US010304468B2

(12) United States Patent
Atti et al.

(10) Patent No.: US 10,304,468 B2
(45) Date of Patent: May 28, 2019

(54) TARGET SAMPLE GENERATION

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/892,130

(22) Filed: Feb. 8, 2018

(65) Prior Publication Data

US 2018/0268828 A1 Sep. 20, 2018

Related U.S. Application Data

(60) Provisional application No. 62/474,010, filed on Mar. 20, 2017.

(51) Int. Cl.
*G10L 19/008* (2013.01)
*G10L 19/005* (2013.01)
(Continued)

(52) U.S. Cl.
CPC ..... *G10L 19/008* (2013.01); *G10L 19/005* (2013.01); *G10L 19/12* (2013.01); *H04S 3/008* (2013.01)

(58) Field of Classification Search
CPC ..... G10L 19/008; G10L 19/005; G10L 19/12; H04S 3/008
See application file for complete search history.

(56) References Cited

U.S. PATENT DOCUMENTS 5,136,578 A * 8/1992 Beshai ..... H04Q 11/06 370/375
8,880,413 B2 * 11/2014 Virette ..... G10L 19/008 381/17

(Continued)

FOREIGN PATENT DOCUMENTS

WO 2010017833 A1 2/2010
WO 2011109374 A1 9/2011
WO 2012105885 A1 8/2012

OTHER PUBLICATIONS

International Search Report and Written Opinion—PCT/US2018/017654—ISA/EPO—dated Apr. 12, 2018.

(Continued)

*Primary Examiner* — Mohammad K Islam
(74) *Attorney, Agent, or Firm* — Toler Law Group, P.C.

(57) ABSTRACT

A method of encoding audio channels includes receiving two or more channels at an encoder and identifying a target channel and a reference channel. The target channel and the reference channel are identified from the two or more channels based on a mismatch value. The method also includes generating a modified target channel by temporally adjusting the target channel based on the mismatch value. The mismatch value is indicative of an amount of temporal mismatch between the target channel and the reference channel. The method also includes determining a temporal correlation value indicative of a temporal correlation between a first signal associated with the reference channel and a second signal associated with the modified target channel. The method also includes comparing the temporal correlation value to a threshold. The method further includes generating missing target samples based on the comparison, a coder type, or both.

27 Claims, 29 Drawing Sheets

(51) Int. Cl.
*H04S 3/00* (2006.01)
*G10L 19/12* (2013.01)

(56) References Cited

U.S. PATENT DOCUMENTS

| | | | | |
|---|---|---|---|---|
| 8,958,566 | B2 * | 2/2015 | Hellmuth | G10L 19/008 381/22 |
| 9,060,236 | B2 * | 6/2015 | Engdegard | G10L 19/008 |
| 9,361,896 | B2 * | 6/2016 | Disch | H04S 3/008 |
| 10,045,145 | B2 * | 8/2018 | Chebiyyam | H04S 7/307 |
| 10,074,373 | B2 * | 9/2018 | Atti | G10L 19/008 |
| 2005/0007452 | A1 * | 1/2005 | McKay, III | G06K 9/36 348/143 |
| 2012/0314776 | A1 * | 12/2012 | Shimizu | H04N 19/597 375/240.25 |
| 2016/0210974 | A1 * | 7/2016 | Disch | G10L 19/008 |
| 2017/0178635 | A1 * | 6/2017 | Atti | G10L 19/008 |
| 2017/0270934 | A1 * | 9/2017 | Atti | G10L 19/002 |
| 2017/0270935 | A1 * | 9/2017 | Atti | G10L 19/008 |
| 2017/0365260 | A1 * | 12/2017 | Chebiyyam | G10L 19/008 |
| 2018/0122385 | A1 * | 5/2018 | Chebiyyam | G10L 19/008 |
| 2018/0204578 | A1 * | 7/2018 | Atti | G10L 19/008 |
| 2018/0204579 | A1 * | 7/2018 | Atti | G10L 19/008 |

OTHER PUBLICATIONS

Lindblom J., et al., "Flexible Sum-Difference Stereo Coding based on Time-Aligned Signal Components", Applications of Signal Processing to Audio and Acoustics , IEEE Workshop on New Peitz, NY, USA, Oct. 16-19, 2005 (Oct. 16, 2005), XP010854377, pp. 255-258.

* cited by examiner

TARGET SAMPLE GENERATION

I. CROSS REFERENCE TO RELATED APPLICATIONS

The present application claims the benefit of U.S. Provisional Patent Application No. 62/474,010, entitled "TARGET SAMPLE GENERATION," filed Mar. 20, 2017, which is expressly incorporated by reference herein in its entirety.

II. FIELD

The present disclosure is generally related to encoding of multiple audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. Generally, a sound source is closer to a first microphone than to a second microphone of the multiple microphones. Accordingly, a second audio signal received from the second microphone may be delayed relative to a first audio signal received from the first microphone due to the distance of the microphones from the sound source. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal. The first audio signal may not be aligned with the second audio signal because of the delay in receiving the second audio signal relative to the first audio signal. The misalignment of the first audio signal relative to the second audio signal may increase the difference between the two audio signals. Because of the increase in the difference, a higher number of bits may be used to encode the side channel signal.

IV. SUMMARY

In a particular implementation, an encoder is configured to receive two or more channels and to identify a target channel and a reference channel. The target channel and the reference channel are identified from the two or more channels based on a mismatch value. The encoder is also configured to generate a modified target channel by temporally adjusting the target channel based on the mismatch value. The mismatch value is indicative of an amount of temporal mismatch between the target channel and the reference channel. The encoder is further configured to determine a temporal correlation value indicative of a temporal correlation between a first signal associated with the reference channel and a second signal associated with the modified target channel. The encoder is further configured to compare the temporal correlation value to a threshold. The encoder is also configured to generate, based on the comparison, missing target samples using at least one of a reference frame based on the reference channel or a target frame based on the modified target channel. The first signal corresponds to a portion of the reference frame, and the second signal corresponds to a portion of the target frame.

In another particular implementation, a method of encoding audio channels includes receiving two or more channels at an encoder and identifying a target channel and a reference channel. The target channel and the reference channel are identified from the two or more channels based on a mismatch value. The method also includes generating a modified target channel by temporally adjusting the target channel based on the mismatch value. The mismatch value is indicative of an amount of temporal mismatch between the target channel and the reference channel. The method also includes determining a temporal correlation value indicative of a temporal correlation between a first signal associated with the reference channel and a second signal associated with the modified target channel. The method also includes comparing the temporal correlation value to a threshold. The method further includes generating, based on the comparison, missing target samples using at least one of a reference frame based on the reference channel or a target frame based on the modified target channel. The first signal corresponds to a portion of the reference frame, and the second signal corresponds to a portion of the target frame.

In another particular implementation, a non-transitory computer-readable medium includes instructions that, when executed by a processor within an encoder, cause the encoder to perform operations including identifying a target channel and a reference channel. The target channel and the reference channel are identified from two or more channels based on a mismatch value. The operations also include generating a modified target channel by temporally adjusting the target channel based on the mismatch value. The mismatch value is indicative of an amount of temporal mismatch between the target channel and the reference channel. The operations also include determining a temporal correlation value indicative of a temporal correlation between a first signal associated with the reference channel and a second signal associated with the modified target channel. The operations also include comparing the temporal correlation value to a threshold. The operations further include generating, based on the comparison, missing target samples using at least one of a reference frame based on the reference channel or a target frame based on the modified target channel. The first signal corresponds to a portion of the reference frame, and the second signal corresponds to a portion of the target frame.

In another particular implementation, a device includes means for identifying a target channel and a reference channel. The target channel and the reference channel are identified from two or more channels based on a mismatch value. The device also includes means for generating a modified target channel by temporally adjusting the target channel based on the mismatch value. The mismatch value is indicative of an amount of temporal mismatch between the target channel and the reference channel. The device also includes means for determining a temporal correlation value indicative of a temporal correlation between a first signal associated with the reference channel and a second signal associated with the modified target channel. The device also includes means for comparing the temporal correlation value to a threshold. The device further includes means for generating, based on the comparison, missing target samples using at least one of a reference frame based on the reference channel or a target frame based on the modified target channel. The first signal corresponds to a portion of the reference frame, and the second signal corresponds to a portion of the target frame.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
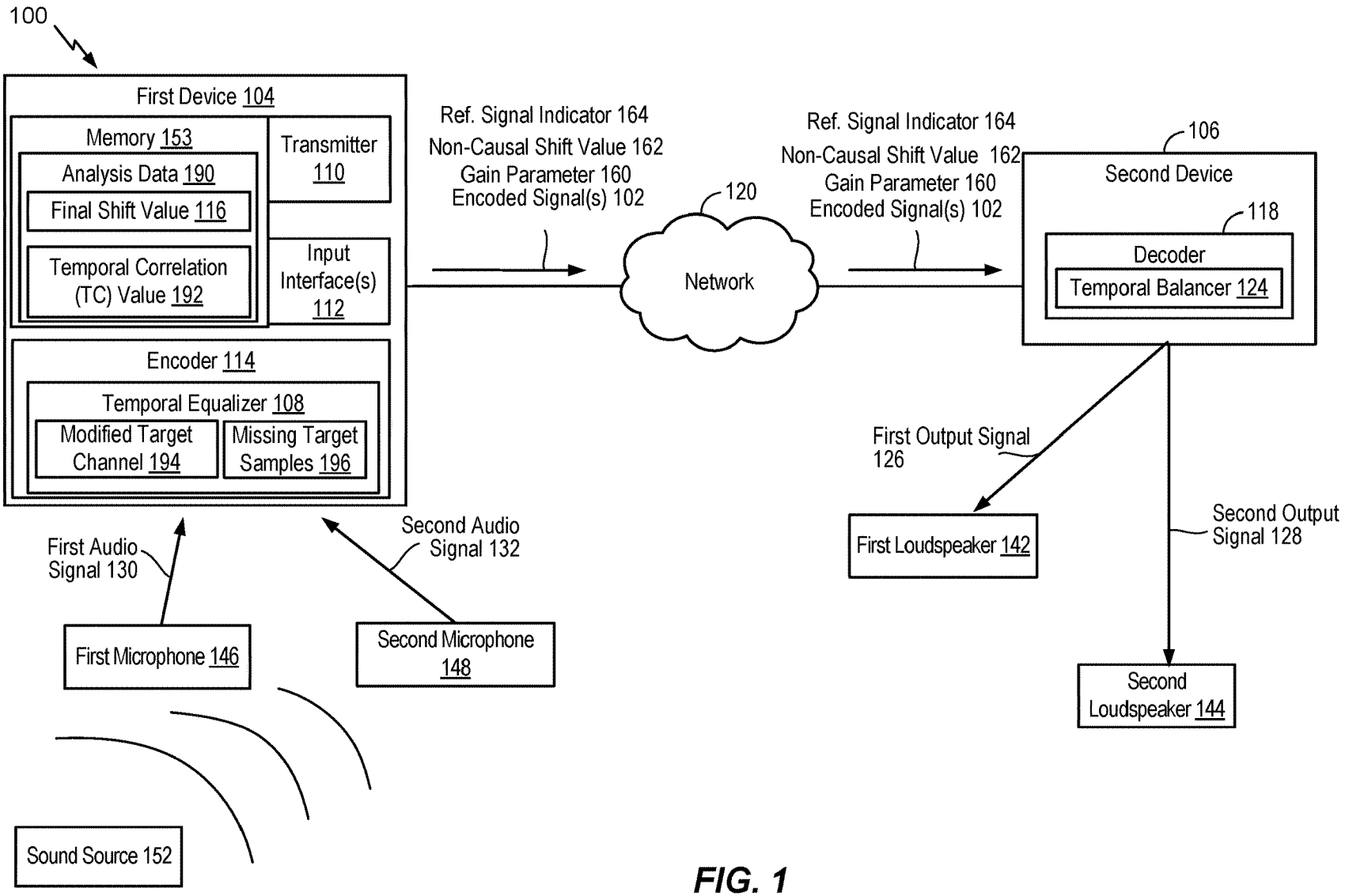
FIG. 1 is a block diagram of a particular illustrative example of a system that includes a device operable to encode multiple audio signals.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", "identifying", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted.

The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

In some examples, the microphones may receive audio from multiple sound sources. The multiple sound sources may include a dominant sound source (e.g., a talker) and one or more secondary sound sources (e.g., a passing car, traffic, background music, street noise). The sound emitted from the dominant sound source may reach the first microphone earlier in time than the second microphone.

An audio signal may be encoded in segments or frames. A frame may correspond to a number of samples (e.g., 640 samples, 1920 samples or 2000 samples). Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded in MS coding. Relatively more bits are spent on the sum signal than on the side signal. PS coding reduces redundancy in each subband by transforming the L/R signals into a sum signal and a set of side parameters. The side parameters may indicate an inter-channel intensity difference (IID), an inter-channel phase difference (IPD), an inter-channel time difference (ITD), etc. The sum signal is waveform coded and transmitted along with the side parameters. In a hybrid system, the side-channel may be waveform coded in the lower bands (e.g., less than 2-3 kilohertz (kHz)) and PS coded in the upper bands (e.g., greater than or equal to 2-3 kHz) where the inter-channel phase preservation is perceptually less critical.

The MS coding and the PS coding may be done in either the frequency domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value or a real value which may vary from frame-to-frame, from one frequency or subband to another, or a combination thereof.

In some cases, the Mid channel and the Side channel may be generated based on the following Formula:

$$M=(c1*L+c2*R),\ S=(c3*L-c4*R), \qquad \text{Formula 3}$$

where c1, c2, c3 and c4 are complex values or real values which may vary from frame-to-frame, from one subband or frequency to another, or a combination thereof. Generating the Mid channel and the Side channel based on Formula 1, Formula 2, or Formula 3 may be referred to as performing a "downmixing" algorithm. A reverse process of generating the Left channel and the Right channel from the Mid channel and the Side channel based on Formula 1, Formula 2, or Formula 3 may be referred to as performing an "upmixing" algorithm.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for certain frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value (e.g., a temporal shift value, a gain value, an energy value, an inter-channel prediction value) indicative of a temporal mismatch (e.g., a shift) of the first audio signal relative to the second audio signal. The shift value (e.g., the mismatch value) may correspond to an amount of temporal delay between receipt of the first audio signal at the first microphone and receipt of the second audio signal at the second microphone. Furthermore, the encoder may determine the shift value on a frame-by-frame basis, e.g., based on each 20 milliseconds (ms) speech/audio frame. For example, the shift value may correspond to an amount of time that a second frame of the second audio signal is delayed with respect to a first frame of the first audio signal.

Alternatively, the shift value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal mismatch (e.g., shift) value may also change from one frame to another. However, in some implementations, the temporal shift value may always be positive to indicate an amount of delay of the "target" channel relative to the "reference" channel. Furthermore, the shift value may correspond to a "non-causal shift" value by which the delayed target channel is "pulled back" in time such that the target channel is aligned (e.g., maximally aligned) with the "reference" channel. "Pulling back" the target channel may correspond to advancing the target channel in time. A "non-causal shift" may correspond to a shift of a delayed audio channel (e.g., a lagging audio channel) relative to a leading audio channel to temporally align the delayed audio channel with the leading audio channel. The downmix algorithm to determine the mid channel and the side channel may be performed on the reference channel and the non-causal shifted target channel.

The encoder may determine the shift value based on the first audio channel and a plurality of shift values applied to the second audio channel. For example, a first frame of the first audio channel, X, may be received at a first time ($m_1$). A first particular frame of the second audio channel, Y, may be received at a second time ($n_1$) corresponding to a first shift value, e.g., shift1=$n_1-m_1$. Further, a second frame of the first audio channel may be received at a third time ($m_2$). A second particular frame of the second audio channel may be received at a fourth time ($n_2$) corresponding to a second shift value, e.g., shift2=$n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a shift value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally mismatched (e.g., not aligned) due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, a time of arrival of audio signals at the microphones from multiple sound sources (e.g., talkers) may vary when the multiple talkers are alternatively talking (e.g., without overlap). In such a case, the encoder may dynamically adjust a temporal shift value based on the talker to identify the reference channel. In some other examples, the multiple talkers may be talking at the same time, which may result in varying temporal shift values depending on who is the loudest talker, closest to the microphone, etc.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular shift value. The encoder may generate a first estimated shift value (e.g., a first estimated mismatch value) based on the comparison values. For example, the first estimated shift value may correspond to a comparison value indicating a higher temporal-similarity (or lower difference) between the first frame of the first audio signal and a corresponding first frame of the second audio signal. A positive shift value (e.g., the first estimated shift value) may indicate that the first audio signal is a leading audio signal (e.g., a temporally leading audio signal) and that the second audio signal is a lagging audio signal (e.g., a temporally lagging audio signal). A frame (e.g., samples) of the lagging audio signal may be temporally delayed relative to a frame (e.g., samples) of the leading audio signal.

The encoder may determine the final shift value (e.g., the final mismatch value) by refining, in multiple stages, a series of estimated shift values. For example, the encoder may first estimate a "tentative" shift value based on comparison values generated from stereo pre-processed and re-sampled versions of the first audio signal and the second audio signal. The encoder may generate interpolated comparison values associated with shift values proximate to the estimated "tentative" shift value. The encoder may determine a second estimated "interpolated" shift value based on the interpolated comparison values. For example, the second estimated "interpolated" shift value may correspond to a particular interpolated comparison value that indicates a higher temporal-similarity (or lower difference) than the remaining interpolated comparison values and the first estimated "tentative" shift value. If the second estimated "interpolated" shift value of the current frame (e.g., the first frame of the first audio signal) is different than a final shift value of a previous frame (e.g., a frame of the first audio signal that precedes the first frame), then the "interpolated" shift value of the current frame is further "amended" to improve the temporal-similarity between the first audio signal and the shifted second audio signal. In particular, a third estimated "amended" shift value may correspond to a more accurate measure of temporal-similarity by searching around the second estimated "interpolated" shift value of the current frame and the final estimated shift value of the previous frame. The third estimated "amended" shift value is further conditioned to estimate the final shift value by limiting any spurious changes in the shift value between frames and further controlled to not switch from a negative shift value to a positive shift value (or vice versa) in two successive (or consecutive) frames as described herein.

In some examples, the encoder may refrain from switching between a positive shift value and a negative shift value or vice-versa in consecutive frames or in adjacent frames. For example, the encoder may set the final shift value to a particular value (e.g., 0) indicating no temporal-shift based on the estimated "interpolated" or "amended" shift value of the first frame and a corresponding estimated "interpolated" or "amended" or final shift value in a particular frame that precedes the first frame. To illustrate, the encoder may set the final shift value of the current frame (e.g., the first frame) to indicate no temporal-shift, i.e., shift1=0, in response to determining that one of the estimated "tentative" or "interpolated" or "amended" shift value of the current frame is positive and the other of the estimated "tentative" or "interpolated" or "amended" or "final" estimated shift value of the previous frame (e.g., the frame preceding the first frame) is negative. Alternatively, the encoder may also set the final shift value of the current frame (e.g., the first frame) to indicate no temporal-shift, i.e., shift1=0, in response to determining that one of the estimated "tentative" or "interpolated" or "amended" shift value of the current frame is negative and the other of the estimated "tentative" or "interpolated" or "amended" or "final" estimated shift value of the previous frame (e.g., the frame preceding the first frame) is positive. As referred to herein, a "temporal-shift" may correspond to a time-shift, a time-offset, a sample shift, a sample offset, or offset.

The encoder may select a frame of the first audio signal or the second audio signal as a "reference" or "target" based on the shift value. For example, in response to determining that the final shift value is positive, the encoder may generate a reference channel or signal indicator having a first value (e.g., 0) indicating that the first audio signal is a "reference" signal and that the second audio signal is the "target" signal. Alternatively, in response to determining that the final shift value is negative, the encoder may generate the reference channel or signal indicator having a second value (e.g., 1) indicating that the second audio signal is the "reference" signal and that the first audio signal is the "target" signal.

The reference signal may correspond to a leading signal, whereas the target signal may correspond to a lagging signal. In a particular aspect, the reference signal may be the same signal that is indicated as a leading signal by the first estimated shift value. In an alternate aspect, the reference signal may differ from the signal indicated as a leading signal by the first estimated shift value. The reference signal may be treated as the leading signal regardless of whether the first estimated shift value indicates that the reference signal corresponds to a leading signal. For example, the reference signal may be treated as the leading signal by shifting (e.g., adjusting) the other signal (e.g., the target signal) relative to the reference signal.

In some examples, the encoder may identify or determine at least one of the target signal or the reference signal based on a mismatch value (e.g., an estimated shift value or the final shift value) corresponding to a frame to be encoded and mismatch (e.g., shift) values corresponding to previously encoded frames. The encoder may store the mismatch values in a memory. The target channel may correspond to a temporally lagging audio channel of the two audio channels and the reference channel may correspond to a temporally leading audio channel of the two audio channels. In some examples, the encoder may identify the temporally lagging channel and may not maximally align the target channel with the reference channel based on the mismatch values from the memory. For example, the encoder may partially align the target channel with the reference channel based on one or more mismatch values. In some other examples, the encoder may progressively adjust the target channel over a series of frames by "non-causally" distributing the overall mismatch value (e.g., 100 samples) into smaller mismatch values (e.g., 25 samples, 25 samples, 25 samples, and 25 samples) over encoded of multiple frames (e.g., four frames).

The encoder may estimate a relative gain (e.g., a relative gain parameter) associated with the reference signal and the non-causal shifted target signal. For example, in response to determining that the final shift value is positive, the encoder may estimate a gain value to normalize or equalize the energy or power levels of the first audio signal relative to the second audio signal that is offset by the non-causal shift value (e.g., an absolute value of the final shift value). Alternatively, in response to determining that the final shift value is negative, the encoder may estimate a gain value to normalize or equalize the power levels of the non-causal shifted first audio signal relative to the second audio signal. In some examples, the encoder may estimate a gain value to normalize or equalize the energy or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal (e.g., the shifted target signal or the unshifted target signal), the non-causal shift value, and the relative gain parameter. The side signal may correspond to a difference between first samples of the first frame of the first audio signal and selected samples of a selected frame of the second audio signal. The encoder may select the selected frame based on the final shift value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal shift value, the relative gain parameter, the reference channel or signal indicator, or a combination thereof.

The encoder may generate at least one encoded signal (e.g., a mid signal, a side signal, or both) based on the reference signal, the target signal (e.g., the shifted target signal or the unshifted target signal), the non-causal shift value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal shift value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal shift value, the relative gain parameter, the reference channel (or signal) indicator, or a combination thereof. As referred to herein, an audio "signal" corresponds to an audio "channel." As referred to herein, a "shift value" corresponds to an offset value, a mismatch value, a time-offset value, a sample shift value, or a sample offset value. As referred to herein, "shifting" a target signal may correspond to shifting location(s) of data representative of the target signal, copying the data to one or more memory buffers, moving one or more memory pointers associated with the target signal, or a combination thereof.

According to some encoding implementations, non-causal shifting may be used to temporally align a reference channel and a target channel. For example, the target channel may be temporally shifted by a non-causal shift value to generate a modified target channel that is substantially temporally aligned with the reference channel. In shifting the target channel to generate the modified target channel, corrupt portions (e.g., missing target samples) may become present. For example, unavailable samples from the target channel after non-causal shifting may exist.

To generate the missing target samples, the encoder may determine a temporal correlation value that indicates a temporal similarity and temporal short-term/long-term correlation between a first signal associated with the reference channel and a second signal associated with the modified target channel. In one example implementation, the first signal and second signal correspond to a portion of a reference frame of the reference channel and a corresponding portion of a target frame of the target channel. As a non-limiting example, the reference frame may have a frame duration of 20 milliseconds (ms) and the first signal may correspond to a 5 ms portion of the reference frame. Similarly, the target frame may have a frame duration of 20 ms and the second signal may correspond to a 5 ms portion of the target frame. A high temporal correlation value may indicate that the reference channel and the modified target channel are substantially temporally aligned. A high temporal correlation value may also indicate that the short-term and long-term correlation is sufficiently similar. A low temporal correlation value may indicate that the reference channel and the modified target channel are substantially temporally misaligned. If the temporal correlation value is relatively high (e.g., satisfies a first threshold), the encoder may generate the missing target samples based on the reference channel. For example, if there is a large (e.g., strong) temporal correlation between the reference channel and the modified target channel after the non-causal shifting, the missing target samples may be generated based on the reference channel. If the temporal correlation value is relatively low (e.g., fails to satisfy a second threshold), the encoder may generate the missing target samples independently of the reference channel. As a non-limiting example, if there is a small (e.g., weak) temporal correlation between the reference channel and the modified target channel after the non-causal shifting, the missing target samples may be generated based on random noise filtered from a past set of samples of the target channel, based on extrapolation of the target channel itself, based on zero values, or a combination thereof.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include a temporal equalizer 108 and may be configured to downmix and encode multiple audio signals, as described herein. The first device 104 may also include a memory 153 configured to store analysis data 190. The second device 106 may include a decoder 118. The decoder 118 may include a temporal balancer 124 that is configured to upmix and render the multiple channels. The second device 106 may be coupled to a first loudspeaker 142, a second loudspeaker 144, or both.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. The first microphone 146 and the second microphone 148 may receive audio from a sound source 152 (e.g., a user, a speaker, ambient noise, a musical instrument, etc.). In a particular aspect, the first microphone 146, the second microphone 148, or both, may receive audio from multiple sound sources. The multiple sound sources may include a dominant (or most dominant) sound source (e.g., the sound source 152) and one or more secondary sound sources. The one or more secondary sound sources may correspond to traffic, background music, another talker, street noise, etc. The sound source 152 (e.g., the dominant sound source) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132.

The first device 104 may store the first audio signal 130, the second audio signal 132, or both, in the memory 153. The temporal equalizer 108 may determine a final shift value 116 (e.g., a non-causal shift value) indicative of the shift (e.g., a non-causal shift) of the first audio signal 130 (e.g., "target") relative to the second audio signal 132 (e.g., "reference"), as further described with reference to FIGS. 10A-10B. The final shift value 116 (e.g., a final mismatch value) may be indicative of an amount of temporal mismatch (e.g., time delay) between the first audio signal and the second audio signal. As referred to herein, "time delay" may correspond to "temporal delay." The temporal mismatch may be indicative of a time delay between receipt, via the first microphone 146, of the first audio signal 130 and receipt, via the second microphone 148, of the second audio signal 132.

A first value (e.g., a positive value) of the final shift value 116 may indicate that the second audio signal 132 is delayed relative to the first audio signal 130. In this example, the first audio signal 130 may correspond to a leading signal and the second audio signal 132 may correspond to a lagging signal. A second value (e.g., a negative value) of the final shift value 116 may indicate that the first audio signal 130 is delayed relative to the second audio signal 132. In this example, the first audio signal 130 may correspond to a lagging signal and the second audio signal 132 may correspond to a leading signal. A third value (e.g., 0) of the final shift value 116 may indicate no delay between the first audio signal 130 and the second audio signal 132.

In some implementations, the third value (e.g., 0) of the final shift value 116 may indicate that delay between the first audio signal 130 and the second audio signal 132 has switched sign. For example, a first particular frame of the first audio signal 130 may precede the first frame. The first particular frame and a second particular frame of the second audio signal 132 may correspond to the same sound emitted by the sound source 152. The same sound may detected earlier at the first microphone 146 than at the second microphone 148. The delay between the first audio signal 130 and the second audio signal 132 may switch from having the first particular frame delayed with respect to the second particular frame to having the second frame delayed with respect to the first frame. Alternatively, the delay between the first audio signal 130 and the second audio signal 132 may switch from having the second particular frame delayed with respect to the first particular frame to having the first frame delayed with respect to the second frame. The temporal equalizer 108 may set the final shift value 116 to indicate the third value (e.g., 0), as further described with reference to FIGS. 10A-10B, in response to determining that the delay between the first audio signal 130 and the second audio signal 132 has switched sign.

The temporal equalizer 108 may generate a reference signal indicator 164 (e.g., a reference channel indicator) based on the final shift value 116, as further described with reference to FIG. 12. For example, the temporal equalizer 108 may, in response to determining that the final shift value 116 indicates a first value (e.g., a positive value), generate the reference signal indicator 164 to have a first value (e.g., 0) indicating that the first audio signal 130 is a "reference" signal. The temporal equalizer 108 may determine that the second audio signal 132 corresponds to a "target" signal in response to determining that the final shift value 116 indicates the first value (e.g., a positive value). Alternatively, the temporal equalizer 108 may, in response to determining that the final shift value 116 indicates a second value (e.g., a negative value), generate the reference signal indicator 164 to have a second value (e.g., 1) indicating that the second audio signal 132 is the "reference" signal. The temporal equalizer 108 may determine that the first audio signal 130 corresponds to the "target" signal in response to determining that the final shift value 116 indicates the second value (e.g., a negative value). The temporal equalizer 108 may, in response to determining that the final shift value 116 indicates a third value (e.g., 0), generate the reference signal indicator 164 to have a first value (e.g., 0) indicating that the first audio signal 130 is a "reference" signal. The temporal equalizer 108 may determine that the second audio signal 132 corresponds to a "target" signal in response to determining that the final shift value 116 indicates the third value (e.g., 0). Alternatively, the temporal equalizer 108 may, in response to determining that the final shift value 116 indicates the third value (e.g., 0), generate the reference signal indicator 164 to have a second value (e.g., 1) indicating that the second audio signal 132 is a "reference" signal. The temporal equalizer 108 may determine that the first audio signal 130 corresponds to a "target" signal in response to determining that the final shift value 116 indicates the third value (e.g., 0). In some implementations, the temporal equalizer 108 may, in response to determining that the final shift value 116 indicates a third value (e.g., 0), leave the reference signal indicator 164 unchanged. For example, the reference signal indicator 164 may be the same as a reference signal indicator corresponding to the first particular frame of the first audio signal 130. The temporal equalizer 108 may generate a non-causal shift value 162 (e.g., a non-causal mismatch value) indicating an absolute value of the final shift value 116.

The temporal equalizer 108 may generate a gain parameter 160 (e.g., a codec gain parameter) based on samples of the "target" signal and based on samples of the "reference" signal. For example, the temporal equalizer 108 may select samples of the second audio signal 132 based on the non-causal shift value 162. As referred to herein, selecting samples of an audio signal based on a shift value may correspond to generating a modified (e.g., time-shifted) audio signal by adjusting (e.g., shifting) the audio signal based on the shift value and selecting samples of the modified audio signal. For example, the temporal equalizer 108 may generate a time-shifted second audio signal by shifting the second audio signal 132 based on the non-causal shift value 162 and may select samples of the time-shifted second audio signal. The temporal equalizer 108 may adjust (e.g., shift) a single audio signal (e.g., a single channel) of the first audio signal 130 or the second audio signal 132 based on the non-causal shift value 162. Alternatively, the temporal equalizer 108 may select samples of the second audio signal 132 independent of the non-causal shift value 162. The temporal equalizer 108 may, in response to determining that the first audio signal 130 is the reference signal, determine the gain parameter 160 of the selected samples based on the first samples of the first frame of the first audio signal 130. Alternatively, the temporal equalizer 108 may, in response to determining that the second audio signal 132 is the reference signal, determine the gain parameter 160 of the first samples based on the selected samples. As an example, the gain parameter 160 may be based on one of the following Equations:

Equation 1a $$g_D = \frac{\sum_{n=0}^{N-N_1} Ref(n)Targ(n+N_1)}{\sum_{n=0}^{N-N_1} Targ^2(n+N_1)},$$

Equation 1b $$g_D = \frac{\sum_{n=0}^{N-N_1} |Ref(n)|}{\sum_{n=0}^{N-N_1} |Targ(n+N_1)|},$$

Equation 1c $$g_D = \frac{\sum_{n=0}^{N} Ref(n)Targ(n)}{\sum_{n=0}^{N} Targ^2(n)},$$

Equation 1d $$g_D = \frac{\sum_{n=0}^{N} |Ref(n)|}{\sum_{n=0}^{N} |Targ(n)|},$$

-continued $$g_D = \frac{\sum_{n=0}^{N-N_1} Ref(n)Targ(n)}{\sum_{n=0}^{N} Ref^2(n)}, \quad \text{Equation 1e}$$

$$g_D = \frac{\sum_{n=0}^{N-N_1} |Targ(n)|}{\sum_{n=0}^{N} |Ref(n)|}, \quad \text{Equation 1f}$$

where $g_D$ corresponds to the relative gain parameter 160 for downmix processing, Ref(n) corresponds to samples of the "reference" signal, $N_1$ corresponds to the non-causal shift value 162 of the first frame, and T arg(n+$N_1$) corresponds to samples of the "target" signal. The gain parameter 160 ($g_D$) may be modified, e.g., based on one of the Equations 1a-1f, to incorporate long term smoothing/hysteresis logic to avoid large jumps in gain between frames. When the target signal includes the first audio signal 130, the first samples may include samples of the target signal and the selected samples may include samples of the reference signal. When the target signal includes the second audio signal 132, the first samples may include samples of the reference signal, and the selected samples may include samples of the target signal.

In some implementations, the temporal equalizer 108 may generate the gain parameter 160 based on treating the first audio signal 130 as a reference signal and treating the second audio signal 132 as a target signal, irrespective of the reference signal indicator 164. For example, the temporal equalizer 108 may generate the gain parameter 160 based on one of the Equations 1a-1f where Ref(n) corresponds to samples (e.g., the first samples) of the first audio signal 130 and T arg(n+$N_1$) corresponds to samples (e.g., the selected samples) of the second audio signal 132. In alternate implementations, the temporal equalizer 108 may generate the gain parameter 160 based on treating the second audio signal 132 as a reference signal and treating the first audio signal 130 as a target signal, irrespective of the reference signal indicator 164. For example, the temporal equalizer 108 may generate the gain parameter 160 based on one of the Equations 1a-1f where Ref(n) corresponds to samples (e.g., the selected samples) of the second audio signal 132 and T arg(n+$N_1$) corresponds to samples (e.g., the first samples) of the first audio signal 130.

According to one implementation, the temporal equalizer 108 may be configured to shift the target channel (e.g., the first audio signal 130) by the final shift value 116 to generate a modified target channel 194. The encoder 114 may determine a temporal correlation value 192 between the modified target channel 194 and the reference channel (e.g., the second audio signal 132). The temporal correlation value 192 may be indicative of a temporal correlation between the reference channel and the modified target channel 194. According to some implementations, the temporal correlation value 192 may be indicative of a temporal correlation between a reference frame of the reference channel and a corresponding target frame of the modified target channel 194. The temporal correlation value 192 may be stored as analysis data 190 in the memory 153.

The temporal correlation value 192 may be determined based on a difference between the final shift value 116 and a "true" shift. For example, the true shift may be the shift amount to be applied to the target channel to generate the modified target channel 194 being temporally aligned with the reference channel. Because the non-causal shifting may be performed over several frames, the temporal correlation value 192 may be normalized by an allowable temporal shift amount per frame. For example, if a given frame may be shifted by up to 20 ms (e.g., the allowable temporal shift amount), the temporal correlation value 192 may be normalized based on the 20 ms shift amount. To illustrate, if a temporal difference between the reference frame and the target frame is 5 ms, the temporal correlation value 192 may be determined by subtracting the temporal difference from the allowable temporal shift amount (e.g., 20 ms-5 ms) and normalizing with respect to the allowable temporal shift amount (e.g., 15 ms/20 ms). Thus, the temporal correlation value 192 may be "0.75".

According to another implementation, the temporal correlation value 192 may be based on temporal misalignment between the reference channel and the modified target channel 194. As a non-limiting example, if temporal difference between the reference channel and the modified target channel 192 is 80 ms, the temporal correlation value 192 may be based on the 80 ms difference. One or more thresholds may be set by the encoder 114 to determine the correlation based on the temporal correlation value 192 (e.g., 80 ms). As a non-limiting example, a first threshold may be equal to 70 ms, a second threshold may be equal to 50 ms, and a third threshold may be equal to 25 ms. Because the temporal correlation value 192 is greater than or equal to the first threshold, there may be a low correlation between the reference channel and the modified target channel 194. As a result, zero value may be used to generate the missing target samples 196. In other scenarios where the temporal correlation value 192 is between the first and second thresholds, random noise filtered from the target channel may be used to generate the missing target samples 196. In other scenarios where the temporal correlation value 192 is between the second and third thresholds, extrapolations based on the target channel may be used to generate the missing target samples 196. In other scenarios where the temporal correlation value 192 is lower than the third threshold, the missing target samples 196 may be generated based on the reference channel. It should be understood that the previous scenarios are for illustrative purposes only and should not be construed as limiting. For example, in other scenarios, a single threshold may be used in conjunction with the temporal correlation value 192 to determine how to generate the missing target samples 196.

According to one implementation, the temporal correlation value 192 may range from zero to one. A temporal correlation value 192 of one indicates a "strong correlation" between the reference channel and the modified target channel 194. For example, a temporal correlation value 192 of one may indicate that the reference channel and the modified target channel 194 are temporally aligned. A temporal correlation value 192 of zero indicates a "weak correlation" between the reference channel and the modified target channel 194. For example, a temporal correlation value 192 of zero may indicate that the reference channel and the modified target channel 194 are substantially temporally misaligned.

According to one implementation, the temporal correlation value 192 may range from zero to one. The temporal correlation value 192 may be based on the comparison values (e.g., cross-correlation values) generated to determine either the tentative shift value, the comparison values used to determine the interpolated shift value, or any other comparison values generated in the process of determining the final shift value 116. In a particular implementation, the comparison value corresponding to the final shift value 116 may be used as the temporal correlation value 192.

Because target samples of a corresponding target frame are shifted with respect to the target channel (e.g., the first audio signal 130) by the final shift value 116, target samples of the target frame may be missing as a result of the shift. For example, the missing target samples may correspond to target samples of the first audio signal 130 that are time-shifted out of the target frame as a result of the shift. According to some implementations, the temporal equalizer 108 may generate a mid signal based on samples of the reference channel and samples (e.g., time-shifted and adjusted samples) of the modified target channel 194. Time-shifting may result in the mid signal including at least one "corrupt" portion. In a particular aspect, a corrupt portion includes sample information from the reference channel and excludes sample information from the target channel. In some cases, the unavailable samples from the target channel after non-causal shifting may be predicted from other information (e.g., random noise filtered from a past set of samples of the target channel, extrapolations of the target channel, the reference channel, etc.). For example, the temporal equalizer 108 may generate predicted samples based on the other information. The prediction (i.e., the predicted samples) may be imperfect, such that the predicted samples differ from the unavailable samples of the target channel.

The temporal equalizer 108 may compare the temporal correlation value 192 to one or more thresholds to determine how to generate the missing target samples 196. For example, the temporal equalizer 108 may compare the temporal correlation value 192 to a first threshold. As a non-limiting example, the first threshold may be "0.8". Thus, if the temporal correlation value 192 is greater than or equal to "0.8", the temporal correlation value 192 may satisfy the first threshold. If the temporal correlation value 192 satisfies the first threshold, there may be a high correlation between the reference channel and the modified target channel 194. If the temporal correlation value 192 satisfies the first threshold (e.g., if the reference channel and the modified target channel 194 are substantially temporally aligned), the encoder 114 may generate the missing target samples 196 based on the reference channel. For example, the encoder 114 may use reference samples associated with the reference channel to generate the missing target samples 196 resulting from time-shifting the target channel.

If the temporal correlation value 192 fails to satisfy the first threshold, the encoder 114 may determine whether the temporal correlation value 192 satisfies a second threshold. As a non-limiting example, the second threshold may be "0.1". Thus, if the temporal correlation value 192 is less than or equal to "0.1", the temporal correlation value 192 may fail to satisfy the second threshold. If the temporal correlation value 192 fails to satisfy the second threshold, there may be a low correlation between the reference channel and the modified target channel 194. If the temporal correlation value 192 fails to satisfy the second threshold (e.g., if the reference channel and the modified target channel 194 are substantially temporally misaligned), the encoder 114 may generate the missing target samples 196 independent of the reference channel.

To illustrate, the encoder 114 may bypass use of (i.e., not use) the reference channel in generation of the missing target samples 196 in response to the determination that the temporal correlation value 192 fails to satisfy the second threshold. According to one implementation, the missing target samples 196 may be generated based on random noise filtered from a past set of samples of the modified target channel 194 using a linear predication filter in response to the determination that the temporal correlation value 192 fails to satisfy the second threshold. According to another implementation, the missing target samples 196 may be set to zero values in response to the determination that the temporal correlation value 192 fails to satisfy the second threshold. According to another implementation, the missing target samples 196 may be extrapolated from the modified target channel 194 in response to the determination that the temporal correlation value 192 fails to satisfy the second threshold. According to another implementation, the missing target samples 196 may be generated based on a scaled excitation signal from the reference channel. The scaled excitation signal may be derived by performing an LPC analysis operation on the reference channel and filtering this scaled excitation signal using a linear predication filter derived from the available samples of the target channel.

If the temporal correlation value 192 satisfies the second threshold and fails to satisfy the first threshold, the encoder 114 may generate the missing target samples 196 based partially on the reference channel and based partially independent of the reference channel. As a non-limiting example, if the temporal correlation value 192 is between "0.8" and "0.1", the encoder 114 may apply a first weight (w1) to an algorithm for generating the missing target samples 196 based on the reference samples of the reference channel and may apply a second weight (w2) to an algorithm for generating the missing target samples 196 independent of the reference channel. To illustrate, a first number of the missing target samples 196 may be generated based on the reference channel, and a second number of the missing target samples 196 may be generate based on the target channel. In other implementations, the missing target samples 196 may be generated based on the reference channel, the target channel, zero values, random noise, or a combination thereof. In another alternative implementation, the weights (w1, w2) may not be dependent on whether the temporal correlation value 192 satisfies a threshold. For example, the weights (w1, w2) may be based on a mapping function from the actual value of the temporal correlation value 192. It should be noted that although only two weights (w1, w2) are described, there could be alternative implementations where there are more than two techniques for predicting the missing target channel samples, thus leading to multiple weights.

The temporal equalizer 108 may generate one or more encoded signals 102 (e.g., a mid channel signal, a side channel signal, or both) based on the first samples, the selected samples, and the relative gain parameter 160 for downmix processing. For example, the temporal equalizer 108 may generate the mid signal based on one of the following Equations:

$$M=\mathrm{Ref}(n)+g_D T\,\arg(n+N_1), \qquad \text{Equation 2a}$$

$$M=\mathrm{Ref}(n)+T\,\arg(n+N_1), \qquad \text{Equation 2b}$$

where M corresponds to the mid channel signal, $g_D$ corresponds to the relative gain parameter 160 for downmix processing, Ref(n) corresponds to samples of the "reference" signal, $N_1$ corresponds to the non-causal shift value 162 of the first frame, and T $\arg(n+N_1)$ corresponds to samples of the "target" signal.

The temporal equalizer 108 may generate the side channel signal based on one of the following Equations:

$$S=\mathrm{Ref}(n)-g_D T\,\arg(n+N_1), \qquad \text{Equation 3a}$$

$$S=g_D\mathrm{Ref}(n)-T\,\arg(n+N_1), \qquad \text{Equation 3b}$$

where S corresponds to the side channel signal, $g_D$ corresponds to the relative gain parameter 160 for downmix processing, Ref(n) corresponds to samples of the "reference" signal, $N_1$ corresponds to the non-causal shift value 162 of the first frame, and T arg(n+$N_1$) corresponds to samples of the "target" signal.

The transmitter 110 may transmit the encoded signals 102 (e.g., the mid channel signal, the side channel signal, or both), the reference signal indicator 164, the non-causal shift value 162, the gain parameter 160, or a combination thereof, via the network 120, to the second device 106. In some implementations, the transmitter 110 may store the encoded signals 102 (e.g., the mid channel signal, the side channel signal, or both), the reference signal indicator 164, the non-causal shift value 162, the gain parameter 160, or a combination thereof, at a device of the network 120 or a local device for further processing or decoding later.

The decoder 118 may decode the encoded signals 102. The temporal balancer 124 may perform upmixing to generate a first output signal 126 (e.g., corresponding to first audio signal 130), a second output signal 128 (e.g., corresponding to the second audio signal 132), or both. The second device 106 may output the first output signal 126 via the first loudspeaker 142. The second device 106 may output the second output signal 128 via the second loudspeaker 144.

The system 100 may thus enable the temporal equalizer 108 to encode the side channel signal using fewer bits than the mid signal. The first samples of the first frame of the first audio signal 130 and selected samples of the second audio signal 132 may correspond to the same sound emitted by the sound source 152 and hence a difference between the first samples and the selected samples may be lower than between the first samples and other samples of the second audio signal 132. The side channel signal may correspond to the difference between the first samples and the selected samples.

Figure 2:
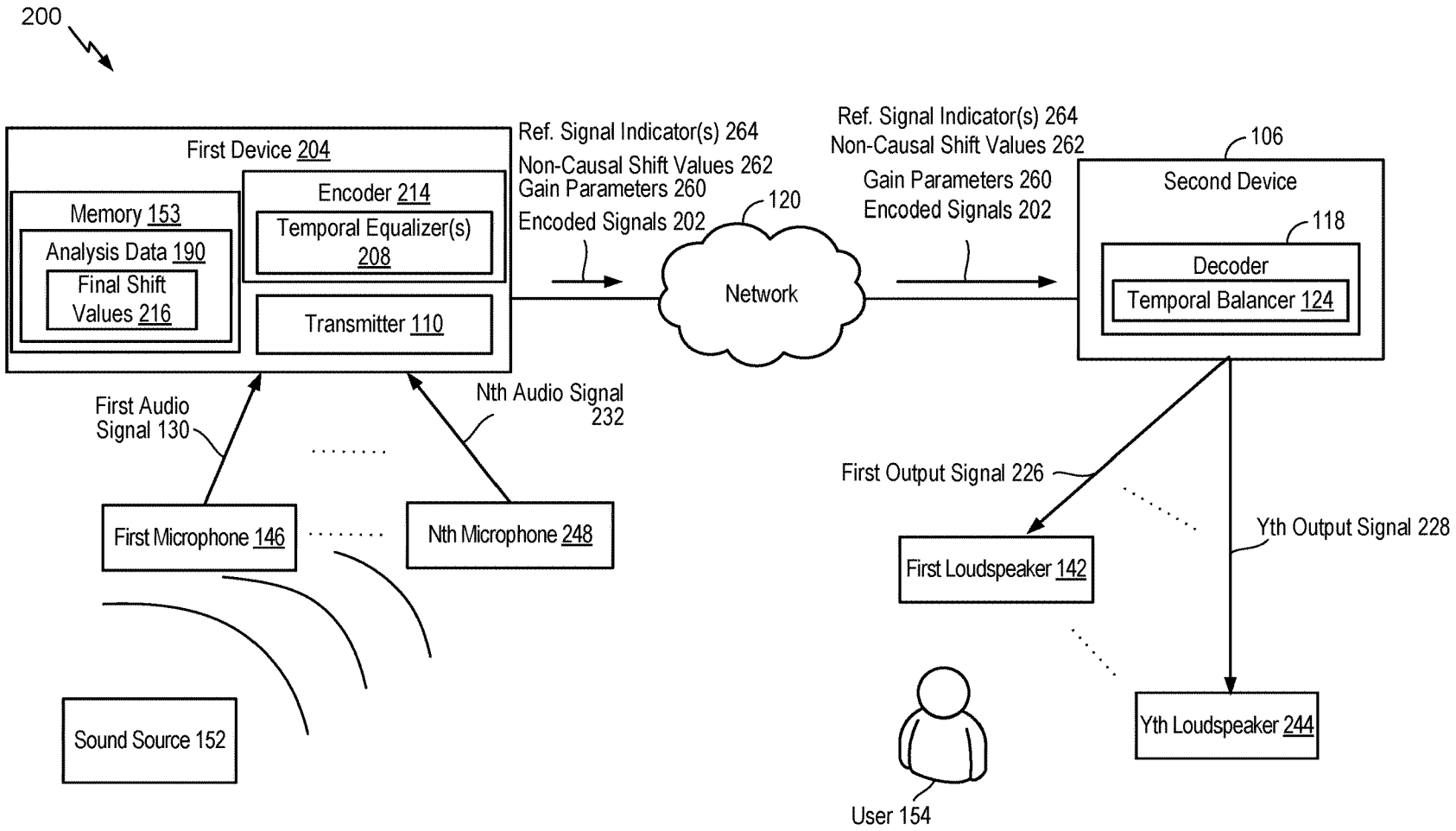
FIG. 2 is a diagram illustrating another example of a system that includes the device of FIG. 1.

Referring to FIG. 2, a particular illustrative aspect of a system is disclosed and generally designated 200. The system 200 includes a first device 204 coupled, via the network 120, to the second device 106. The first device 204 may correspond to the first device 104 of FIG. 1 The system 200 differs from the system 100 of FIG. 1 in that the first device 204 is coupled to more than two microphones. For example, the first device 204 may be coupled to the first microphone 146, an Nth microphone 248, and one or more additional microphones (e.g., the second microphone 148 of FIG. 1). The second device 106 may be coupled to the first loudspeaker 142, a Yth loudspeaker 244, one or more additional speakers (e.g., the second loudspeaker 144), or a combination thereof. The first device 204 may include an encoder 214. The encoder 214 may correspond to the encoder 114 of FIG. 1. The encoder 214 may include one or more temporal equalizers 208. For example, the temporal equalizer(s) 208 may include the temporal equalizer 108 of FIG. 1.

During operation, the first device 204 may receive more than two audio signals. For example, the first device 204 may receive the first audio signal 130 via the first microphone 146, an Nth audio signal 232 via the Nth microphone 248, and one or more additional audio signals (e.g., the second audio signal 132) via the additional microphones (e.g., the second microphone 148).

The temporal equalizer(s) 208 may generate one or more reference signal indicators 264, final shift values 216, non-causal shift values 262, gain parameters 260, encoded signals 202, or a combination thereof, as further described with reference to FIGS. 14-15. For example, the temporal equalizer(s) 208 may determine that the first audio signal 130 is a reference signal and that each of the Nth audio signal 232 and the additional audio signals is a target signal. The temporal equalizer(s) 208 may generate the reference signal indicator 164, the final shift values 216, the non-causal shift values 262, the gain parameters 260, and the encoded signals 202 corresponding to the first audio signal 130 and each of the Nth audio signal 232 and the additional audio signals, as described with reference to FIG. 14.

The reference signal indicators 264 may include the reference signal indicator 164. The final shift values 216 may include the final shift value 116 indicative of a shift of the second audio signal 132 relative to the first audio signal 130, a second final shift value indicative of a shift of the Nth audio signal 232 relative to the first audio signal 130, or both, as further described with reference to FIG. 14. The non-causal shift values 262 may include the non-causal shift value 162 corresponding to an absolute value of the final shift value 116, a second non-causal shift value corresponding to an absolute value of the second final shift value, or both, as further described with reference to FIG. 14. The gain parameters 260 may include the gain parameter 160 of selected samples of the second audio signal 132, a second gain parameter of selected samples of the Nth audio signal 232, or both, as further described with reference to FIG. 14. The encoded signals 202 may include at least one of the encoded signals 102. For example, the encoded signals 202 may include the side channel signal corresponding to first samples of the first audio signal 130 and selected samples of the second audio signal 132, a second side channel corresponding to the first samples and selected samples of the Nth audio signal 232, or both, as further described with reference to FIG. 14. The encoded signals 202 may include a mid channel signal corresponding to the first samples, the selected samples of the second audio signal 132, and the selected samples of the Nth audio signal 232, as further described with reference to FIG. 14.

In some implementations, the temporal equalizer(s) 208 may determine multiple reference signals and corresponding target signals, as described with reference to FIG. 15. For example, the reference signal indicators 264 may include a reference signal indicator corresponding to each pair of reference signal and target signal. To illustrate, the reference signal indicators 264 may include the reference signal indicator 164 corresponding to the first audio signal 130 and the second audio signal 132. The final shift values 216 may include a final shift value corresponding to each pair of reference signal and target signal. For example, the final shift values 216 may include the final shift value 116 corresponding to the first audio signal 130 and the second audio signal 132. The non-causal shift values 262 may include a non-causal shift value corresponding to each pair of reference signal and target signal. For example, the non-causal shift values 262 may include the non-causal shift value 162 corresponding to the first audio signal 130 and the second audio signal 132. The gain parameters 260 may include a gain parameter corresponding to each pair of reference signal and target signal. For example, the gain parameters 260 may include the gain parameter 160 corresponding to the first audio signal 130 and the second audio signal 132. The encoded signals 202 may include a mid channel signal and a side channel signal corresponding to each pair of reference signal and target signal. For example, the encoded signals 202 may include the encoded signals 102 corresponding to the first audio signal 130 and the second audio signal 132.

The transmitter 110 may transmit the reference signal indicators 264, the non-causal shift values 262, the gain parameters 260, the encoded signals 202, or a combination thereof, via the network 120, to the second device 106. The decoder 118 may generate one or more output signals based on the reference signal indicators 264, the non-causal shift values 262, the gain parameters 260, the encoded signals 202, or a combination thereof. For example, the decoder 118 may output a first output signal 226 via the first loudspeaker 142, a Yth output signal 228 via the Yth loudspeaker 244, one or more additional output signals (e.g., the second output signal 128) via one or more additional loudspeakers (e.g., the second loudspeaker 144), or a combination thereof.

The system 200 may thus enable the temporal equalizer(s) 208 to encode more than two audio signals. For example, the encoded signals 202 may include multiple side channel signals that are encoded using fewer bits than corresponding mid channels by generating the side channel signals based on the non-causal shift values 262.

Figure 3:
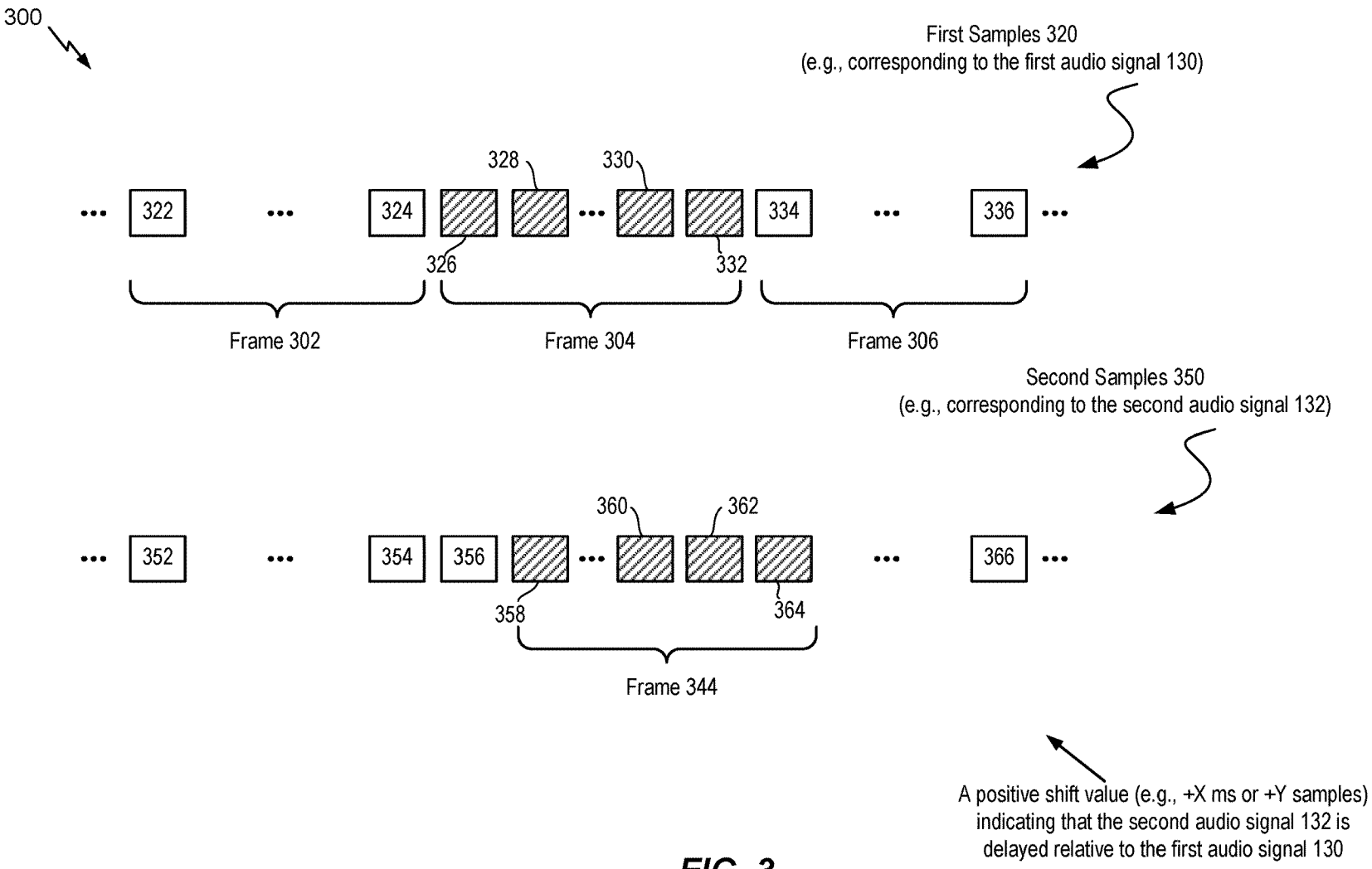
FIG. 3 is a diagram illustrating particular examples of samples that may be encoded by the device of FIG. 1.

Referring to FIG. 3, illustrative examples of samples are shown and generally designated 300. At least a subset of the samples 300 may be encoded by the first device 104, as described herein.

The samples 300 may include first samples 320 corresponding to the first audio signal 130, second samples 350 corresponding to the second audio signal 132, or both. The first samples 320 may include a sample 322, a sample 324, a sample 326, a sample 328, a sample 330, a sample 332, a sample 334, a sample 336, one or more additional samples, or a combination thereof. The second samples 350 may include a sample 352, a sample 354, a sample 356, a sample 358, a sample 360, a sample 362, a sample 364, a sample 366, one or more additional samples, or a combination thereof.

The first audio signal 130 may correspond to a plurality of frames (e.g., a frame 302, a frame 304, a frame 306, or a combination thereof). Each of the plurality of frames may correspond to a subset of samples (e.g., corresponding to 20 ms, such as 640 samples at 32 kHz or 960 samples at 48 kHz) of the first samples 320. For example, the frame 302 may correspond to the sample 322, the sample 324, one or more additional samples, or a combination thereof. The frame 304 may correspond to the sample 326, the sample 328, the sample 330, the sample 332, one or more additional samples, or a combination thereof. The frame 306 may correspond to the sample 334, the sample 336, one or more additional samples, or a combination thereof.

The sample 322 may be received at the input interface(s) 112 of FIG. 1 at approximately the same time as the sample 352. The sample 324 may be received at the input interface(s) 112 of FIG. 1 at approximately the same time as the sample 354. The sample 326 may be received at the input interface(s) 112 of FIG. 1 at approximately the same time as the sample 356. The sample 328 may be received at the input interface(s) 112 of FIG. 1 at approximately the same time as the sample 358. The sample 330 may be received at the input interface(s) 112 of FIG. 1 at approximately the same time as the sample 360. The sample 332 may be received at the input interface(s) 112 of FIG. 1 at approximately the same time as the sample 362. The sample 334 may be received at the input interface(s) 112 of FIG. 1 at approximately the same time as the sample 364. The sample 336 may be received at the input interface(s) 112 of FIG. 1 at approximately the same time as the sample 366.

A first value (e.g., a positive value) of the final shift value 116 may indicate an amount of temporal mismatch between the first audio signal 130 and the second audio signal 132 that is indicative of a temporal delay of the second audio signal 132 relative to the first audio signal 130. For example, a first value (e.g., +X ms or +Y samples, where X and Y include positive real numbers) of the final shift value 116 may indicate that the frame 304 (e.g., the samples 326-332) correspond to the samples 358-364. The samples 358-364 of the second audio signal 132 may be temporally delayed relative to the samples 326-332. The samples 326-332 and the samples 358-364 may correspond to the same sound emitted from the sound source 152. The samples 358-364 may correspond to a frame 344 of the second audio signal 132. Illustration of samples with cross-hatching in one or more of FIGS. 1-15 may indicate that the samples correspond to the same sound. For example, the samples 326-332 and the samples 358-364 are illustrated with cross-hatching in FIG. 3 to indicate that the samples 326-332 (e.g., the frame 304) and the samples 358-364 (e.g., the frame 344) correspond to the same sound emitted from the sound source 152.

It should be understood that a temporal offset of Y samples, as shown in FIG. 3, is illustrative. For example, the temporal offset may correspond to a number of samples, Y, that is greater than or equal to 0. In a first case where the temporal offsetY=0 samples, the samples 326-332 (e.g., corresponding to the frame 304) and the samples 356-362 (e.g., corresponding to the frame 344) may show high similarity without any frame offset. In a second case where the temporal offset Y=2 samples, the frame 304 and frame 344 may be offset by 2 samples. In this case, the first audio signal 130 may be received prior to the second audio signal 132 at the input interface(s) 112 by Y=2 samples or X=(2/Fs) ms, where Fs corresponds to the sample rate in kHz. In some cases, the temporal offset, Y, may include a non-integer value, e.g., Y=1.6 samples corresponding to X=0.05 ms at 32 kHz.

The temporal equalizer 108 of FIG. 1 may determine, based on the final shift value 116, that the first audio signal 130 corresponds to a reference signal and that the second audio signal 132 corresponds to a target signal. The reference signal (e.g., the first audio signal 130) may correspond to a leading signal and the target signal (e.g., the second audio signal 132) may correspond to a lagging signal. For example, the first audio signal 130 may be treated as the reference signal by shifting the second audio signal 132 relative to the first audio signal 130 based on the final shift value 116.

The temporal equalizer 108 may shift the second audio signal 132 to indicate that the samples 326-332 are to be encoded with the samples 358-264 (as compared to the samples 356-362). For example, the temporal equalizer 108 may shift the locations of the samples 358-364 to locations of the samples 356-362. The temporal equalizer 108 may update one or more pointers from indicating the locations of the samples 356-362 to indicate the locations of the samples 358-364. The temporal equalizer 108 may copy data corresponding to the samples 358-364 to a buffer, as compared to copying data corresponding to the samples 356-362. The temporal equalizer 108 may generate the encoded signals 102 by encoding the samples 326-332 and the samples 358-364, as described with reference to FIG. 1.

Figure 4:
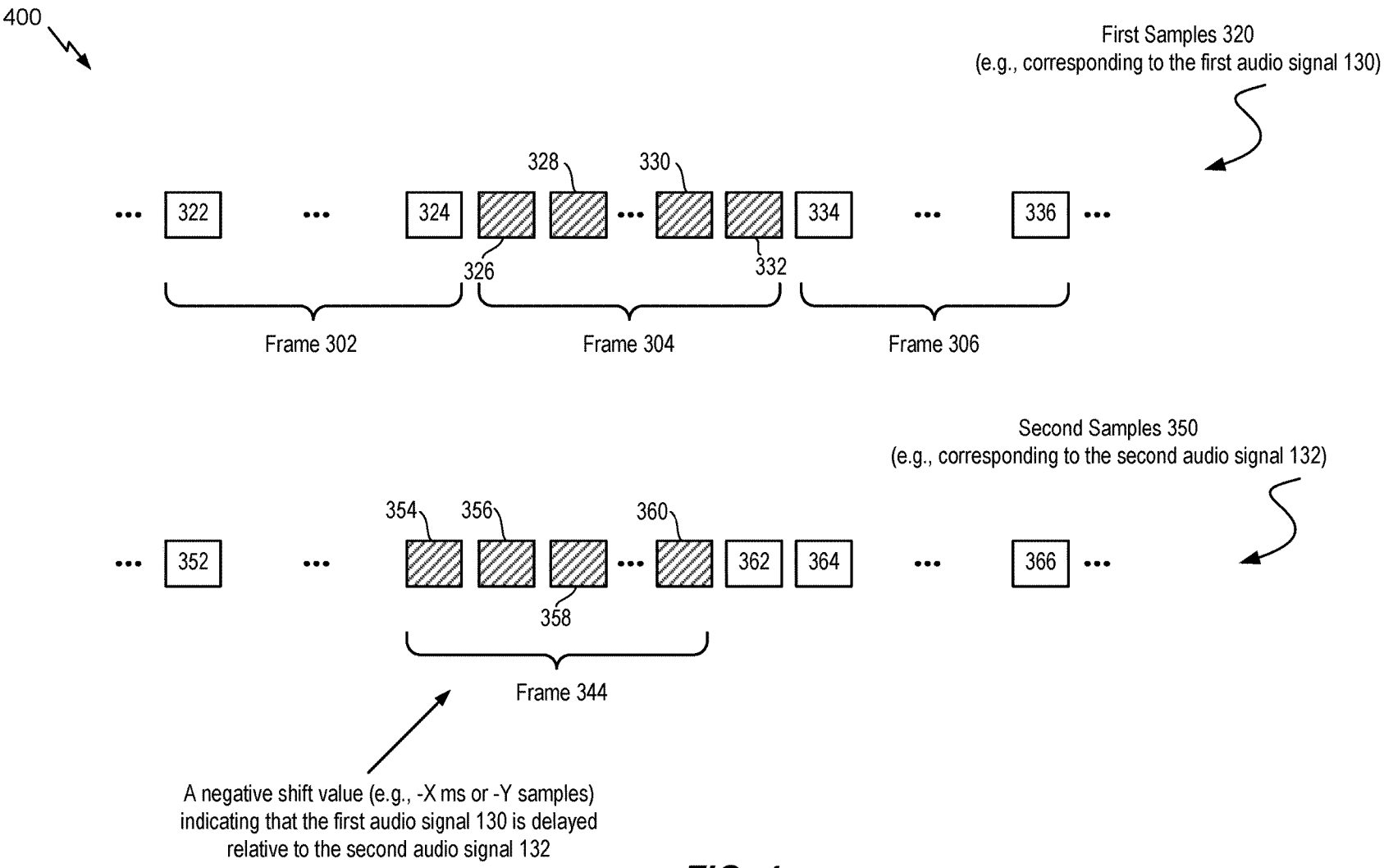
FIG. 4 is a diagram illustrating particular examples of samples that may be encoded by the device of FIG. 1.

Referring to FIG. 4, illustrative examples of samples are shown and generally designated as 400. The examples 400 differ from the examples 300 in that the first audio signal 130 is delayed relative to the second audio signal 132.

A second value (e.g., a negative value) of the final shift value 116 may indicate that an amount of temporal mismatch between the first audio signal 130 and the second audio signal 132 is indicative of a temporal delay of the first audio signal 130 relative to the second audio signal 132. For example, the second value (e.g., −X ms or −Y samples, where X and Y include positive real numbers) of the final shift value 116 may indicate that the frame 304 (e.g., the samples 326-332) correspond to the samples 354-360. The samples 354-360 may correspond to the frame 344 of the second audio signal 132. The samples 326-332 are temporally delayed relative to the samples 354-360. The samples 354-360 (e.g., the frame 344) and the samples 326-332 (e.g., the frame 304) may correspond to the same sound emitted from the sound source 152.

It should be understood that a temporal offset of −Y samples, as shown in FIG. 4, is illustrative. For example, the temporal offset may correspond to a number of samples, −Y, that is less than or equal to 0. In a first case where the temporal offset Y=0 samples, the samples 326-332 (e.g., corresponding to the frame 304) and the samples 356-362 (e.g., corresponding to the frame 344) may show high similarity without any frame offset. In a second case where the temporal offset Y=−6 samples, the frame 304 and frame 344 may be offset by 6 samples. In this case, the first audio signal 130 may be received subsequent to the second audio signal 132 at the input interface(s) 112 by Y=−6 samples or X=(−6/Fs) ms, where Fs corresponds to the sample rate in kHz. In some cases, the temporal offset, Y, may include a non-integer value, e.g., Y=−3.2 samples corresponding to X=−0.1 ms at 32 kHz.

The temporal equalizer 108 of FIG. 1 may determine that the second audio signal 132 corresponds to a reference signal and that the first audio signal 130 corresponds to a target signal. In particular, the temporal equalizer 108 may estimate the non-causal shift value 162 from the final shift value 116, as described with reference to FIG. 5. The temporal equalizer 108 may identify (e.g., designate) one of the first audio signal 130 or the second audio signal 132 as a reference signal and the other of the first audio signal 130 or the second audio signal 132 as a target signal based on a sign of the final shift value 116.

The reference signal (e.g., the second audio signal 132) may correspond to a leading signal and the target signal (e.g., the first audio signal 130) may correspond to a lagging signal. For example, the second audio signal 132 may be treated as the reference signal by shifting the first audio signal 130 relative to the second audio signal 132 based on the final shift value 116.

The temporal equalizer 108 may shift the first audio signal 130 to indicate that the samples 354-360 are to be encoded with the samples 326-332 (as compared to the samples 324-330). For example, the temporal equalizer 108 may shift the locations of the samples 326-332 to locations of the samples 324-330. The temporal equalizer 108 may update one or more pointers from indicating the locations of the samples 324-330 to indicate the locations of the samples 326-332. The temporal equalizer 108 may copy data corresponding to the samples 326-332 to a buffer, as compared to copying data corresponding to the samples 324-330. The temporal equalizer 108 may generate the encoded signals 102 by encoding the samples 354-360 and the samples 326-332, as described with reference to FIG. 1.

Figure 5:
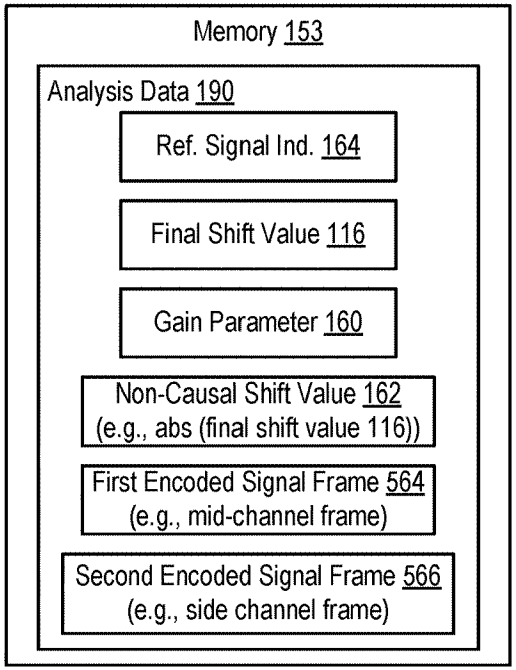
FIG. 5 is a diagram illustrating another example of a system operable to encode multiple audio signals.
Figure 5:
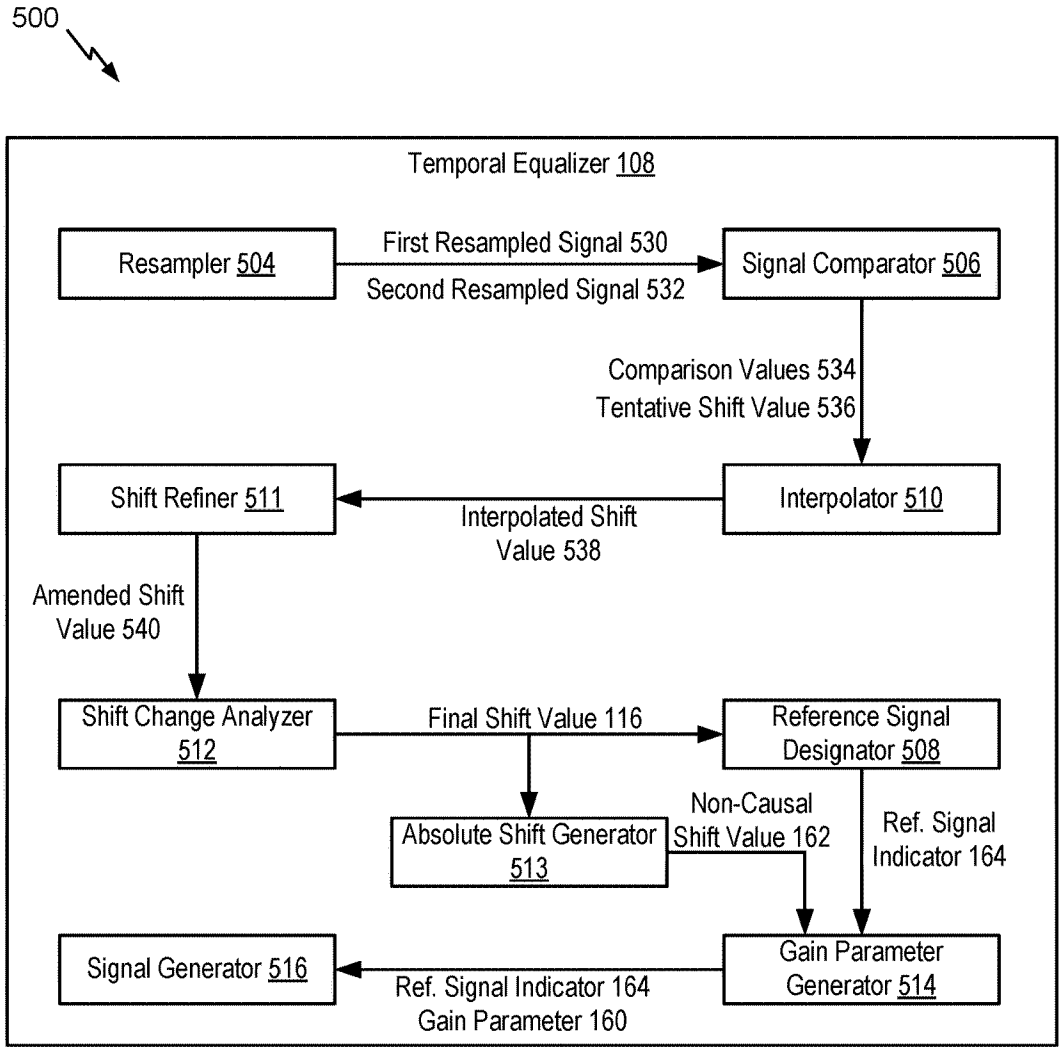

Referring to FIG. 5, an illustrative example of a system is shown and generally designated 500. The system 500 may correspond to the system 100 of FIG. 1. For example, the system 100, the first device 104 of FIG. 1, or both, may include one or more components of the system 500. The temporal equalizer 108 may include a resampler 504, a signal comparator 506, an interpolator 510, a shift refiner 511, a shift change analyzer 512, an absolute shift generator 513, a reference signal designator 508, a gain parameter generator 514, a signal generator 516, or a combination thereof.

During operation, the resampler 504 may generate one or more resampled signals, as further described with reference to FIG. 6. For example, the resampler 504 may generate a first resampled signal 530 (a downsampled signal or an upsampled signal) by resampling (e.g., downsampling or upsampling) the first audio signal 130 based on a resampling (e.g., downsampling or upsampling) factor (D) (e.g., ≥1). The resampler 504 may generate a second resampled signal 532 by resampling the second audio signal 132 based on the resampling factor (D). The resampler 504 may provide the first resampled signal 530, the second resampled signal 532, or both, to the signal comparator 506.

The signal comparator 506 may generate comparison values 534 (e.g., difference values, similarity values, coherence values, or cross-correlation values), a tentative shift value 536 (e.g., a tentative mismatch value), or both, as further described with reference to FIG. 7. For example, the signal comparator 506 may generate the comparison values 534 based on the first resampled signal 530 and a plurality of shift values applied to the second resampled signal 532, as further described with reference to FIG. 7. The signal comparator 506 may determine the tentative shift value 536 based on the comparison values 534, as further described with reference to FIG. 7. The first resampled signal 530 may include fewer samples or more samples than the first audio signal 130. The second resampled signal 532 may include fewer samples or more samples than the second audio signal 132. In an alternate aspect, the first resampled signal 530 may be the same as the first audio signal 130 and the second resampled signal 532 may be the same as the second audio signal 132. Determining the comparison values 534 based on the fewer samples of the resampled signals (e.g., the first resampled signal 530 and the second resampled signal 532) may use fewer resources (e.g., time, number of operations, or both) than on samples of the original signals (e.g., the first audio signal 130 and the second audio signal 132). Determining the comparison values 534 based on the more samples of the resampled signals (e.g., the first resampled signal 530 and the second resampled signal 532) may increase precision than on samples of the original signals (e.g., the first audio signal 130 and the second audio signal 132). The signal comparator 506 may provide the comparison values 534, the tentative shift value 536, or both, to the interpolator 510.

The interpolator 510 may extend the tentative shift value 536. For example, the interpolator 510 may generate an interpolated shift value 538 (e.g., interpolated mismatch value), as further described with reference to FIG. 8. For example, the interpolator 510 may generate interpolated comparison values corresponding to shift values that are proximate to the tentative shift value 536 by interpolating the comparison values 534. The interpolator 510 may determine the interpolated shift value 538 based on the interpolated comparison values and the comparison values 534. The comparison values 534 may be based on a coarser granularity of the shift values. For example, the comparison values 534 may be based on a first subset of a set of shift values so that a difference between a first shift value of the first subset and each second shift value of the first subset is greater than or equal to a threshold (e.g., ≥1). The threshold may be based on the resampling factor (D).

The interpolated comparison values may be based on a finer granularity of shift values that are proximate to the resampled tentative shift value 536. For example, the interpolated comparison values may be based on a second subset of the set of shift values so that a difference between a highest shift value of the second subset and the resampled tentative shift value 536 is less than the threshold (e.g., ≥1), and a difference between a lowest shift value of the second subset and the resampled tentative shift value 536 is less than the threshold. Determining the comparison values 534 based on the coarser granularity (e.g., the first subset) of the set of shift values may use fewer resources (e.g., time, operations, or both) than determining the comparison values 534 based on a finer granularity (e.g., all) of the set of shift values. Determining the interpolated comparison values corresponding to the second subset of shift values may extend the tentative shift value 536 based on a finer granularity of a smaller set of shift values that are proximate to the tentative shift value 536 without determining comparison values corresponding to each shift value of the set of shift values. Thus, determining the tentative shift value 536 based on the first subset of shift values and determining the interpolated shift value 538 based on the interpolated comparison values may balance resource usage and refinement of the estimated shift value. The interpolator 510 may provide the interpolated shift value 538 to the shift refiner 511.

The shift refiner 511 may generate an amended shift value 540 by refining the interpolated shift value 538, as further described with reference to FIGS. 9A-9C. For example, the shift refiner 511 may determine whether the interpolated shift value 538 indicates that a change in a shift between the first audio signal 130 and the second audio signal 132 is greater than a shift change threshold, as further described with reference to FIG. 9A. The change in the shift may be indicated by a difference between the interpolated shift value 538 and a first shift value associated with the frame 302 of FIG. 3. The shift refiner 511 may, in response to determining that the difference is less than or equal to the threshold, set the amended shift value 540 to the interpolated shift value 538. Alternatively, the shift refiner 511 may, in response to determining that the difference is greater than the threshold, determine a plurality of shift values that correspond to a difference that is less than or equal to the shift change threshold, as further described with reference to FIG. 9A. The shift refiner 511 may determine comparison values based on the first audio signal 130 and the plurality of shift values applied to the second audio signal 132. The shift refiner 511 may determine the amended shift value 540 based on the comparison values, as further described with reference to FIG. 9A. For example, the shift refiner 511 may select a shift value of the plurality of shift values based on the comparison values and the interpolated shift value 538, as further described with reference to FIG. 9A. The shift refiner 511 may set the amended shift value 540 to indicate the selected shift value. A non-zero difference between the first shift value corresponding to the frame 302 and the interpolated shift value 538 may indicate that some samples of the second audio signal 132 correspond to both frames (e.g., the frame 302 and the frame 304). For example, some samples of the second audio signal 132 may be duplicated during encoding. Alternatively, the non-zero difference may indicate that some samples of the second audio signal 132 correspond to neither the frame 302 nor the frame 304. For example, some samples of the second audio signal 132 may be lost during encoding. Setting the amended shift value 540 to one of the plurality of shift values may prevent a large change in shifts between consecutive (or adjacent) frames, thereby reducing an amount of sample loss or sample duplication during encoding. The shift refiner 511 may provide the amended shift value 540 to the shift change analyzer 512.

In some implementations, the shift refiner 511 may adjust the interpolated shift value 538, as described with reference to FIG. 9B. The shift refiner 511 may determine the amended shift value 540 based on the adjusted interpolated shift value 538. In some implementations, the shift refiner 511 may determine the amended shift value 540 as described with reference to FIG. 9C.

The shift change analyzer 512 may determine whether the amended shift value 540 indicates a switch or reverse in timing between the first audio signal 130 and the second audio signal 132, as described with reference to FIG. 1. In particular, a reverse or a switch in timing may indicate that, for the frame 302, the first audio signal 130 is received at the input interface(s) 112 prior to the second audio signal 132, and, for a subsequent frame (e.g., the frame 304 or the frame 306), the second audio signal 132 is received at the input interface(s) prior to the first audio signal 130. Alternatively, a reverse or a switch in timing may indicate that, for the frame 302, the second audio signal 132 is received at the input interface(s) 112 prior to the first audio signal 130, and, for a subsequent frame (e.g., the frame 304 or the frame 306), the first audio signal 130 is received at the input interface(s) prior to the second audio signal 132. In other words, a switch or reverse in timing may be indicate that a final shift value corresponding to the frame 302 has a first sign that is distinct from a second sign of the amended shift value 540 corresponding to the frame 304 (e.g., a positive to negative transition or vice-versa). The shift change analyzer 512 may determine whether delay between the first audio signal 130 and the second audio signal 132 has switched sign based on the amended shift value 540 and the first shift value associated with the frame 302, as further described with reference to FIG. 10A. The shift change analyzer 512 may, in response to determining that the delay between the first audio signal 130 and the second audio signal 132 has switched sign, set the final shift value 116 to a value (e.g., 0) indicating no time shift. Alternatively, the shift change analyzer 512 may set the final shift value 116 to the amended shift value 540 in response to determining that the delay between the first audio signal 130 and the second audio signal 132 has not switched sign, as further described with reference to FIG. 10A. The shift change analyzer 512 may generate an estimated shift value by refining the amended shift value 540, as further described with reference to FIGS. 10A,11. The shift change analyzer 512 may set the final shift value 116 to the estimated shift value. Setting the final shift value 116 to indicate no time shift may reduce distortion at a decoder by refraining from time shifting the first audio signal 130 and the second audio signal 132 in opposite directions for consecutive (or adjacent) frames of the first audio signal 130. The shift change analyzer 512 may provide the final shift value 116 to the reference signal designator 508, to the absolute shift generator 513, or both. In some implementations, the shift change analyzer 512 may determine the final shift value 116 as described with reference to FIG. 10B.

The absolute shift generator 513 may generate the non-causal shift value 162 by applying an absolute function to the final shift value 116. The absolute shift generator 513 may provide the non-causal shift value 162 to the gain parameter generator 514.

The reference signal designator 508 may generate the reference signal indicator 164, as further described with reference to FIGS. 12-13. For example, the reference signal indicator 164 may have a first value indicating that the first audio signal 130 is a reference signal or a second value indicating that the second audio signal 132 is the reference signal. The reference signal designator 508 may provide the reference signal indicator 164 to the gain parameter generator 514.

The gain parameter generator 514 may select samples of the target signal (e.g., the second audio signal 132) based on the non-causal shift value 162. For example, the gain parameter generator 514 may generate a time-shifted target signal (e.g., a time-shifted second audio signal) by shifting the target signal (e.g., the second audio signal 132) based on the non-causal shift value 162 and may select samples of the time-shifted target signal. To illustrate, the gain parameter generator 514 may select the samples 358-364 in response to determining that the non-causal shift value 162 has a first value (e.g., +X ms or +Y samples, where X and Y include positive real numbers). The gain parameter generator 514 may select the samples 354-360 in response to determining that the non-causal shift value 162 has a second value (e.g., −X ms or −Y samples). The gain parameter generator 514 may select the samples 356-362 in response to determining that the non-causal shift value 162 has a value (e.g., 0) indicating no time shift.

The gain parameter generator 514 may determine whether the first audio signal 130 is the reference signal or the second audio signal 132 is the reference signal based on the reference signal indicator 164. The gain parameter generator 514 may generate the gain parameter 160 based on the samples 326-332 of the frame 304 and the selected samples (e.g., the samples 354-360, the samples 356-362, or the samples 358-364) of the second audio signal 132, as described with reference to FIG. 1. For example, the gain parameter generator 514 may generate the gain parameter 160 based on one or more of Equation 1a-Equation 1f, where $g_D$ corresponds to the gain parameter 160, Ref(n) corresponds to samples of the reference signal, and T arg(n+$N_1$) corresponds to samples of the target signal. To illustrate, Ref(n) may correspond to the samples 326-332 of the frame 304 and T arg(n+$t_{N1}$) may correspond to the samples 358-364 of the frame 344 when the non-causal shift value 162 has a first value (e.g., +X ms or +Y samples, where X and Y include positive real numbers). In some implementations, Ref(n) may correspond to samples of the first audio signal 130 and T arg(n+$N_1$) may correspond to samples of the second audio signal 132, as described with reference to FIG. 1. In alternate implementations, Ref(n) may correspond to samples of the second audio signal 132 and T arg(n+$N_1$) may correspond to samples of the first audio signal 130, as described with reference to FIG. 1.

The gain parameter generator 514 may provide the gain parameter 160, the reference signal indicator 164, the non-causal shift value 162, or a combination thereof, to the signal generator 516. The signal generator 516 may generate the encoded signals 102, as described with reference to FIG. 1. For examples, the encoded signals 102 may include a first encoded signal frame 564 (e.g., a mid channel frame), a second encoded signal frame 566 (e.g., a side channel frame), or both. The signal generator 516 may generate the first encoded signal frame 564 based on Equation 2a or Equation 2b, where M corresponds to the first encoded signal frame 564, $g_D$ corresponds to the gain parameter 160, Ref(n) corresponds to samples of the reference signal, and T arg(n+$N_1$) corresponds to samples of the target signal. The signal generator 516 may generate the second encoded signal frame 566 based on Equation 3a or Equation 3b, where S corresponds to the second encoded signal frame 566, $g_D$ corresponds to the gain parameter 160, Ref(n) corresponds to samples of the reference signal, and T arg(n+$N_1$) corresponds to samples of the target signal.

The temporal equalizer 108 may store the first resampled signal 530, the second resampled signal 532, the comparison values 534, the tentative shift value 536, the interpolated shift value 538, the amended shift value 540, the non-causal shift value 162, the reference signal indicator 164, the final shift value 116, the gain parameter 160, the first encoded signal frame 564, the second encoded signal frame 566, or a combination thereof, in the memory 153. For example, the analysis data 190 may include the first resampled signal 530, the second resampled signal 532, the comparison values 534, the tentative shift value 536, the interpolated shift value 538, the amended shift value 540, the non-causal shift value 162, the reference signal indicator 164, the final shift value 116, the gain parameter 160, the first encoded signal frame 564, the second encoded signal frame 566, or a combination thereof.

Figure 6:
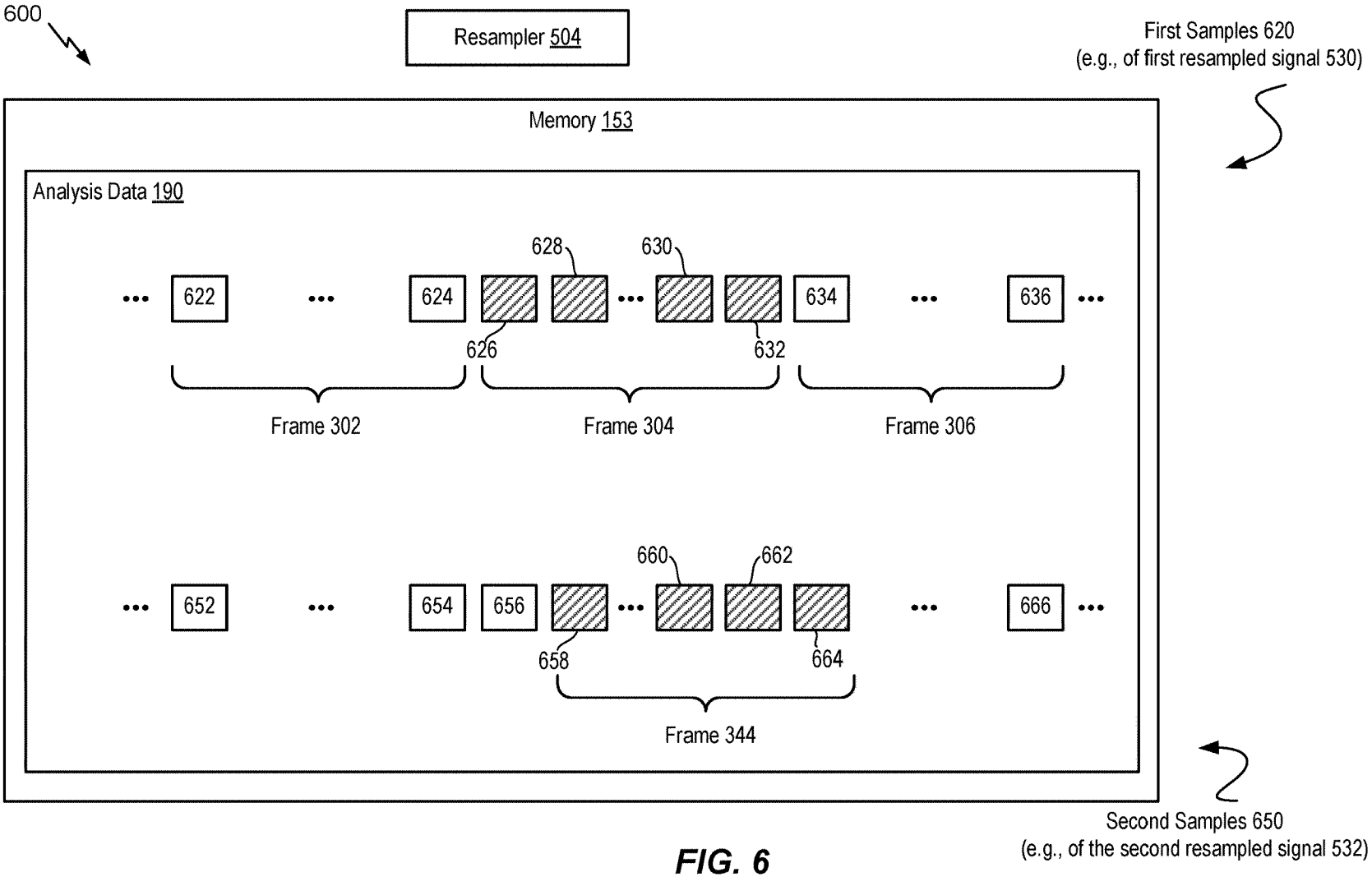
FIG. 6 is a diagram illustrating another example of a system operable to encode multiple audio signals.

Referring to FIG. 6, an illustrative example of a system is shown and generally designated 600. The system 600 may correspond to the system 100 of FIG. 1. For example, the system 100, the first device 104 of FIG. 1, or both, may include one or more components of the system 600.

The resampler 504 may generate first samples 620 of the first resampled signal 530 by resampling (e.g., downsampling or upsampling) the first audio signal 130 of FIG. 1. The resampler 504 may generate second samples 650 of the second resampled signal 532 by resampling (e.g., downsampling or upsampling) the second audio signal 132 of FIG. 1.

The first audio signal 130 may be sampled at a first sample rate (Fs) to generate the samples 320 of FIG. 3. The first sample rate (Fs) may correspond to a first rate (e.g., 16 kilohertz (kHz)) associated with wideband (WB) bandwidth, a second rate (e.g., 32 kHz) associated with super wideband (SWB) bandwidth, a third rate (e.g., 48 kHz) associated with full band (FB) bandwidth, or another rate. The second audio signal 132 may be sampled at the first sample rate (Fs) to generate the second samples 350 of FIG. 3.

In some implementations, the resampler 504 may preprocess the first audio signal 130 (or the second audio signal 132) prior to resampling the first audio signal 130 (or the second audio signal 132). The resampler 504 may preprocess the first audio signal 130 (or the second audio signal 132) by filtering the first audio signal 130 (or the second audio signal 132) based on an infinite impulse response (IIR) filter (e.g., a first order IIR filter). The IIR filter may be based on the following Equation:

$$H_{pre}(z)=1/(1-\alpha z^{-1}), \qquad \text{Equation 4}$$

where α is positive, such as 0.68 or 0.72. Performing the de-emphasis prior to resampling may reduce effects, such as aliasing, signal conditioning, or both. The first audio signal 130 (e.g., the pre-processed first audio signal 130) and the second audio signal 132 (e.g., the pre-processed second audio signal 132) may be resampled based on a resampling factor (D). The resampling factor (D) may be based on the first sample rate (Fs) (e.g., D=Fs/8, D=2Fs, etc.).

In alternate implementations, the first audio signal 130 and the second audio signal 132 may be low-pass filtered or decimated using an anti-aliasing filter prior to resampling.

The decimation filter may be based on the resampling factor (D). In a particular example, the resampler 504 may select a decimation filter with a first cut-off frequency (e.g., π/D or π/4) in response to determining that the first sample rate (Fs) corresponds to a particular rate (e.g., 32 kHz). Reducing aliasing by de-emphasizing multiple signals (e.g., the first audio signal 130 and the second audio signal 132) may be computationally less expensive than applying a decimation filter to the multiple signals.

The first samples 620 may include a sample 622, a sample 624, a sample 626, a sample 628, a sample 630, a sample 632, a sample 634, a sample 636, one or more additional samples, or a combination thereof. The first samples 620 may include a subset (e.g., ⅛ th) of the first samples 320 of FIG. 3. The sample 622, the sample 624, one or more additional samples, or a combination thereof, may correspond to the frame 302. The sample 626, the sample 628, the sample 630, the sample 632, one or more additional samples, or a combination thereof, may correspond to the frame 304. The sample 634, the sample 636, one or more additional samples, or a combination thereof, may correspond to the frame 306.

The second samples 650 may include a sample 652, a sample 654, a sample 656, a sample 658, a sample 660, a sample 662, a sample 664, a sample 666, one or more additional samples, or a combination thereof. The second samples 650 may include a subset (e.g., ⅛ th) of the second samples 350 of FIG. 3. The samples 654-660 may correspond to the samples 354-360. For example, the samples 654-660 may include a subset (e.g., ⅛ th) of the samples 354-360. The samples 656-662 may correspond to the samples 356-362. For example, the samples 656-662 may include a subset (e.g., ⅛ th) of the samples 356-362. The samples 658-664 may correspond to the samples 358-364. For example, the samples 658-664 may include a subset (e.g., ⅛ th) of the samples 358-364. In some implementations, the resampling factor may correspond to a first value (e.g., 1) where samples 622-636 and samples 652-666 of FIG. 6 may be similar to samples 322-336 and samples 352-366 of FIG. 3, respectively.

The resampler 504 may store the first samples 620, the second samples 650, or both, in the memory 153. For example, the analysis data 190 may include the first samples 620, the second samples 650, or both.

Figure 7:
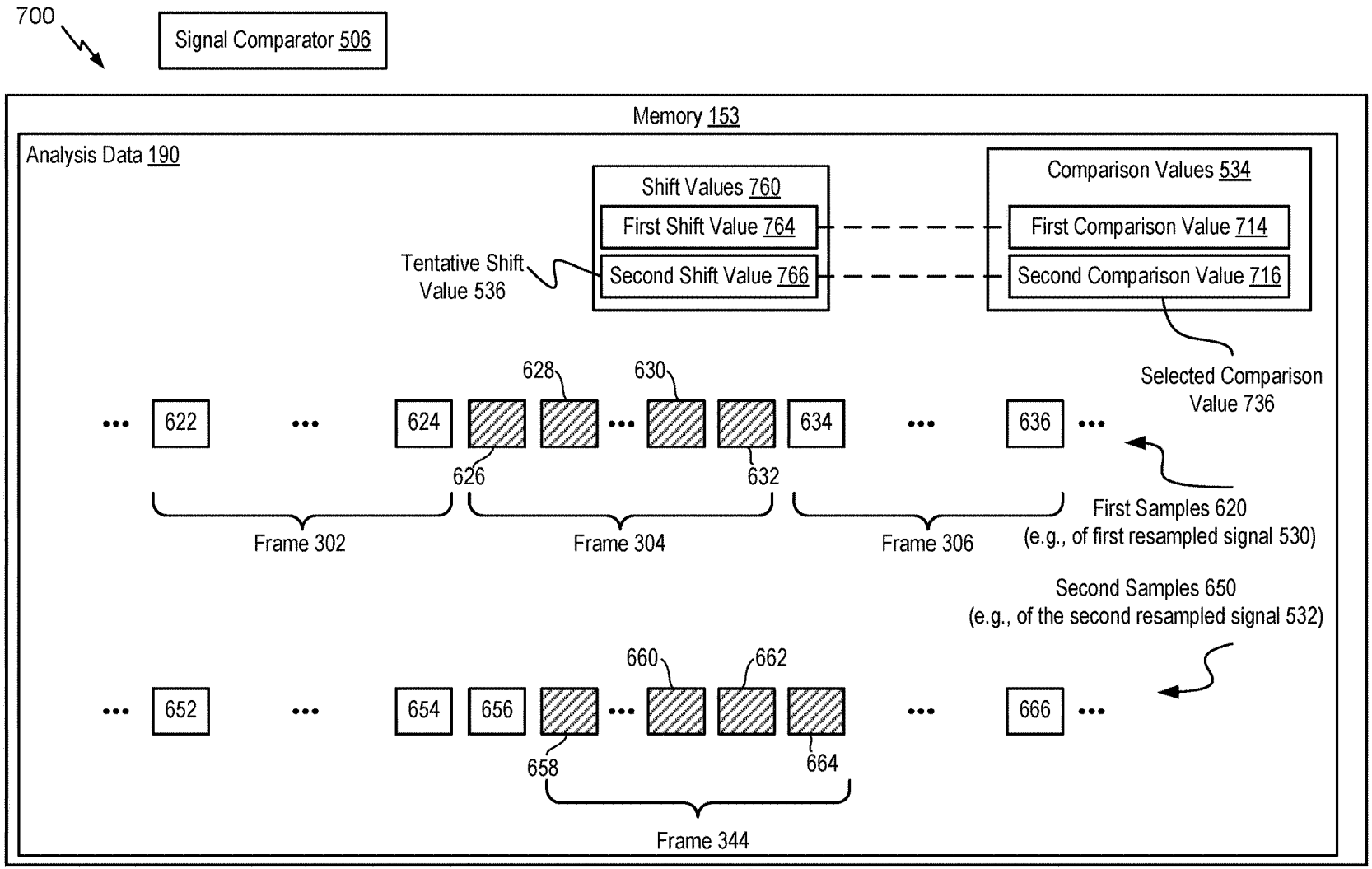
FIG. 7 is a diagram illustrating another example of a system operable to encode multiple audio signals.

Referring to FIG. 7, an illustrative example of a system is shown and generally designated 700. The system 700 may correspond to the system 100 of FIG. 1. For example, the system 100, the first device 104 of FIG. 1, or both, may include one or more components of the system 700.

The memory 153 may store a plurality of shift values 760. The shift values 760 may include a first shift value 764 (e.g., −X ms or −Y samples, where X and Y include positive real numbers), a second shift value 766 (e.g., +X ms or +Y samples, where X and Y include positive real numbers), or both. The shift values 760 may range from a lower shift value (e.g., a minimum shift value, T_MIN) to a higher shift value (e.g., a maximum shift value, T_MAX). The shift values 760 may indicate an expected temporal shift (e.g., a maximum expected temporal shift) between the first audio signal 130 and the second audio signal 132.

During operation, the signal comparator 506 may determine the comparison values 534 based on the first samples 620 and the shift values 760 applied to the second samples 650. For example, the samples 626-632 may correspond to a first time (t). To illustrate, the input interface(s) 112 of FIG. 1 may receive the samples 626-632 corresponding to the frame 304 at approximately the first time (t). The first shift value 764 (e.g., −X ms or −Y samples, where X and Y include positive real numbers) may correspond to a second time (t−1).

The samples 654-660 may correspond to the second time (t−1). For example, the input interface(s) 112 may receive the samples 654-660 at approximately the second time (t−1). The signal comparator 506 may determine a first comparison value 714 (e.g., a difference value or a cross-correlation value) corresponding to the first shift value 764 based on the samples 626-632 and the samples 654-660. For example, the first comparison value 714 may correspond to an absolute value of cross-correlation of the samples 626-632 and the samples 654-660. As another example, the first comparison value 714 may indicate a difference between the samples 626-632 and the samples 654-660.

The second shift value 766 (e.g., +X ms or +Y samples, where X and Y include positive real numbers) may correspond to a third time (t+1). The samples 658-664 may correspond to the third time (t+1). For example, the input interface(s) 112 may receive the samples 658-664 at approximately the third time (t+1). The signal comparator 506 may determine a second comparison value 716 (e.g., a difference value or a cross-correlation value) corresponding to the second shift value 766 based on the samples 626-632 and the samples 658-664. For example, the second comparison value 716 may correspond to an absolute value of cross-correlation of the samples 626-632 and the samples 658-664. As another example, the second comparison value 716 may indicate a difference between the samples 626-632 and the samples 658-664. The signal comparator 506 may store the comparison values 534 in the memory 153. For example, the analysis data 190 may include the comparison values 534.

The signal comparator 506 may identify a selected comparison value 736 of the comparison values 534 that has a higher (or lower) value than other values of the comparison values 534. For example, the signal comparator 506 may select the second comparison value 716 as the selected comparison value 736 in response to determining that the second comparison value 716 is greater than or equal to the first comparison value 714. In some implementations, the comparison values 534 may correspond to cross-correlation values. The signal comparator 506 may, in response to determining that the second comparison value 716 is greater than the first comparison value 714, determine that the samples 626-632 have a higher correlation with the samples 658-664 than with the samples 654-660. The signal comparator 506 may select the second comparison value 716 that indicates the higher correlation as the selected comparison value 736. In other implementations, the comparison values 534 may correspond to difference values. The signal comparator 506 may, in response to determining that the second comparison value 716 is lower than the first comparison value 714, determine that the samples 626-632 have a greater similarity with (e.g., a lower difference to) the samples 658-664 than the samples 654-660. The signal comparator 506 may select the second comparison value 716 that indicates a lower difference as the selected comparison value 736.

The selected comparison value 736 may indicate a higher correlation (or a lower difference) than the other values of the comparison values 534. The signal comparator 506 may identify the tentative shift value 536 of the shift values 760 that corresponds to the selected comparison value 736. For example, the signal comparator 506 may identify the second shift value 766 as the tentative shift value 536 in response to determining that the second shift value 766 corresponds to the selected comparison value 736 (e.g., the second comparison value 716).

The signal comparator 506 may determine the selected comparison value 736 based on the following Equation:

$$maxXCorr = \max\left(\left|\sum_{k=-K}^{K} w(n)l'(n) * w(n+k)r'(n+k)\right|\right), \quad \text{Equation 5}$$

where maxXCorr corresponds to the selected comparison value 736 and k corresponds to a shift value. w(n)*l' corresponds to de-emphasized, resampled, and windowed first audio signal 130, and w(n)*r' corresponds to de-emphasized, resampled, and windowed second audio signal 132. For example, w(n)*l' may correspond to the samples 626-632, w(n−1)*r' may correspond to the samples 654-660, w(n)*r' may correspond to the samples 656-662, and w(n+1)*r' may correspond to the samples 658-664. −K may correspond to a lower shift value (e.g., a minimum shift value) of the shift values 760, and K may correspond to a higher shift value (e.g., a maximum shift value) of the shift values 760. In Equation 5, w(n)*l' corresponds to the first audio signal 130 independently of whether the first audio signal 130 corresponds to a right (r) channel signal or a left (l) channel signal. In Equation 5, w(n)*r' corresponds to the second audio signal 132 independently of whether the second audio signal 132 corresponds to the right (r) channel signal or the left (l) channel signal.

The signal comparator 506 may determine the tentative shift value 536 based on the following Equation:

$$T = \underset{k}{argmax}\left(\left|\sum_{k=-K}^{K} w(n)l'(n) * w(n+k)r'(n+k)\right|\right), \quad \text{Equation 6}$$

where T corresponds to the tentative shift value 536.

The signal comparator 506 may map the tentative shift value 536 from the resampled samples to the original samples based on the resampling factor (D) of FIG. 6. For example, the signal comparator 506 may update the tentative shift value 536 based on the resampling factor (D). To illustrate, the signal comparator 506 may set the tentative shift value 536 to a product (e.g., 12) of the tentative shift value 536 (e.g., 3) and the resampling factor (D) (e.g., 4).

Figure 8:
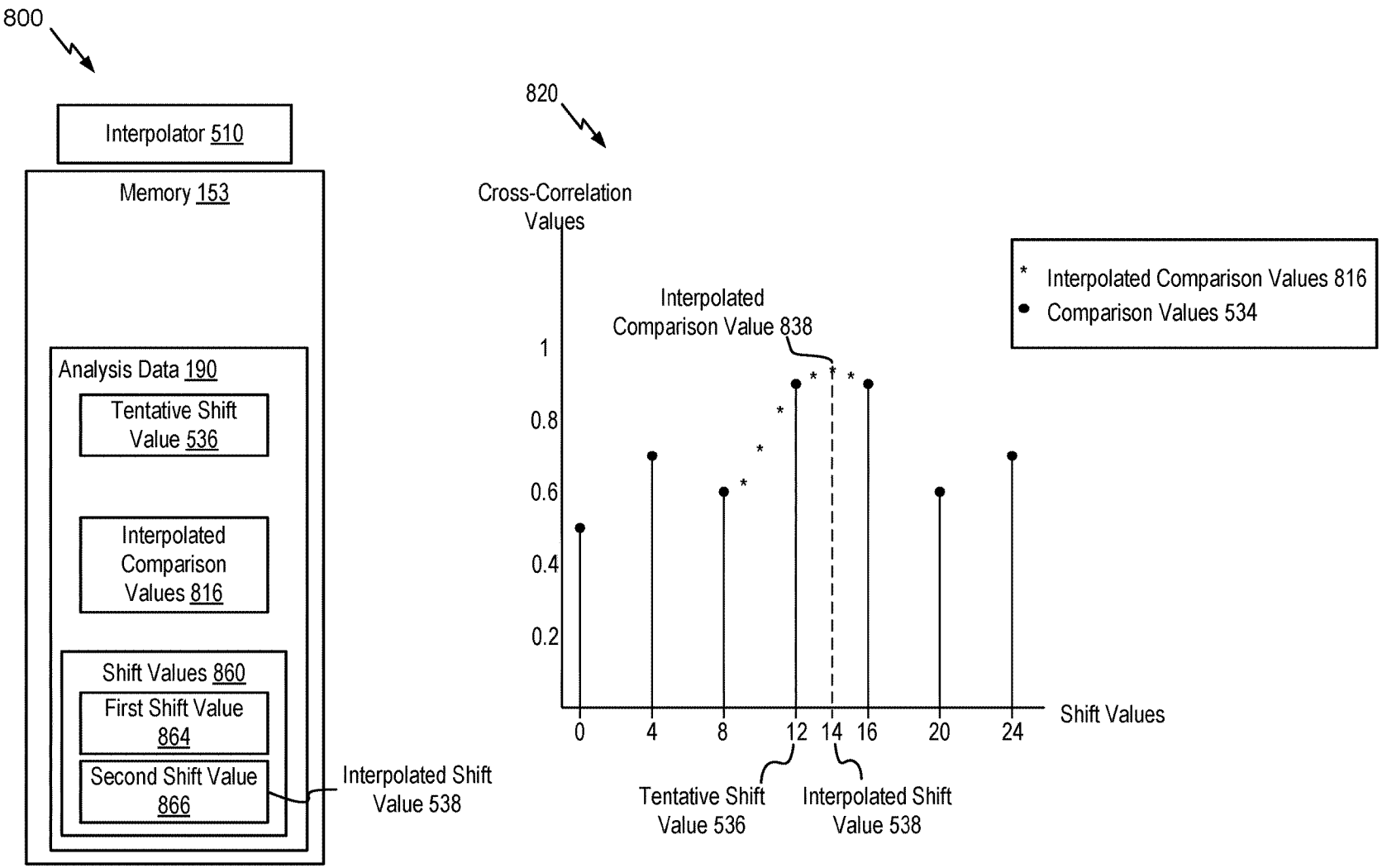
FIG. 8 is a diagram illustrating another example of a system operable to encode multiple audio signals.

Referring to FIG. 8, an illustrative example of a system is shown and generally designated 800. The system 800 may correspond to the system 100 of FIG. 1. For example, the system 100, the first device 104 of FIG. 1, or both, may include one or more components of the system 800. The memory 153 may be configured to store shift values 860. The shift values 860 may include a first shift value 864, a second shift value 866, or both.

During operation, the interpolator 510 may generate the shift values 860 proximate to the tentative shift value 536 (e.g., 12), as described herein. Mapped shift values may correspond to the shift values 760 mapped from the resampled samples to the original samples based on the resampling factor (D). For example, a first mapped shift value of the mapped shift values may correspond to a product of the first shift value 764 and the resampling factor (D). A difference between a first mapped shift value of the mapped shift values and each second mapped shift value of the mapped shift values may be greater than or equal to a threshold value (e.g., the resampling factor (D), such as 4). The shift values 860 may have finer granularity than the shift values 760. For example, a difference between a lower value (e.g., a minimum value) of the shift values 860 and the tentative shift value 536 may be less than the threshold value (e.g., 4). The threshold value may correspond to the resampling factor (D) of FIG. 6. The shift values 860 may range from a first value (e.g., the tentative shift value 536−(the threshold value−1)) to a second value (e.g., the tentative shift value 536+(threshold value−1)).

The interpolator 510 may generate interpolated comparison values 816 corresponding to the shift values 860 by performing interpolation on the comparison values 534, as described herein. Comparison values corresponding to one or more of the shift values 860 may be excluded from the comparison values 534 because of the lower granularity of the comparison values 534. Using the interpolated comparison values 816 may enable searching of interpolated comparison values corresponding to the one or more of the shift values 860 to determine whether an interpolated comparison value corresponding to a particular shift value proximate to the tentative shift value 536 indicates a higher correlation (or lower difference) than the second comparison value 716 of FIG. 7.

FIG. 8 includes a graph 820 illustrating examples of the interpolated comparison values 816 and the comparison values 534 (e.g., cross-correlation values). The interpolator 510 may perform the interpolation based on a hanning windowed sinc interpolation, IIR filter based interpolation, spline interpolation, another form of signal interpolation, or a combination thereof. For example, the interpolator 510 may perform the hanning windowed sinc interpolation based on the following Equation:

$$R(k)_{32kHz} = \sum_{i=-4}^{4} R(\hat{t}_{N2} - i)_{8kHz} * b(3i + t), \quad \text{Equation 7}$$

where $t=k-\hat{t}_{N2}$, b corresponds to a windowed sinc function, $\hat{t}_{N2}$ corresponds to the tentative shift value 536. $R(\hat{t}_{N2}-i)_{8\ kHz}$ may correspond to a particular comparison value of the comparison values 534. For example, $R(\hat{t}_{N2}-i)_{8\ kHz}$ may indicate a first comparison value of the comparison values 534 that corresponds to a first shift value (e.g., 8) when i corresponds to 4. $R(\hat{t}_{N2}-i)_{8\ kHz}$ may indicate the second comparison value 716 that corresponds to the tentative shift value 536 (e.g., 12) when i corresponds to 0. $R(\hat{t}_{N2}-i)_{8\ kHz}$ may indicate a third comparison value of the comparison values 534 that corresponds to a third shift value (e.g., 16) when i corresponds to −4.

$R(k)_{32\ kHz}$ may correspond to a particular interpolated value of the interpolated comparison values 816. Each interpolated value of the interpolated comparison values 816 may correspond to a sum of a product of the windowed sinc function (b) and each of the first comparison value, the second comparison value 716, and the third comparison value. For example, the interpolator 510 may determine a first product of the windowed sinc function (b) and the first comparison value, a second product of the windowed sinc function (b) and the second comparison value 716, and a third product of the windowed sinc function (b) and the third comparison value. The interpolator 510 may determine a particular interpolated value based on a sum of the first product, the second product, and the third product. A first interpolated value of the interpolated comparison values 816 may correspond to a first shift value (e.g., 9). The windowed sinc function (b) may have a first value corresponding to the first shift value. A second interpolated value of the interpolated comparison values 816 may correspond to a second shift value (e.g., 10). The windowed sinc function (b) may have a second value corresponding to the second shift value. The first value of the windowed sinc function (b) may be distinct from the second value. The first interpolated value may thus be distinct from the second interpolated value.

In Equation 7, 8 kHz may correspond to a first rate of the comparison values 534. For example, the first rate may indicate a number (e.g., 8) of comparison values corresponding to a frame (e.g., the frame 304 of FIG. 3) that are included in the comparison values 534. 32 kHz may correspond to a second rate of the interpolated comparison values 816. For example, the second rate may indicate a number (e.g., 32) of interpolated comparison values corresponding to a frame (e.g., the frame 304 of FIG. 3) that are included in the interpolated comparison values 816.

The interpolator 510 may select an interpolated comparison value 838 (e.g., a maximum value or a minimum value) of the interpolated comparison values 816. The interpolator 510 may select a shift value (e.g., 14) of the shift values 860 that corresponds to the interpolated comparison value 838. The interpolator 510 may generate the interpolated shift value 538 indicating the selected shift value (e.g., the second shift value 866).

Using a coarse approach to determine the tentative shift value 536 and searching around the tentative shift value 536 to determine the interpolated shift value 538 may reduce search complexity without compromising search efficiency or accuracy.

Figure 9A:
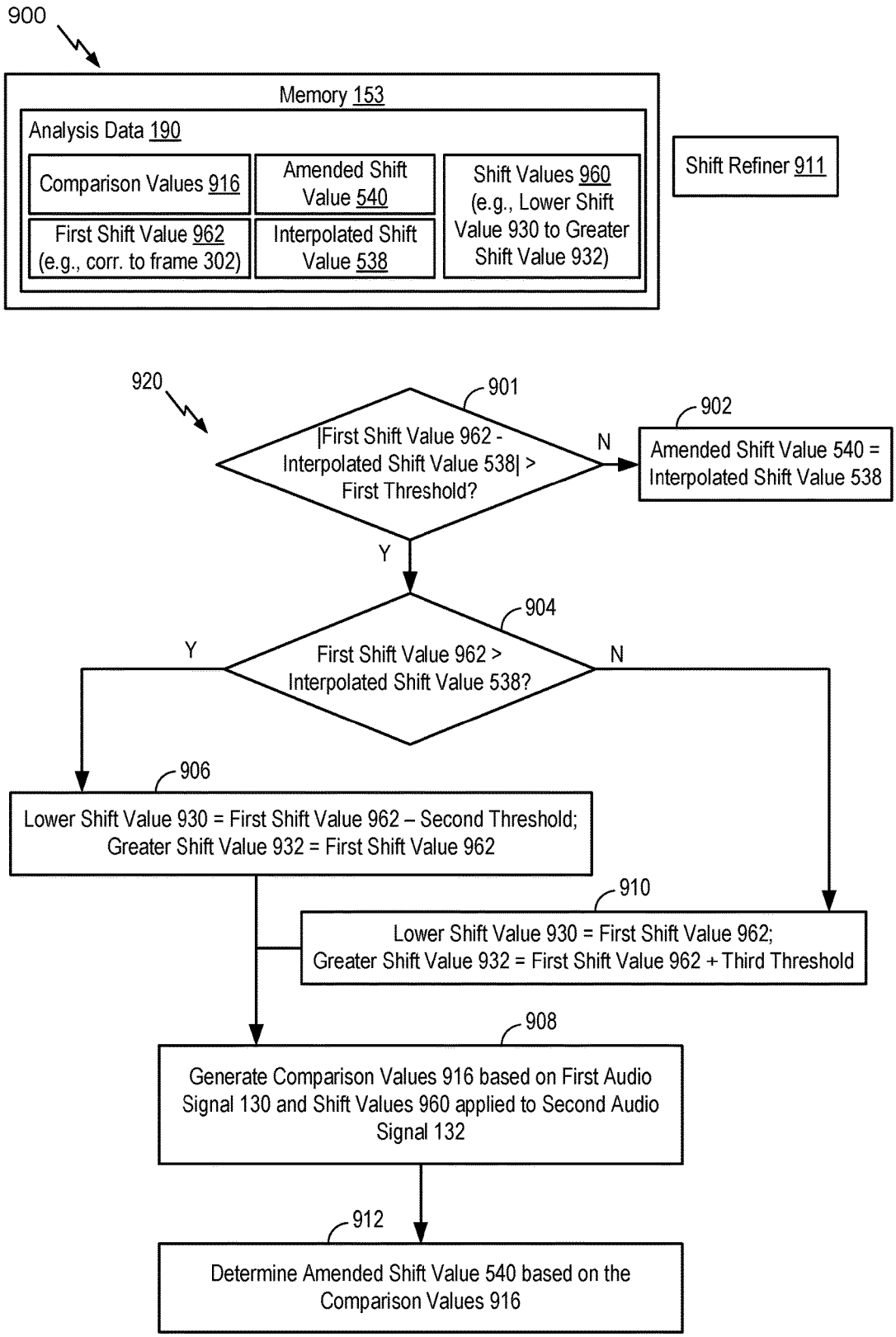
FIG. 9A is a diagram illustrating another example of a system operable to encode multiple audio signals.

Referring to FIG. 9A, an illustrative example of a system is shown and generally designated 900. The system 900 may correspond to the system 100 of FIG. 1. For example, the system 100, the first device 104 of FIG. 1, or both, may include one or more components of the system 900. The system 900 may include the memory 153, a shift refiner 911, or both. The memory 153 may be configured to store a first shift value 962 corresponding to the frame 302. For example, the analysis data 190 may include the first shift value 962. The first shift value 962 may correspond to a tentative shift value, an interpolated shift value, an amended shift value, a final shift value, or a non-causal shift value associated with the frame 302. The frame 302 may precede the frame 304 in the first audio signal 130. The shift refiner 911 may correspond to the shift refiner 511 of FIG. 1.

FIG. 9A also includes a flow chart of an illustrative method of operation generally designated 920. The method 920 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911, or a combination thereof.

The method 920 includes determining whether an absolute value of a difference between the first shift value 962 and the interpolated shift value 538 is greater than a first threshold, at 901. For example, the shift refiner 911 may determine whether an absolute value of a difference between the first shift value 962 and the interpolated shift value 538 is greater than a first threshold (e.g., a shift change threshold).

The method 920 also includes, in response to determining that the absolute value is less than or equal to the first threshold, at 901, setting the amended shift value 540 to indicate the interpolated shift value 538, at 902. For example, the shift refiner 911 may, in response to determining that the absolute value is less than or equal to the shift change threshold, set the amended shift value 540 to indicate the interpolated shift value 538. In some implementations, the shift change threshold may have a first value (e.g., 0) indicating that the amended shift value 540 is to be set to the interpolated shift value 538 when the first shift value 962 is equal to the interpolated shift value 538. In alternate implementations, the shift change threshold may have a second value (e.g., ≥1) indicating that the amended shift value 540 is to be set to the interpolated shift value 538, at 902, with a greater degree of freedom. For example, the amended shift value 540 may be set to the interpolated shift value 538 for a range of differences between the first shift value 962 and the interpolated shift value 538. To illustrate, the amended shift value 540 may be set to the interpolated shift value 538 when an absolute value of a difference (e.g., −2, −1, 0, 1, 2) between the first shift value 962 and the interpolated shift value 538 is less than or equal to the shift change threshold (e.g., 2).

The method 920 further includes, in response to determining that the absolute value is greater than the first threshold, at 901, determining whether the first shift value 962 is greater than the interpolated shift value 538, at 904. For example, the shift refiner 911 may, in response to determining that the absolute value is greater than the shift change threshold, determine whether the first shift value 962 is greater than the interpolated shift value 538.

The method 920 also includes, in response to determining that the first shift value 962 is greater than the interpolated shift value 538, at 904, setting a lower shift value 930 to a difference between the first shift value 962 and a second threshold, and setting a greater shift value 932 to the first shift value 962, at 906. For example, the shift refiner 911 may, in response to determining that the first shift value 962 (e.g., 20) is greater than the interpolated shift value 538 (e.g., 14), set the lower shift value 930 (e.g., 17) to a difference between the first shift value 962 (e.g., 20) and a second threshold (e.g., 3). Additionally, or in the alternative, the shift refiner 911 may, in response to determining that the first shift value 962 is greater than the interpolated shift value 538, set the greater shift value 932 (e.g., 20) to the first shift value 962. The second threshold may be based on the difference between the first shift value 962 and the interpolated shift value 538. In some implementations, the lower shift value 930 may be set to a difference between the interpolated shift value 538 and a threshold (e.g., the second threshold) and the greater shift value 932 may be set to a difference between the first shift value 962 and a threshold (e.g., the second threshold).

The method 920 further includes, in response to determining that the first shift value 962 is less than or equal to the interpolated shift value 538, at 904, setting the lower shift value 930 to the first shift value 962, and setting a greater shift value 932 to a sum of the first shift value 962 and a third threshold, at 910. For example, the shift refiner 911 may, in response to determining that the first shift value 962 (e.g., 10) is less than or equal to the interpolated shift value 538 (e.g., 14), set the lower shift value 930 to the first shift value 962 (e.g., 10). Additionally, or in the alternative, the shift refiner 911 may, in response to determining that the first shift value 962 is less than or equal to the interpolated shift value 538, set the greater shift value 932 (e.g., 13) to a sum of the first shift value 962 (e.g., 10) and a third threshold (e.g., 3). The third threshold may be based on the difference between the first shift value 962 and the interpolated shift value 538. In some implementations, the lower shift value 930 may be set to a difference between the first shift value 962 and a threshold (e.g., the third threshold) and the greater shift value 932 may be set to a difference between the interpolated shift value 538 and a threshold (e.g., the third threshold).

The method 920 also includes determining comparison values 916 based on the first audio signal 130 and shift values 960 applied to the second audio signal 132, at 908. For example, the shift refiner 911 (or the signal comparator 506) may generate the comparison values 916, as described with reference to FIG. 7, based on the first audio signal 130 and the shift values 960 applied to the second audio signal 132. To illustrate, the shift values 960 may range from the lower shift value 930 (e.g., 17) to the greater shift value 932 (e.g., 20). The shift refiner 911 (or the signal comparator 506) may generate a particular comparison value of the comparison values 916 based on the samples 326-332 and a particular subset of the second samples 350. The particular subset of the second samples 350 may correspond to a particular shift value (e.g., 17) of the shift values 960. The particular comparison value may indicate a difference (or a correlation) between the samples 326-332 and the particular subset of the second samples 350.

The method 920 further includes determining the amended shift value 540 based on the comparison values 916 generated based on the first audio signal 130 and the second audio signal 132, at 912. For example, the shift refiner 911 may determine the amended shift value 540 based on the comparison values 916. To illustrate, in a first case, when the comparison values 916 correspond to cross-correlation values, the shift refiner 911 may determine that the interpolated comparison value 838 of FIG. 8 corresponding to the interpolated shift value 538 is greater than or equal to a highest comparison value of the comparison values 916. Alternatively, when the comparison values 916 correspond to difference values, the shift refiner 911 may determine that the interpolated comparison value 838 is less than or equal to a lowest comparison value of the comparison values 916. In this case, the shift refiner 911 may, in response to determining that the first shift value 962 (e.g., 20) is greater than the interpolated shift value 538 (e.g., 14), set the amended shift value 540 to the lower shift value 930 (e.g., 17). Alternatively, the shift refiner 911 may, in response to determining that the first shift value 962 (e.g., 10) is less than or equal to the interpolated shift value 538 (e.g., 14), set the amended shift value 540 to the greater shift value 932 (e.g., 13).

In a second case, when the comparison values 916 correspond to cross-correlation values, the shift refiner 911 may determine that the interpolated comparison value 838 is less than the highest comparison value of the comparison values 916 and may set the amended shift value 540 to a particular shift value (e.g., 18) of the shift values 960 that corresponds to the highest comparison value. Alternatively, when the comparison values 916 correspond to difference values, the shift refiner 911 may determine that the interpolated comparison value 838 is greater than the lowest comparison value of the comparison values 916 and may set the amended shift value 540 to a particular shift value (e.g., 18) of the shift values 960 that corresponds to the lowest comparison value.

The comparison values 916 may be generated based on the first audio signal 130, the second audio signal 132, and the shift values 960. The amended shift value 540 may be generated based on comparison values 916 using a similar procedure as performed by the signal comparator 506, as described with reference to FIG. 7.

The method 920 may thus enable the shift refiner 911 to limit a change in a shift value associated with consecutive (or adjacent) frames. The reduced change in the shift value may reduce sample loss or sample duplication during encoding.

Figure 9B:
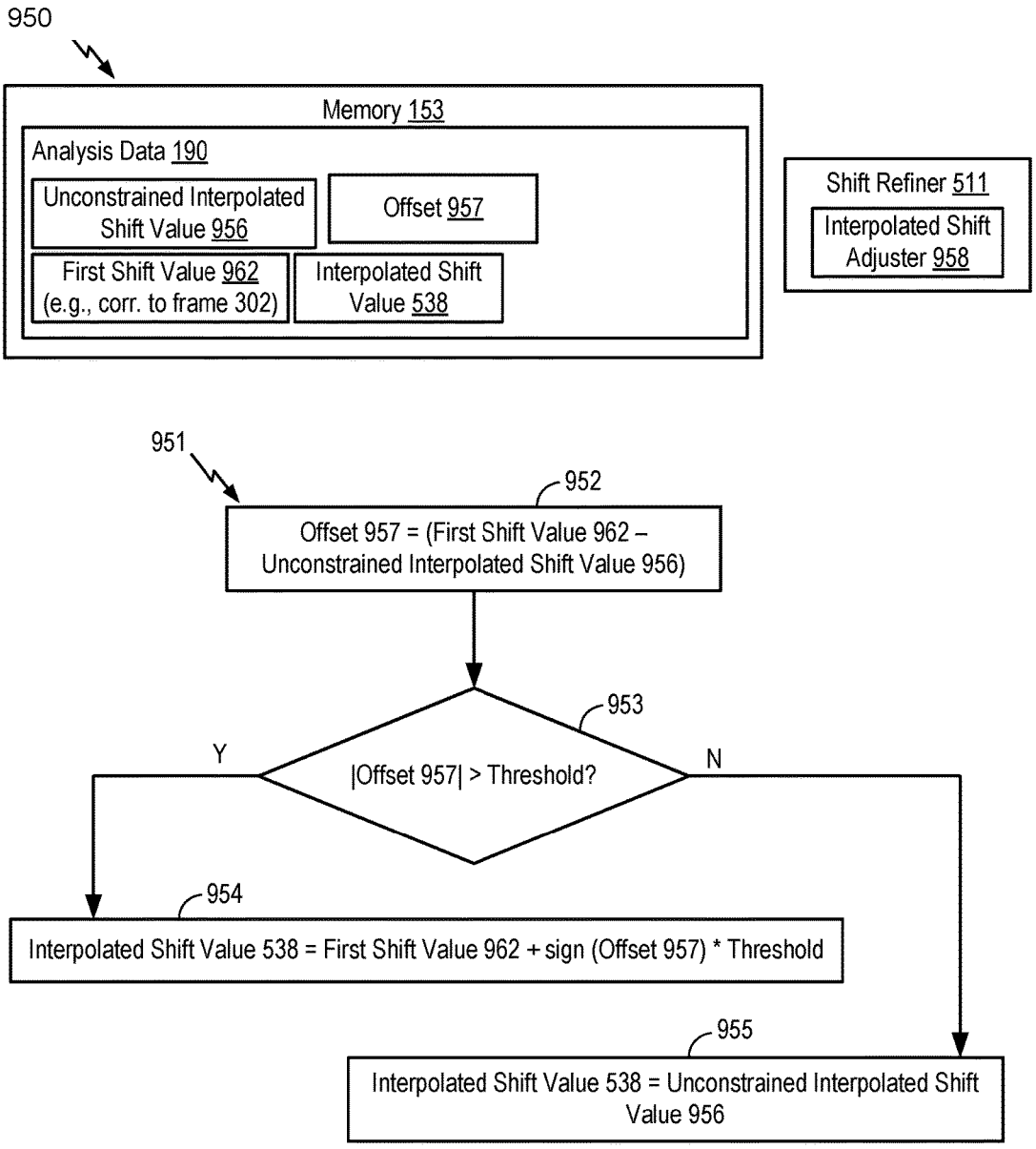
FIG. 9B is a diagram illustrating another example of a system operable to encode multiple audio signals.

Referring to FIG. 9B, an illustrative example of a system is shown and generally designated 950. The system 950 may correspond to the system 100 of FIG. 1. For example, the system 100, the first device 104 of FIG. 1, or both, may include one or more components of the system 950. The system 950 may include the memory 153, the shift refiner 511, or both. The shift refiner 511 may include an interpolated shift adjuster 958. The interpolated shift adjuster 958 may be configured to selectively adjust the interpolated shift value 538 based on the first shift value 962, as described herein. The shift refiner 511 may determine the amended shift value 540 based on the interpolated shift value 538 (e.g., the adjusted interpolated shift value 538), as described with reference to FIGS. 9A, 9C.

FIG. 9B also includes a flow chart of an illustrative method of operation generally designated 951. The method 951 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911 of FIG. 9A, the interpolated shift adjuster 958, or a combination thereof.

The method 951 includes generating an offset 957 based on a difference between the first shift value 962 and an unconstrained interpolated shift value 956, at 952. For example, the interpolated shift adjuster 958 may generate the offset 957 based on a difference between the first shift value 962 and an unconstrained interpolated shift value 956. The unconstrained interpolated shift value 956 may correspond to the interpolated shift value 538 (e.g., prior to adjustment by the interpolated shift adjuster 958). The interpolated shift adjuster 958 may store the unconstrained interpolated shift value 956 in the memory 153. For example, the analysis data 190 may include the unconstrained interpolated shift value 956.

The method 951 also includes determining whether an absolute value of the offset 957 is greater than a threshold, at 953. For example, the interpolated shift adjuster 958 may determine whether an absolute value of the offset 957 satisfies a threshold. The threshold may correspond to an interpolated shift limitation MAX_SHIFT_CHANGE (e.g., 4).

The method 951 includes, in response to determining that the absolute value of the offset 957 is greater than the threshold, at 953, setting the interpolated shift value 538 based on the first shift value 962, a sign of the offset 957, and the threshold, at 954. For example, the interpolated shift adjuster 958 may in response to determining that the absolute value of the offset 957 fails to satisfy (e.g., is greater than) the threshold, constrain the interpolated shift value 538. To illustrate, the interpolated shift adjuster 958 may adjust the interpolated shift value 538 based on the first shift value 962, a sign (e.g., +1 or −1) of the offset 957, and the threshold (e.g., the interpolated shift value 538=the first shift value 962+sign (the offset 957)*Threshold).

The method 951 includes, in response to determining that the absolute value of the offset 957 is less than or equal to the threshold, at 953, set the interpolated shift value 538 to the unconstrained interpolated shift value 956, at 955. For example, the interpolated shift adjuster 958 may in response to determining that the absolute value of the offset 957 satisfies (e.g., is less than or equal to) the threshold, refrain from changing the interpolated shift value 538.

The method 951 may thus enable constraining the interpolated shift value 538 such that a change in the interpolated shift value 538 relative to the first shift value 962 satisfies an interpolation shift limitation.

Figure 9C:
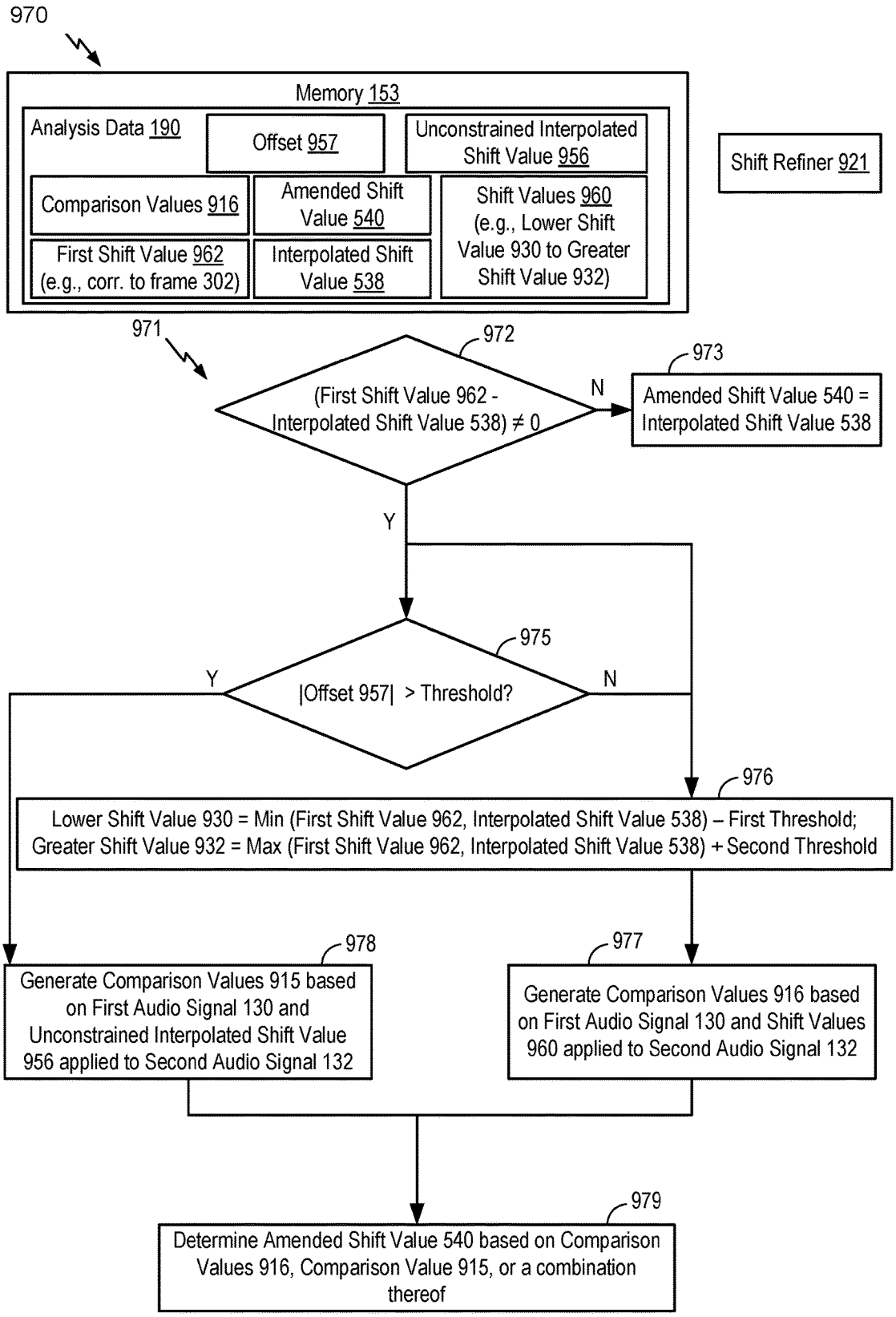
FIG. 9C is a diagram illustrating another example of a system operable to encode multiple audio signals.

Referring to FIG. 9C, an illustrative example of a system is shown and generally designated 970. The system 970 may correspond to the system 100 of FIG. 1. For example, the system 100, the first device 104 of FIG. 1, or both, may include one or more components of the system 970. The system 970 may include the memory 153, a shift refiner 921, or both. The shift refiner 921 may correspond to the shift refiner 511 of FIG. 5.

FIG. 9C also includes a flow chart of an illustrative method of operation generally designated 971. The method 971 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911 of FIG. 9A, the shift refiner 921, or a combination thereof.

The method 971 includes determining whether a difference between the first shift value 962 and the interpolated shift value 538 is non-zero, at 972. For example, the shift refiner 921 may determine whether a difference between the first shift value 962 and the interpolated shift value 538 is non-zero.

The method 971 includes, in response to determining that the difference between the first shift value 962 and the interpolated shift value 538 is zero, at 972, setting the amended shift value 540 to the interpolated shift value 538, at 973. For example, the shift refiner 921 may, in response to determining that the difference between the first shift value 962 and the interpolated shift value 538 is zero, determine the amended shift value 540 based on the interpolated shift value 538 (e.g., the amended shift value 540=the interpolated shift value 538).

The method 971 includes, in response to determining that the difference between the first shift value 962 and the interpolated shift value 538 is non-zero, at 972, determining whether an absolute value of the offset 957 is greater than a threshold, at 975. For example, the shift refiner 921 may, in response to determining that the difference between the first shift value 962 and the interpolated shift value 538 is non-zero, determine whether an absolute value of the offset 957 is greater than a threshold. The offset 957 may correspond to a difference between the first shift value 962 and the unconstrained interpolated shift value 956, as described with reference to FIG. 9B. The threshold may correspond to an interpolated shift limitation MAX_SHIFT_CHANGE (e.g., 4).

The method 971 includes, in response to determining that a difference between the first shift value 962 and the interpolated shift value 538 is non-zero, at 972, or determining that the absolute value of the offset 957 is less than or equal to the threshold, at 975, setting the lower shift value 930 to a difference between a first threshold and a minimum of the first shift value 962 and the interpolated shift value 538, and setting the greater shift value 932 to a sum of a second threshold and a maximum of the first shift value 962 and the interpolated shift value 538, at 976. For example, the shift refiner 921 may, in response to determining that the absolute value of the offset 957 is less than or equal to the threshold, determine the lower shift value 930 based on a difference between a first threshold and a minimum of the first shift value 962 and the interpolated shift value 538. The shift refiner 921 may also determine the greater shift value 932 based on a sum of a second threshold and a maximum of the first shift value 962 and the interpolated shift value 538.

The method 971 also includes generating the comparison values 916 based on the first audio signal 130 and the shift values 960 applied to the second audio signal 132, at 977. For example, the shift refiner 921 (or the signal comparator 506) may generate the comparison values 916, as described with reference to FIG. 7, based on the first audio signal 130 and the shift values 960 applied to the second audio signal 132. The shift values 960 may range from the lower shift value 930 to the greater shift value 932. The method 971 may proceed to 979.

The method 971 includes, in response to determining that the absolute value of the offset 957 is greater than the threshold, at 975, generating a comparison value 915 based on the first audio signal 130 and the unconstrained interpolated shift value 956 applied to the second audio signal 132, at 978. For example, the shift refiner 921 (or the signal comparator 506) may generate the comparison value 915, as described with reference to FIG. 7, based on the first audio signal 130 and the unconstrained interpolated shift value 956 applied to the second audio signal 132.

The method 971 also includes determining the amended shift value 540 based on the comparison values 916, the comparison value 915, or a combination thereof, at 979. For example, the shift refiner 921 may determine the amended shift value 540 based on the comparison values 916, the comparison value 915, or a combination thereof, as described with reference to FIG. 9A. In some implementations, the shift refiner 921 may determine the amended shift value 540 based on a comparison of the comparison value 915 and the comparison values 916 to avoid local maxima due to shift variation.

In some cases, an inherent pitch of the first audio signal 130, the first resampled signal 530, the second audio signal 132, the second resampled signal 532, or a combination thereof, may interfere with the shift estimation process. In such cases, pitch de-emphasis or pitch filtering may be performed to reduce the interference due to pitch and to improve reliability of shift estimation between multiple channels. In some cases, background noise may be present in the first audio signal 130, the first resampled signal 530, the second audio signal 132, the second resampled signal 532, or a combination thereof, that may interfere with the shift estimation process. In such cases, noise suppression or noise cancellation may be used to improve reliability of shift estimation between multiple channels.

Figure 10A:
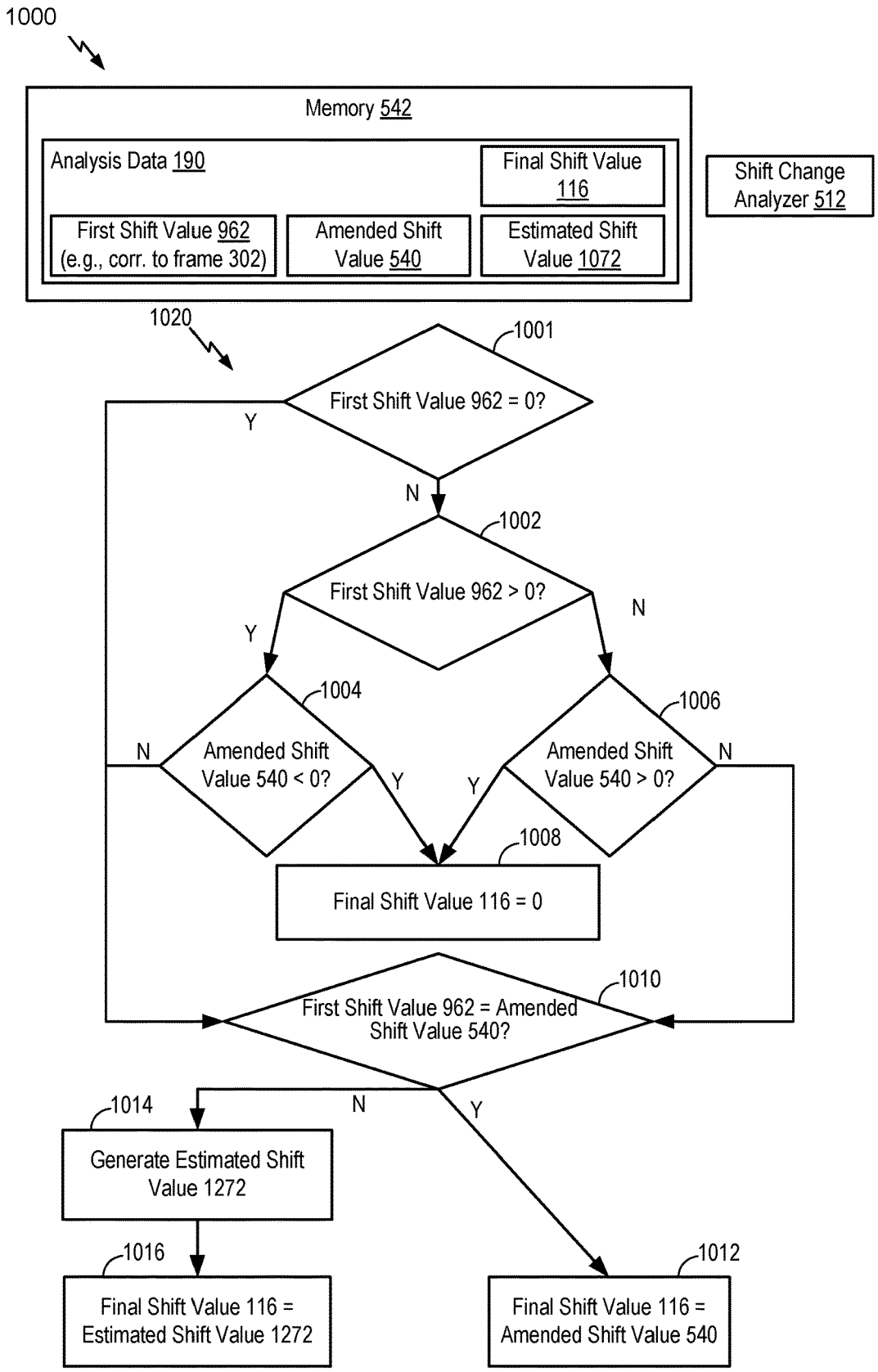
FIG. 10A is a diagram illustrating another example of a system operable to encode multiple audio signals.

Referring to FIG. 10A, an illustrative example of a system is shown and generally designated 1000. The system 1000 may correspond to the system 100 of FIG. 1. For example, the system 100, the first device 104 of FIG. 1, or both, may include one or more components of the system 1000.

FIG. 10A also includes a flow chart of an illustrative method of operation generally designated 1020. The method 1020 may be performed by the shift change analyzer 512, the temporal equalizer 108, the encoder 114, the first device 104, or a combination thereof.

The method 1020 includes determining whether the first shift value 962 is equal to 0, at 1001. For example, the shift change analyzer 512 may determine whether the first shift value 962 corresponding to the frame 302 has a first value (e.g., 0) indicating no time shift. The method 1020 includes, in response to determining that the first shift value 962 is equal to 0, at 1001, proceeding to 1010.

The method 1020 includes, in response to determining that the first shift value 962 is non-zero, at 1001, determining whether the first shift value 962 is greater than 0, at 1002. For example, the shift change analyzer 512 may determine whether the first shift value 962 corresponding to the frame 302 has a first value (e.g., a positive value) indicating that the second audio signal 132 is delayed in time relative to the first audio signal 130.

The method 1020 includes, in response to determining that the first shift value 962 is greater than 0, at 1002, determining whether the amended shift value 540 is less than 0, at 1004. For example, the shift change analyzer 512 may, in response to determining that the first shift value 962 has the first value (e.g., a positive value), determine whether the amended shift value 540 has a second value (e.g., a negative value) indicating that the first audio signal 130 is delayed in time relative to the second audio signal 132. The method 1020 includes, in response to determining that the amended shift value 540 is less than 0, at 1004, proceeding to 1008. The method 1020 includes, in response to determining that the amended shift value 540 is greater than or equal to 0, at 1004, proceeding to 1010.

The method 1020 includes, in response to determining that the first shift value 962 is less than 0, at 1002, determining whether the amended shift value 540 is greater than 0, at 1006. For example, the shift change analyzer 512 may in response to determining that the first shift value 962 has the second value (e.g., a negative value), determine whether the amended shift value 540 has a first value (e.g., a positive value) indicating that the second audio signal 132 is delayed in time with respect to the first audio signal 130. The method 1020 includes, in response to determining that the amended shift value 540 is greater than 0, at 1006, proceeding to 1008. The method 1020 includes, in response to determining that the amended shift value 540 is less than or equal to 0, at 1006, proceeding to 1010.

The method 1020 includes setting the final shift value 116 to 0, at 1008. For example, the shift change analyzer 512 may set the final shift value 116 to a particular value (e.g., 0) that indicates no time shift. The final shift value 116 may be set to the particular value (e.g., 0) in response to determining that the leading signal and the lagging signal switched during a period after generating the frame 302. For example, the frame 302 may be encoded based on the first shift value 962 indicating that the first audio signal 130 is the leading signal and the second audio signal 132 is the lagging signal. The amended shift value 540 may indicate that the first audio signal 130 is the lagging signal and the second audio signal 132 is the leading signal. The shift change analyzer 512 may set the final shift value 116 to the particular value in response to determining that a leading signal indicated by the first shift value 962 is distinct from a leading signal indicated by the amended shift value 540.

The method 1020 includes determining whether the first shift value 962 is equal to the amended shift value 540, at 1010. For example, the shift change analyzer 512 may determine whether the first shift value 962 and the amended shift value 540 indicate the same time delay between the first audio signal 130 and the second audio signal 132.

The method 1020 includes, in response to determining that the first shift value 962 is equal to the amended shift value 540, at 1010, setting the final shift value 116 to the amended shift value 540, at 1012. For example, the shift change analyzer 512 may set the final shift value 116 to the amended shift value 540.

The method 1020 includes, in response to determining that the first shift value 962 is not equal to the amended shift value 540, at 1010, generating an estimated shift value 1072, at 1014. For example, the shift change analyzer 512 may determine the estimated shift value 1072 by refining the amended shift value 540, as further described with reference to FIG. 11.

The method 1020 includes setting the final shift value 116 to the estimated shift value 1072, at 1016. For example, the shift change analyzer 512 may set the final shift value 116 to the estimated shift value 1072.

In some implementations, the shift change analyzer 512 may set the non-causal shift value 162 to indicate the second estimated shift value in response to determining that the delay between the first audio signal 130 and the second audio signal 132 did not switch. For example, the shift change analyzer 512 may set the non-causal shift value 162 to indicate the amended shift value 540 in response to determining that the first shift value 962 is equal to 0, 1001, that the amended shift value 540 is greater than or equal to 0, at 1004, or that the amended shift value 540 is less than or equal to 0, at 1006.

The shift change analyzer 512 may thus set the non-causal shift value 162 to indicate no time shift in response to determining that delay between the first audio signal 130 and the second audio signal 132 switched between the frame 302 and the frame 304 of FIG. 3. Preventing the non-causal shift value 162 from switching directions (e.g., positive to negative or negative to positive) between consecutive frames may reduce distortion in downmix signal generation at the encoder 114, avoid use of additional delay for upmix synthesis at a decoder, or both.

Figure 10B:
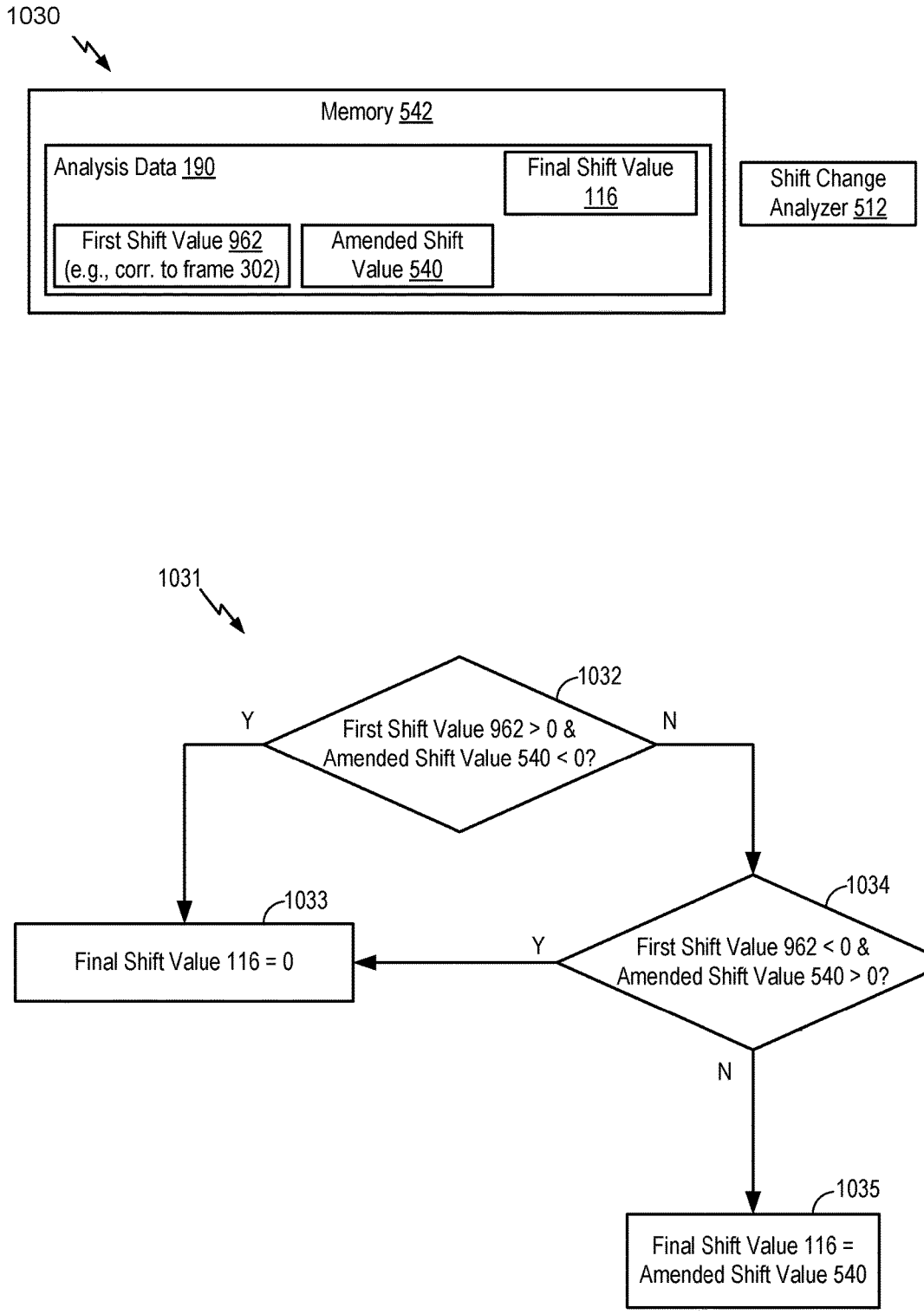
FIG. 10B is a diagram illustrating another example of a system operable to encode multiple audio signals.

Referring to FIG. 10B, an illustrative example of a system is shown and generally designated 1030. The system 1030 may correspond to the system 100 of FIG. 1. For example, the system 100, the first device 104 of FIG. 1, or both, may include one or more components of the system 1030.

FIG. 10B also includes a flow chart of an illustrative method of operation generally designated 1031. The method 1031 may be performed by the shift change analyzer 512, the temporal equalizer 108, the encoder 114, the first device 104, or a combination thereof.

The method 1031 includes determining whether the first shift value 962 is greater than zero and the amended shift value 540 is less than zero, at 1032. For example, the shift change analyzer 512 may determine whether the first shift value 962 is greater than zero and whether the amended shift value 540 is less than zero.

The method 1031 includes, in response to determining that the first shift value 962 is greater than zero and that the amended shift value 540 is less than zero, at 1032, setting the final shift value 116 to zero, at 1033. For example, the shift change analyzer 512 may, in response to determining that the first shift value 962 is greater than zero and that the amended shift value 540 is less than zero, set the final shift value 116 to a first value (e.g., 0) that indicates no time shift.

The method 1031 includes, in response to determining that the first shift value 962 is less than or equal to zero or that the amended shift value 540 is greater than or equal to zero, at 1032, determining whether the first shift value 962 is less than zero and whether the amended shift value 540 is greater than zero, at 1034. For example, the shift change analyzer 512 may, in response to determining that the first shift value 962 is less than or equal to zero or that the amended shift value 540 is greater than or equal to zero, determine whether the first shift value 962 is less than zero and whether the amended shift value 540 is greater than zero.

The method 1031 includes, in response to determining that the first shift value 962 is less than zero and that the amended shift value 540 is greater than zero, proceeding to 1033. The method 1031 includes, in response to determining that the first shift value 962 is greater than or equal to zero or that the amended shift value 540 is less than or equal to zero, setting the final shift value 116 to the amended shift value 540, at 1035. For example, the shift change analyzer 512 may, in response to determining that the first shift value 962 is greater than or equal to zero or that the amended shift value 540 is less than or equal to zero, set the final shift value 116 to the amended shift value 540.

Figure 11:
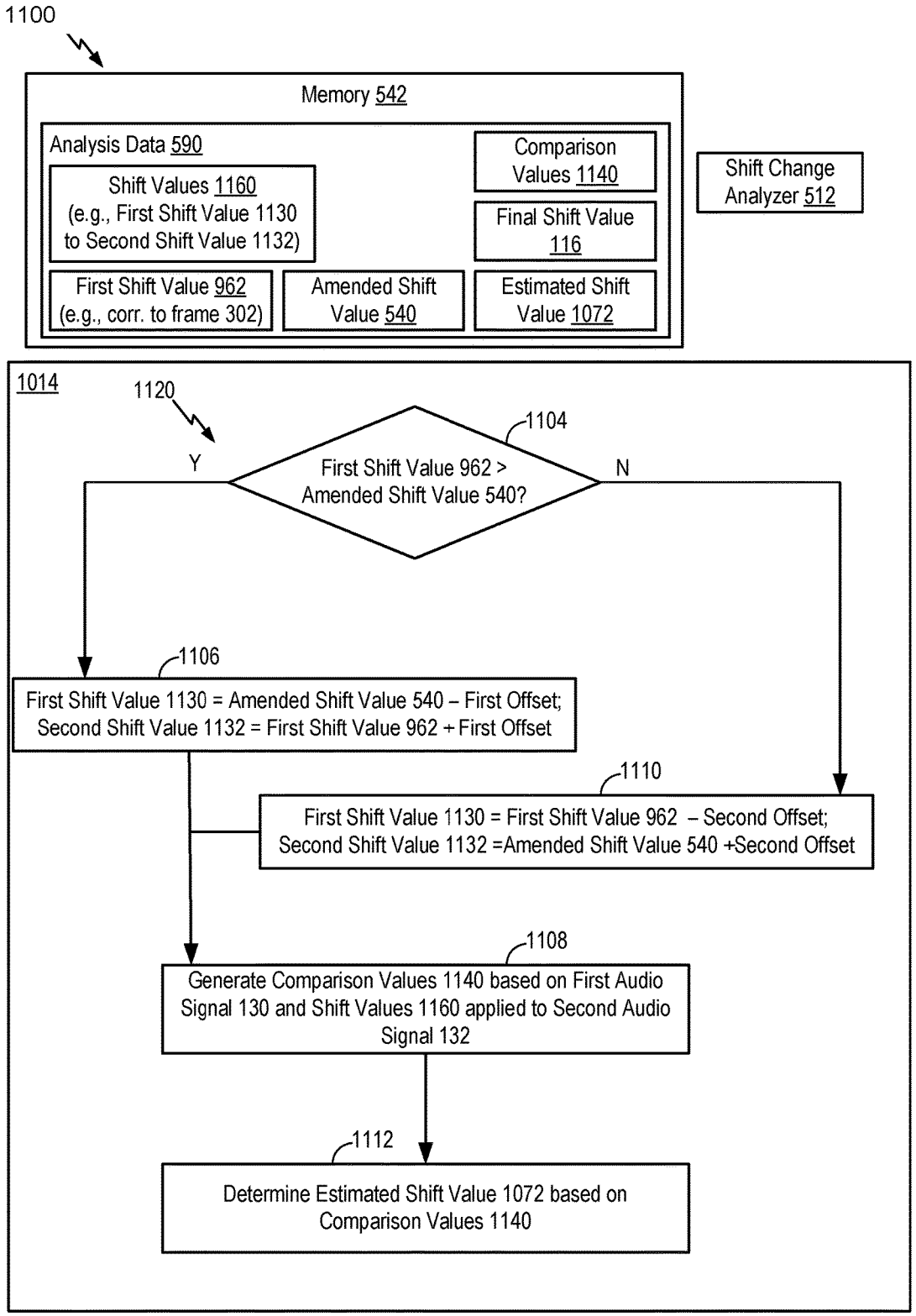
FIG. 11 is a diagram illustrating another example of a system operable to encode multiple audio signals.

Referring to FIG. 11, an illustrative example of a system is shown and generally designated 1100. The system 1100 may correspond to the system 100 of FIG. 1. For example, the system 100, the first device 104 of FIG. 1, or both, may include one or more components of the system 1100. FIG. 11 also includes a flow chart illustrating a method of operation that is generally designated 1120. The method 1120 may be performed by the shift change analyzer 512, the temporal equalizer 108, the encoder 114, the first device 104, or a combination thereof. The method 1120 may correspond to the step 1014 of FIG. 10A.

The method 1120 includes determining whether the first shift value 962 is greater than the amended shift value 540, at 1104. For example, the shift change analyzer 512 may determine whether the first shift value 962 is greater than the amended shift value 540.

The method 1120 also includes, in response to determining that the first shift value 962 is greater than the amended shift value 540, at 1104, setting a first shift value 1130 to a difference between the amended shift value 540 and a first offset, and setting a second shift value 1132 to a sum of the first shift value 962 and the first offset, at 1106. For example, the shift change analyzer 512 may, in response to determining that the first shift value 962 (e.g., 20) is greater than the amended shift value 540 (e.g., 18), determine the first shift value 1130 (e.g., 17) based on the amended shift value 540 (e.g., amended shift value 540−a first offset). Alternatively, or in addition, the shift change analyzer 512 may determine the second shift value 1132 (e.g., 21) based on the first shift value 962 (e.g., the first shift value 962+the first offset). The method 1120 may proceed to 1108.

The method 1120 further includes, in response to determining that the first shift value 962 is less than or equal to the amended shift value 540, at 1104, setting the first shift value 1130 to a difference between the first shift value 962 and a second offset, and setting the second shift value 1132 to a sum of the amended shift value 540 and the second offset. For example, the shift change analyzer 512 may, in response to determining that the first shift value 962 (e.g., 10) is less than or equal to the amended shift value 540 (e.g., 12), determine the first shift value 1130 (e.g., 9) based on the first shift value 962 (e.g., first shift value 962−a second offset). Alternatively, or in addition, the shift change analyzer 512 may determine the second shift value 1132 (e.g., 13) based on the amended shift value 540 (e.g., the amended shift value 540+the second offset). The first offset (e.g., 2) may be distinct from the second offset (e.g., 3). In some implementations, the first offset may be the same as the second offset. A higher value of the first offset, the second offset, or both, may improve a search range.

The method 1120 also includes generating comparison values 1140 based on the first audio signal 130 and shift values 1160 applied to the second audio signal 132, at 1108. For example, the shift change analyzer 512 may generate the comparison values 1140, as described with reference to FIG. 7, based on the first audio signal 130 and the shift values 1160 applied to the second audio signal 132. To illustrate, the shift values 1160 may range from the first shift value 1130 (e.g., 17) to the second shift value 1132 (e.g., 21). The shift change analyzer 512 may generate a particular comparison value of the comparison values 1140 based on the samples 326-332 and a particular subset of the second samples 350. The particular subset of the second samples 350 may correspond to a particular shift value (e.g., 17) of the shift values 1160. The particular comparison value may indicate a difference (or a correlation) between the samples 326-332 and the particular subset of the second samples 350.

The method 1120 further includes determining the estimated shift value 1072 based on the comparison values 1140, at 1112. For example, the shift change analyzer 512 may, when the comparison values 1140 correspond to cross-correlation values, select a highest comparison value of the comparison values 1140 as the estimated shift value 1072. Alternatively, the shift change analyzer 512 may, when the comparison values 1140 correspond to difference values, select a lowest comparison value of the comparison values 1140 as the estimated shift value 1072.

The method 1120 may thus enable the shift change analyzer 512 to generate the estimated shift value 1072 by refining the amended shift value 540. For example, the shift change analyzer 512 may determine the comparison values 1140 based on original samples and may select the estimated shift value 1072 corresponding to a comparison value of the comparison values 1140 that indicates a highest correlation (or lowest difference).

Figure 12:
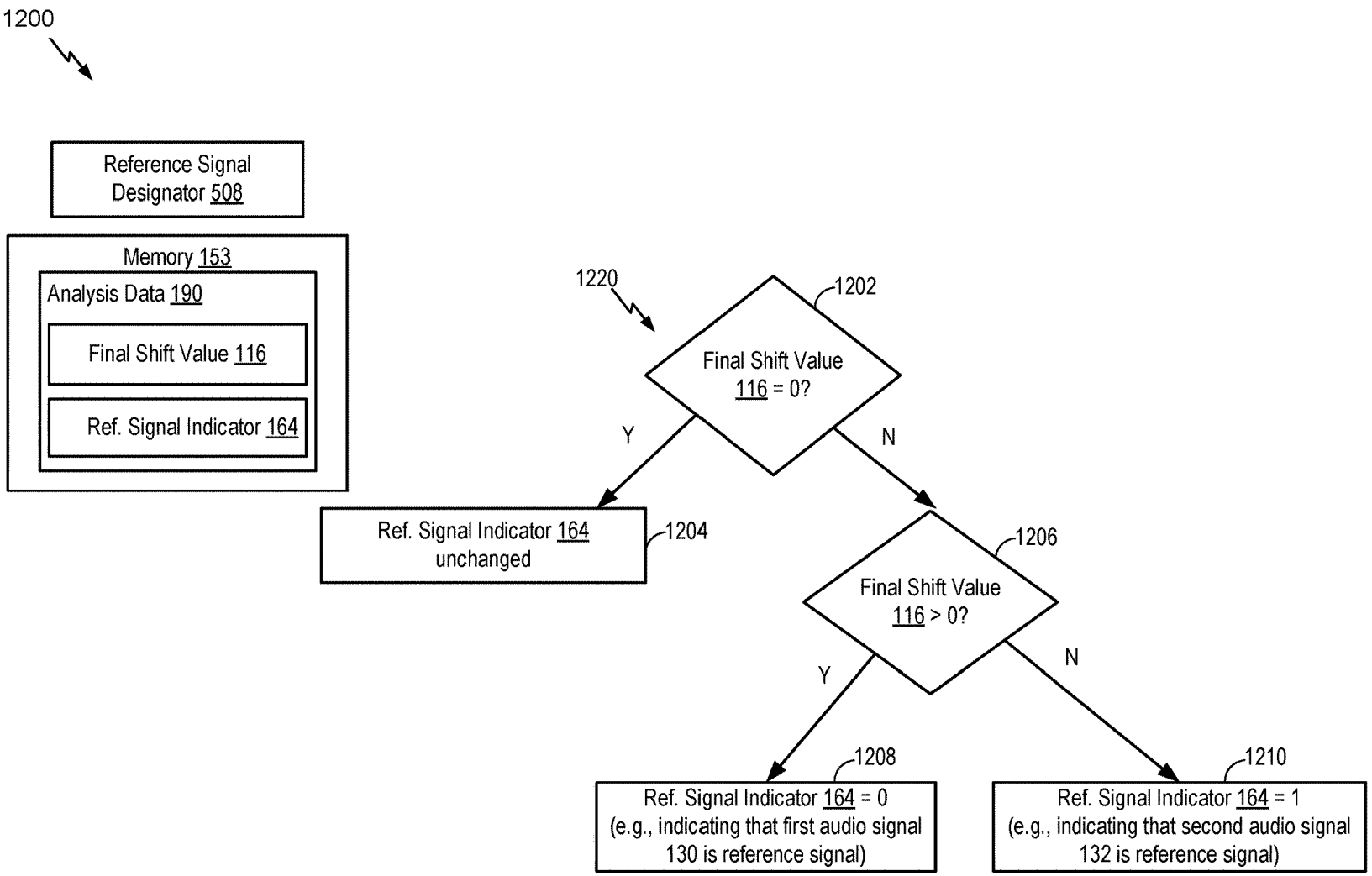
FIG. 12 is a diagram illustrating another example of a system operable to encode multiple audio signals.

Referring to FIG. 12, an illustrative example of a system is shown and generally designated 1200. The system 1200 may correspond to the system 100 of FIG. 1. For example, the system 100, the first device 104 of FIG. 1, or both, may include one or more components of the system 1200. FIG. 12 also includes a flow chart illustrating a method of operation that is generally designated 1220. The method 1220 may be performed by the reference signal designator 508, the temporal equalizer 108, the encoder 114, the first device 104, or a combination thereof.

The method 1220 includes determining whether the final shift value 116 is equal to 0, at 1202. For example, the reference signal designator 508 may determine whether the final shift value 116 has a particular value (e.g., 0) indicating no time shift.

The method 1220 includes, in response to determining that the final shift value 116 is equal to 0, at 1202, leaving the reference signal indicator 164 unchanged, at 1204. For example, the reference signal designator 508 may, in response to determining that the final shift value 116 has the particular value (e.g., 0) indicating no time shift, leave the reference signal indicator 164 unchanged. To illustrate, the reference signal indicator 164 may indicate that the same audio signal (e.g., the first audio signal 130 or the second audio signal 132) is a reference signal associated with the frame 304 as with the frame 302.

The method 1220 includes, in response to determining that the final shift value 116 is non-zero, at 1202, determining whether the final shift value 116 is greater than 0, at 1206. For example, the reference signal designator 508 may, in response to determining that the final shift value 116 has a particular value (e.g., a non-zero value) indicating a time shift, determine whether the final shift value 116 has a first value (e.g., a positive value) indicating that the second audio signal 132 is delayed relative to the first audio signal 130 or a second value (e.g., a negative value) indicating that the first audio signal 130 is delayed relative to the second audio signal 132.

The method 1220 includes, in response to determining that the final shift value 116 has the first value (e.g., a positive value), set the reference signal indicator 164 to have a first value (e.g., 0) indicating that the first audio signal 130 is a reference signal, at 1208. For example, the reference signal designator 508 may, in response to determining that the final shift value 116 has the first value (e.g., a positive value), set the reference signal indicator 164 to a first value (e.g., 0) indicating that the first audio signal 130 is a reference signal. The reference signal designator 508 may, in response to determining that the final shift value 116 has the first value (e.g., the positive value), determine that the second audio signal 132 corresponds to a target signal.

The method 1220 includes, in response to determining that the final shift value 116 has the second value (e.g., a negative value), set the reference signal indicator 164 to have a second value (e.g., 1) indicating that the second audio signal 132 is a reference signal, at 1210. For example, the reference signal designator 508 may, in response to determining that the final shift value 116 has the second value (e.g., a negative value) indicating that the first audio signal 130 is delayed relative to the second audio signal 132, set the reference signal indicator 164 to a second value (e.g., 1) indicating that the second audio signal 132 is a reference signal. The reference signal designator 508 may, in response to determining that the final shift value 116 has the second value (e.g., the negative value), determine that the first audio signal 130 corresponds to a target signal.

The reference signal designator 508 may provide the reference signal indicator 164 to the gain parameter generator 514. The gain parameter generator 514 may determine a gain parameter (e.g., a gain parameter 160) of a target signal based on a reference signal, as described with reference to FIG. 5.

A target signal may be delayed in time relative to a reference signal. The reference signal indicator 164 may indicate whether the first audio signal 130 or the second audio signal 132 corresponds to the reference signal. The reference signal indicator 164 may indicate whether the gain parameter 160 corresponds to the first audio signal 130 or the second audio signal 132.

Figure 13:
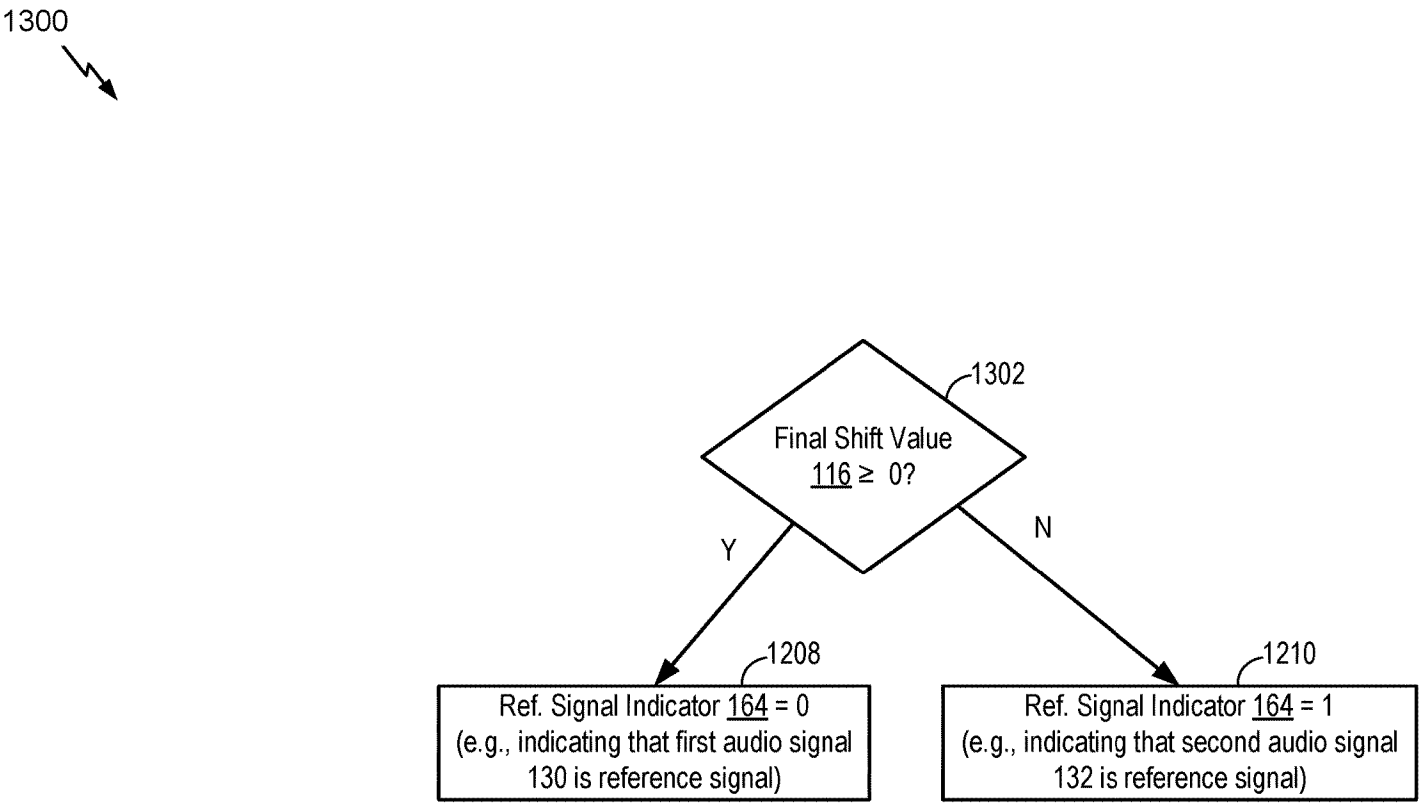
FIG. 13 is a flow chart illustrating a particular method of encoding multiple audio signals.

Referring to FIG. 13, a flow chart illustrating a particular method of operation is shown and generally designated 1300. The method 1300 may be performed by the reference signal designator 508, the temporal equalizer 108, the encoder 114, the first device 104, or a combination thereof.

The method 1300 includes determining whether the final shift value 116 is greater than or equal to zero, at 1302. For example, the reference signal designator 508 may determine whether the final shift value 116 is greater than or equal to zero. The method 1300 also includes, in response to determining that the final shift value 116 is greater than or equal to zero, at 1302, proceeding to 1208. The method 1300 further includes, in response to determining that the final shift value 116 is less than zero, at 1302, proceeding to 1210. The method 1300 differs from the method 1220 of FIG. 12 in that, in response to determining that the final shift value 116 has a particular value (e.g., 0) indicating no time shift, the reference signal indicator 164 is set to a first value (e.g., 0) indicating that the first audio signal 130 corresponds to a reference signal. In some implementations, the reference signal designator 508 may perform the method 1220. In other implementations, the reference signal designator 508 may perform the method 1300.

The method 1300 may thus enable setting the reference signal indicator 164 to a particular value (e.g., 0) indicating that the first audio signal 130 corresponds to a reference signal when the final shift value 116 indicates no time shift independently of whether the first audio signal 130 corresponds to the reference signal for the frame 302.

Figure 14:
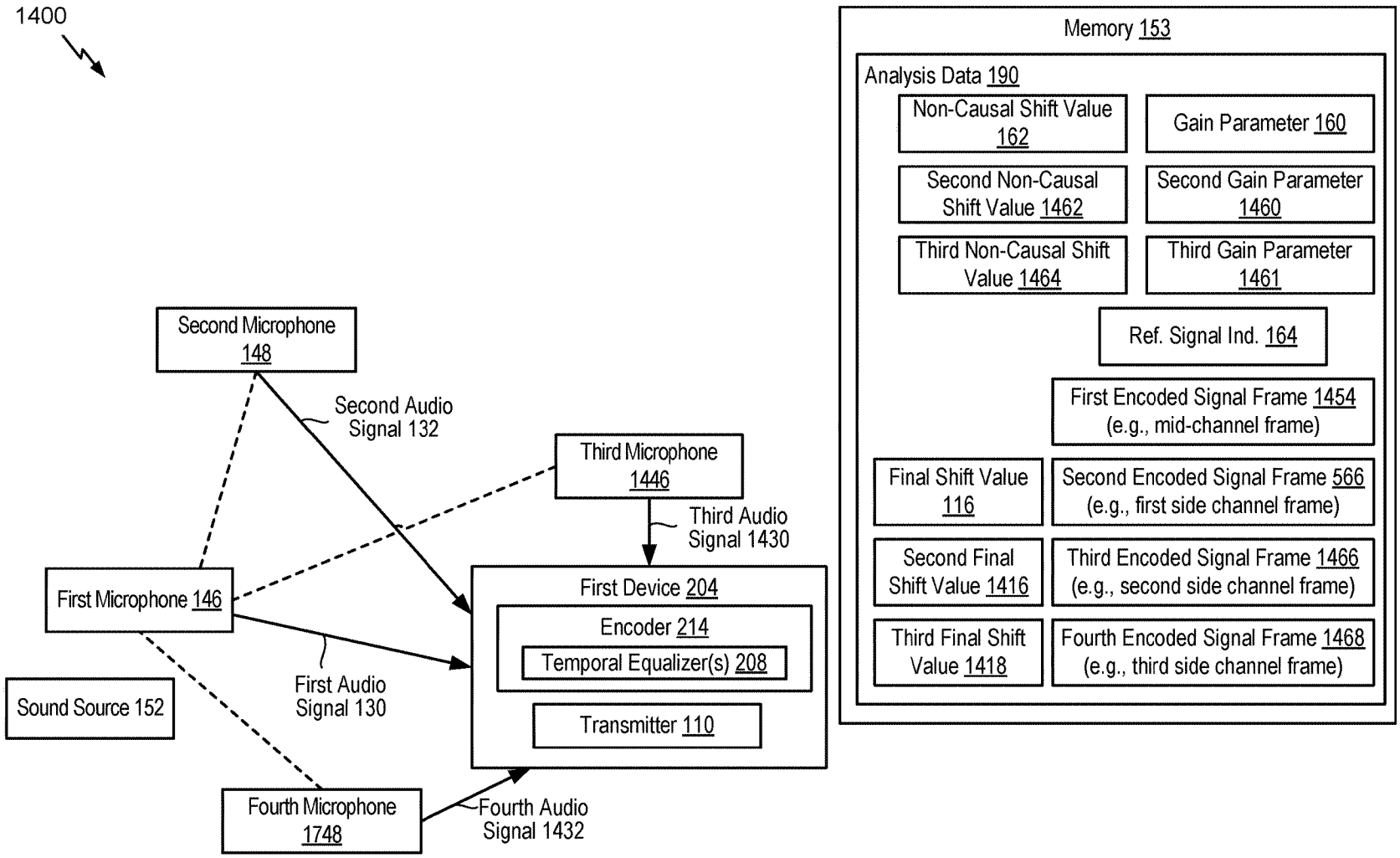
FIG. 14 is a diagram illustrating another example of a system that includes the device of FIG. 1.

Referring to FIG. 14, an illustrative example of a system is shown and generally designated 1400. The system 1400 may correspond to the system 100 of FIG. 1, the system 200 of FIG. 2, or both. For example, the system 100, the first device 104 of FIG. 1, the system 200, the first device 204 of FIG. 2, or a combination thereof, may include one or more components of the system 1400. The first device 204 is coupled to the first microphone 146, the second microphone 148, a third microphone 1446, and a fourth microphone 1448.

During operation, the first device 204 may receive the first audio signal 130 via the first microphone 146, the second audio signal 132 via the second microphone 148, a third audio signal 1430 via the third microphone 1446, a fourth audio signal 1432 via the fourth microphone 1448, or a combination thereof. The sound source 152 may be closer to one of the first microphone 146, the second microphone 148, the third microphone 1446, or the fourth microphone 1448 than to the remaining microphones. For example, the sound source 152 may be closer to the first microphone 146 than to each of the second microphone 148, the third microphone 1446, and the fourth microphone 1448.

The temporal equalizer(s) 208 may determine a final shift value, as described with reference to FIG. 1, indicative of a shift of a particular audio signal of the first audio signal 130, the second audio signal 132, the third audio signal 1430, or fourth audio signal 1432 relative to each of the remaining audio signals. For example, the temporal equalizer(s) 208 may determine the final shift value 116 indicative of a shift of the second audio signal 132 relative to the first audio signal 130, a second final shift value 1416 indicative of a shift of the third audio signal 1430 relative to the first audio signal 130, a third final shift value 1418 indicative of a shift of the fourth audio signal 1432 relative to the first audio signal 130, or a combination thereof.

The temporal equalizer(s) 208 may select one of the first audio signal 130, the second audio signal 132, the third audio signal 1430, or the fourth audio signal 1432 as a reference signal based on the final shift value 116, the second final shift value 1416, and the third final shift value 1418. For example, the temporal equalizer(s) 208 may select the particular signal (e.g., the first audio signal 130) as a reference signal in response to determining that each of the final shift value 116, the second final shift value 1416, and the third final shift value 1418 has a first value (e.g., a non-negative value) indicating that the corresponding audio signal is delayed in time relative to the particular audio signal or that there is no time delay between the corresponding audio signal and the particular audio signal. To illustrate, a positive value of a shift value (e.g., the final shift value 116, the second final shift value 1416, or the third final shift value 1418) may indicate that a corresponding signal (e.g., the second audio signal 132, the third audio signal 1430, or the fourth audio signal 1432) is delayed in time relative to the first audio signal 130. A zero value of a shift value (e.g., the final shift value 116, the second final shift value 1416, or the third final shift value 1418) may indicate that there is no time delay between a corresponding signal (e.g., the second audio signal 132, the third audio signal 1430, or the fourth audio signal 1432) and the first audio signal 130.

The temporal equalizer(s) 208 may generate the reference signal indicator 164 to indicate that the first audio signal 130 corresponds to the reference signal. The temporal equalizer(s) 208 may determine that the second audio signal 132, the third audio signal 1430, and the fourth audio signal 1432 correspond to target signals.

Alternatively, the temporal equalizer(s) 208 may determine that at least one of the final shift value 116, the second final shift value 1416, or the third final shift value 1418 has a second value (e.g., a negative value) indicating that the particular audio signal (e.g., the first audio signal 130) is delayed with respect to another audio signal (e.g., the second audio signal 132, the third audio signal 1430, or the fourth audio signal 1432).

The temporal equalizer(s) 208 may select a first subset of shift values from the final shift value 116, the second final shift value 1416, and the third final shift value 1418. Each shift value of the first subset may have a value (e.g., a negative value) indicating that the first audio signal 130 is delayed in time relative to a corresponding audio signal. For example, the second final shift value 1416 (e.g., −12) may indicate that the first audio signal 130 is delayed in time relative to the third audio signal 1430. The third final shift value 1418 (e.g., −14) may indicate that the first audio signal 130 is delayed in time relative to the fourth audio signal 1432. The first subset of shift values may include the second final shift value 1416 and third final shift value 1418.

The temporal equalizer(s) 208 may select a particular shift value (e.g., a lower shift value) of the first subset that indicates a higher delay of the first audio signal 130 to a corresponding audio signal. The second final shift value 1416 may indicate a first delay of the first audio signal 130 relative to the third audio signal 1430. The third final shift value 1418 may indicate a second delay of the first audio signal 130 relative to the fourth audio signal 1432. The temporal equalizer(s) 208 may select the third final shift value 1418 from the first subset of shift values in response to determining that the second delay is longer than the first delay.

The temporal equalizer(s) 208 may select an audio signal corresponding to the particular shift value as a reference signal. For example, the temporal equalizer(s) 208 may select the fourth audio signal 1432 corresponding to the third final shift value 1418 as the reference signal. The temporal equalizer(s) 208 may generate the reference signal indicator 164 to indicate that the fourth audio signal 1432 corresponds to the reference signal. The temporal equalizer(s) 208 may determine that the first audio signal 130, the second audio signal 132, and the third audio signal 1430 correspond to target signals.

The temporal equalizer(s) 208 may update the final shift value 116 and the second final shift value 1416 based on the particular shift value corresponding to the reference signal. For example, the temporal equalizer(s) 208 may update the final shift value 116 based on the third final shift value 1418 to indicate a first particular delay of the fourth audio signal 1432 relative to the second audio signal 132 (e.g., the final shift value 116=the final shift value 116−the third final shift value 1418). To illustrate, the final shift value 116 (e.g., 2) may indicate a delay of the first audio signal 130 relative to the second audio signal 132. The third final shift value 1418 (e.g., −14) may indicate a delay of the first audio signal 130 relative to the fourth audio signal 1432. A first difference (e.g., 16=2−(−14)) between the final shift value 116 and the third final shift value 1418 may indicate a delay of the fourth audio signal 1432 relative to the second audio signal 132. The temporal equalizer(s) 208 may update the final shift value 116 based on the first difference. The temporal equalizer(s) 208 may update the second final shift value 1416 (e.g., 2) based on the third final shift value 1418 to indicate a second particular delay of the fourth audio signal 1432 relative to the third audio signal 1430 (e.g., the second final shift value 1416=the second final shift value 1416−the third final shift value 1418). To illustrate, the second final shift value 1416 (e.g., −12) may indicate a delay of the first audio signal 130 relative to the third audio signal 1430. The third final shift value 1418 (e.g., −14) may indicate a delay of the first audio signal 130 relative to the fourth audio signal 1432. A second difference (e.g., 2=−12−(−14)) between the second final shift value 1416 and the third final shift value 1418 may indicate a delay of the fourth audio signal 1432 relative to the third audio signal 1430. The temporal equalizer(s) 208 may update the second final shift value 1416 based on the second difference.

The temporal equalizer(s) 208 may reverse the third final shift value 1418 to indicate a delay of the fourth audio signal 1432 relative to the first audio signal 130. For example, the temporal equalizer(s) 208 may update the third final shift value 1418 from a first value (e.g., −14) indicating a delay of the first audio signal 130 relative to the fourth audio signal 1432 to a second value (e.g., +14) indicating a delay of the fourth audio signal 1432 relative to the first audio signal 130 (e.g., the third final shift value 1418=−the third final shift value 1418).

The temporal equalizer(s) 208 may generate the non-causal shift value 162 by applying an absolute value function to the final shift value 116. The temporal equalizer(s) 208 may generate a second non-causal shift value 1462 by applying an absolute value function to the second final shift value 1416. The temporal equalizer(s) 208 may generate a third non-causal shift value 1464 by applying an absolute value function to the third final shift value 1418.

The temporal equalizer(s) 208 may generate a gain parameter of each target signal based on the reference signal, as described with reference to FIG. 1. In an example where the first audio signal 130 corresponds to the reference signal, the temporal equalizer(s) 208 may generate the gain parameter 160 of the second audio signal 132 based on the first audio signal 130, a second gain parameter 1460 of the third audio signal 1430 based on the first audio signal 130, a third gain parameter 1461 of the fourth audio signal 1432 based on the first audio signal 130, or a combination thereof.

The temporal equalizer(s) 208 may generate an encoded signal (e.g., a mid channel signal frame) based on the first audio signal 130, the second audio signal 132, the third audio signal 1430, and the fourth audio signal 1432. For example, the encoded signal (e.g., a first encoded signal frame 1454) may correspond to a sum of samples of reference signal (e.g., the first audio signal 130) and samples of the target signals (e.g., the second audio signal 132, the third audio signal 1430, and the fourth audio signal 1432). The samples of each of the target signals may be time-shifted relative to the samples of the reference signal based on a corresponding shift value, as described with reference to FIG. 1. The temporal equalizer(s) 208 may determine a first product of the gain parameter 160 and samples of the second audio signal 132, a second product of the second gain parameter 1460 and samples of the third audio signal 1430, and a third product of the third gain parameter 1461 and samples of the fourth audio signal 1432. The first encoded signal frame 1454 may correspond to a sum of samples of the first audio signal 130, the first product, the second product, and the third product. That is, the first encoded signal frame 1454 may be generated based on the following Equations:

$$M=\mathrm{Ref}(n)+g_{D1}T\arg 1(n+N_1)+g_{D2}\,T\arg 2(n+N_2)+g_{D3}\,T\arg 3(n+N_3), \qquad \text{Equation 8a}$$

$$M=\mathrm{Ref}(n)+T\arg 1(n+N_1)+T\arg 2(n+N_2)+T\arg 3(n+N_3), \quad \text{Equation 8b}$$

where M corresponds to a mid channel frame (e.g., the first encoded signal frame 1454), Ref(n) corresponds to samples of a reference signal (e.g., the first audio signal 130), $g_{D1}$ corresponds to the gain parameter 160, $g_{D2}$ corresponds to the second gain parameter 1460, $g_{D3}$ corresponds to the third gain parameter 1461, $N_1$ corresponds to the non-causal shift value 162, $N_2$ corresponds to the second non-causal shift value 1462, $N_3$ corresponds to the third non-causal shift value 1464, T arg $1(n+N_1)$ corresponds to samples of a first target signal (e.g., the second audio signal 132), T arg $2(n+N_2)$ corresponds to samples of a second target signal (e.g., the third audio signal 1430), and T arg $3(n+N_3)$ corresponds to samples of a third target signal (e.g., the fourth audio signal 1432).

The temporal equalizer(s) 208 may generate an encoded signal (e.g., a side channel signal frame) corresponding to each of the target signals. For example, the temporal equalizer(s) 208 may generate a second encoded signal frame 566 based on the first audio signal 130 and the second audio signal 132. For example, the second encoded signal frame 566 may correspond to a difference of samples of the first audio signal 130 and samples of the second audio signal 132, as described with reference to FIG. 5. Similarly, the temporal equalizer(s) 208 may generate a third encoded signal frame 1466 (e.g., a side channel frame) based on the first audio signal 130 and the third audio signal 1430. For example, the third encoded signal frame 1466 may correspond to a difference of samples of the first audio signal 130 and samples of the third audio signal 1430. The temporal equalizer(s) 208 may generate a fourth encoded signal frame 1468 (e.g., a side channel frame) based on the first audio signal 130 and the fourth audio signal 1432. For example, the fourth encoded signal frame 1468 may correspond to a difference of samples of the first audio signal 130 and samples of the fourth audio signal 1432. The second encoded signal frame 566, the third encoded signal frame 1466, and the fourth encoded signal frame 1468 may be generated based on one of the following Equations:

$$S_P=\mathrm{Ref}(n)-g_{DP}\,T\arg P(n+N_P), \quad \text{Equation 9a}$$

$$S_P=g_{DP}\mathrm{Ref}(n)-T\arg P(n+N_P), \quad \text{Equation 9b}$$

where $S_P$ corresponds to a side channel frame, Ref(n) corresponds to samples of a reference signal (e.g., the first audio signal 130), $g_{DP}$ corresponds to a gain parameter corresponding to an associated target signal, $N_P$ corresponds to a non-causal shift value corresponding to the associated target signal, and T arg $P(n+N_P)$ corresponds to samples of the associated target signal. For example, $S_P$ may correspond to the second encoded signal frame 566, $g_{DP}$ may correspond to the gain parameter 160, $N_P$ may corresponds to the non-causal shift value 162, and T arg $P(n+N_P)$ may correspond to samples of the second audio signal 132. As another example, $S_P$ may correspond to the third encoded signal frame 1466, $g_{DP}$ may correspond to the second gain parameter 1460, $N_P$ may corresponds to the second non-causal shift value 1462, and T arg $P(n+N_P)$ may correspond to samples of the third audio signal 1430. As a further example, $S_P$ may correspond to the fourth encoded signal frame 1468, $g_{DP}$ may correspond to the third gain parameter 1461, $N_P$ may corresponds to the third non-causal shift value 1464, and T arg $P(n+N_P)$ may correspond to samples of the fourth audio signal 1432.

The temporal equalizer(s) 208 may store the second final shift value 1416, the third final shift value 1418, the second non-causal shift value 1462, the third non-causal shift value 1464, the second gain parameter 1460, the third gain parameter 1461, the first encoded signal frame 1454, the second encoded signal frame 566, the third encoded signal frame 1466, the fourth encoded signal frame 1468, or a combination thereof, in the memory 153. For example, the analysis data 190 may include the second final shift value 1416, the third final shift value 1418, the second non-causal shift value 1462, the third non-causal shift value 1464, the second gain parameter 1460, the third gain parameter 1461, the first encoded signal frame 1454, the third encoded signal frame 1466, the fourth encoded signal frame 1468, or a combination thereof.

The transmitter 110 may transmit the first encoded signal frame 1454, the second encoded signal frame 566, the third encoded signal frame 1466, the fourth encoded signal frame 1468, the gain parameter 160, the second gain parameter 1460, the third gain parameter 1461, the reference signal indicator 164, the non-causal shift value 162, the second non-causal shift value 1462, the third non-causal shift value 1464, or a combination thereof. The reference signal indicator 164 may correspond to the reference signal indicators 264 of FIG. 2. The first encoded signal frame 1454, the second encoded signal frame 566, the third encoded signal frame 1466, the fourth encoded signal frame 1468, or a combination thereof, may correspond to the encoded signals 202 of FIG. 2. The final shift value 116, the second final shift value 1416, the third final shift value 1418, or a combination thereof, may correspond to the final shift values 216 of FIG. 2. The non-causal shift value 162, the second non-causal shift value 1462, the third non-causal shift value 1464, or a combination thereof, may correspond to the non-causal shift values 262 of FIG. 2. The gain parameter 160, the second gain parameter 1460, the third gain parameter 1461, or a combination thereof, may correspond to the gain parameters 260 of FIG. 2.

Figure 15:
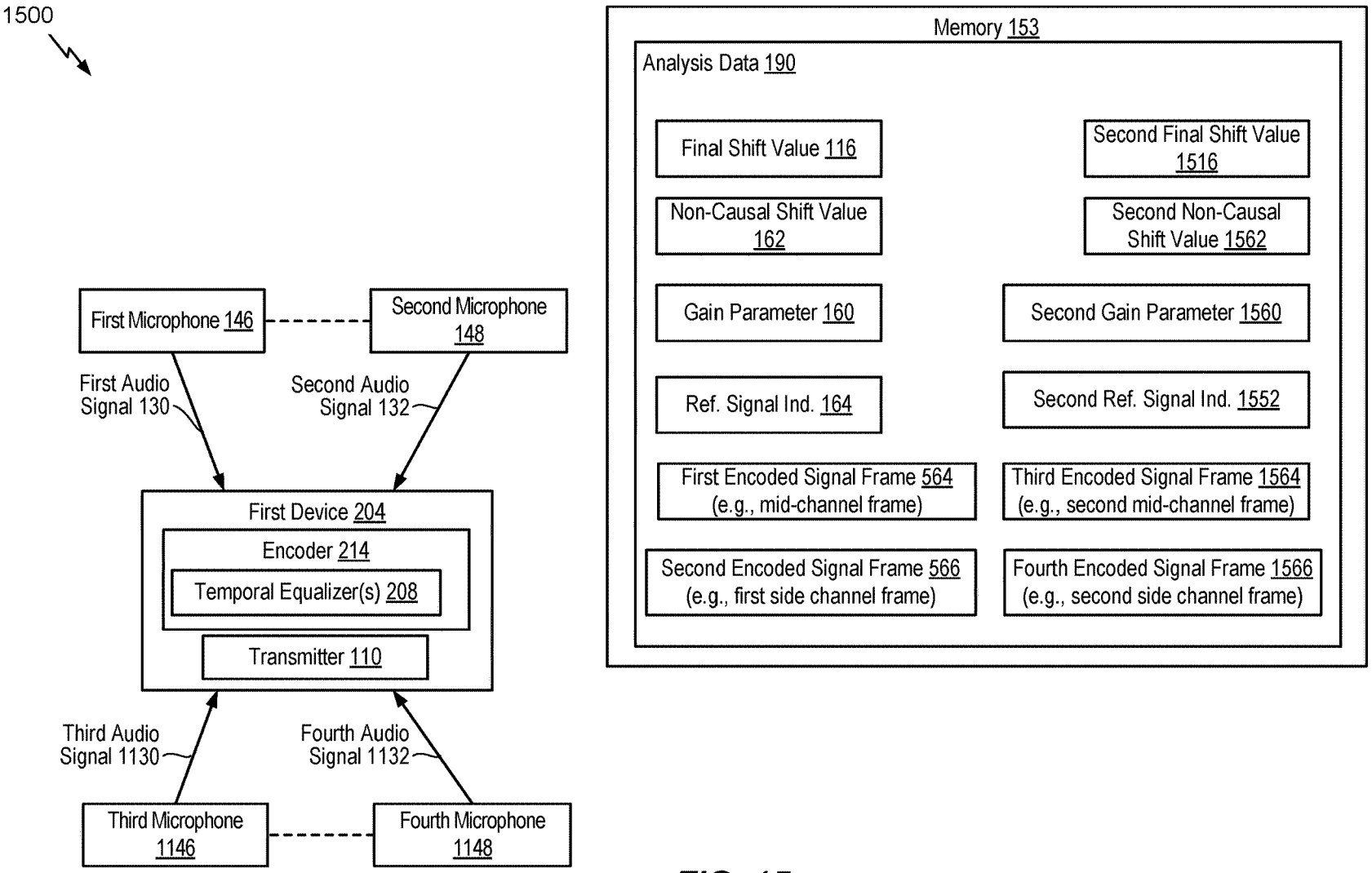
FIG. 15 is a diagram illustrating another example of a system that includes the device of FIG. 1.

Referring to FIG. 15, an illustrative example of a system is shown and generally designated 1500. The system 1500 differs from the system 1400 of FIG. 14 in that the temporal equalizer(s) 208 may be configured to determine multiple reference signals, as described herein.

During operation, the temporal equalizer(s) 208 may receive the first audio signal 130 via the first microphone 146, the second audio signal 132 via the second microphone 148, the third audio signal 1430 via the third microphone 1446, the fourth audio signal 1432 via the fourth microphone 1448, or a combination thereof. The temporal equalizer(s) 208 may determine the final shift value 116, the non-causal shift value 162, the gain parameter 160, the reference signal indicator 164, the first encoded signal frame 564, the second encoded signal frame 566, or a combination thereof, based on the first audio signal 130 and the second audio signal 132, as described with reference to FIGS. 1 and 5. Similarly, the temporal equalizer(s) 208 may determine a second final shift value 1516, a second non-causal shift value 1562, a second gain parameter 1560, a second reference signal indicator 1552, a third encoded signal frame 1564 (e.g., a mid channel signal frame), a fourth encoded signal frame 1566 (e.g., a side channel signal frame), or a combination thereof, based on the third audio signal 1430 and the fourth audio signal 1432.

The transmitter 110 may transmit the first encoded signal frame 564, the second encoded signal frame 566, the third encoded signal frame 1564, the fourth encoded signal frame 1566, the gain parameter 160, the second gain parameter 1560, the non-causal shift value 162, the second non-causal shift value 1562, the reference signal indicator 164, the second reference signal indicator 1552, or a combination thereof. The first encoded signal frame 564, the second encoded signal frame 566, the third encoded signal frame 1564, the fourth encoded signal frame 1566, or a combination thereof, may correspond to the encoded signals 202 of FIG. 2. The gain parameter 160, the second gain parameter 1560, or both, may correspond to the gain parameters 260 of FIG. 2. The final shift value 116, the second final shift value 1516, or both, may correspond to the final shift values 216 of FIG. 2. The non-causal shift value 162, the second non-causal shift value 1562, or both, may correspond to the non-causal shift values 262 of FIG. 2. The reference signal indicator 164, the second reference signal indicator 1552, or both, may correspond to the reference signal indicators 264 of FIG. 2.

Figure 16:
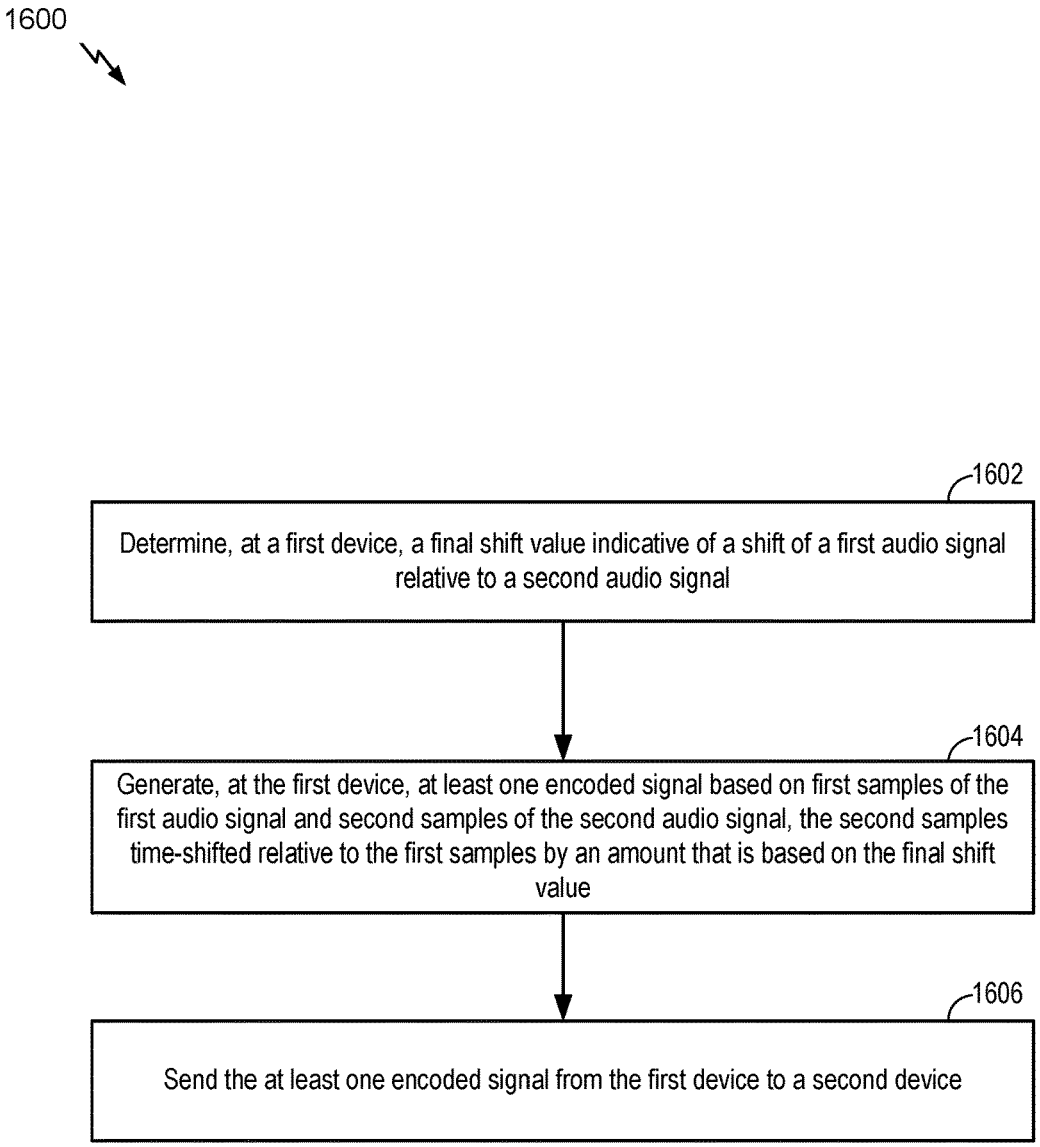
FIG. 16 is a flow chart illustrating a particular method of encoding multiple audio signals.

Referring to FIG. 16, a flow chart illustrating a particular method of operation is shown and generally designated 1600. The method 1600 may be performed by the temporal equalizer 108, the encoder 114, the first device 104 of FIG. 1, or a combination thereof.

The method 1600 includes determining, at a first device, a final shift value indicative of a shift of a first audio signal relative to a second audio signal, at 1602. For example, the temporal equalizer 108 of the first device 104 of FIG. 1 may determine the final shift value 116 indicative of a shift of the first audio signal 130 relative to the second audio signal 132, as described with respect to FIG. 1. As another example, the temporal equalizer 108 may determine the final shift value 116 indicative of a shift of the first audio signal 130 relative to the second audio signal 132, the second final shift value 1416 indicative of a shift of the first audio signal 130 relative to the third audio signal 1430, the third final shift value 1418 indicative of a shift of the first audio signal 130 relative to the fourth audio signal 1432, or a combination thereof, as described with respect to FIG. 14. As a further example, the temporal equalizer 108 may determine the final shift value 116 indicative of a shift of the first audio signal 130 relative to the second audio signal 132, the second final shift value 1516 indicative of a shift of the third audio signal 1430 relative to the fourth audio signal 1432, or both, as described with reference to FIG. 15.

The method 1600 also includes generating, at the first device, at least one encoded signal based on first samples of the first audio signal and second samples of the second audio signal, at 1604. For example, the temporal equalizer 108 of the first device 104 of FIG. 1 may generate the encoded signals 102 based on the samples 326-332 of FIG. 3 and the samples 358-364 of FIG. 3, as further described with reference to FIG. 5. The samples 358-364 may be time-shifted relative to the samples 326-332 by an amount that is based on the final shift value 116.

As another example, the temporal equalizer 108 may generate the first encoded signal frame 1454 based on the samples 326-332, the samples 358-364 of FIG. 3, third samples of the third audio signal 1430, fourth samples of the fourth audio signal 1432, or a combination thereof, as described with reference to FIG. 14. The samples 358-364, the third samples, and the fourth samples may be time-shifted relative to the samples 326-332 by an amount that is based on the final shift value 116, the second final shift value 1416, and the third final shift value 1418, respectively.

The temporal equalizer 108 may generate the second encoded signal frame 566 based on the samples 326-332 and the samples 358-364 of FIG. 3, as described with reference to FIGS. 5 and 14. The temporal equalizer 108 may generate the third encoded signal frame 1466 based on the samples 326-332 and the third samples. The temporal equalizer 108 may generate the fourth encoded signal frame 1468 based on the samples 326-332 and the fourth samples.

As a further example, the temporal equalizer 108 may generate the first encoded signal frame 564 and the second encoded signal frame 566 based on the samples 326-332 and the samples 358-364, as described with reference to FIGS. 5 and 15. The temporal equalizer 108 may generate the third encoded signal frame 1564 and the fourth encoded signal frame 1566 based on third samples of the third audio signal 1430 and fourth samples of the fourth audio signal 1432, as described with reference to FIG. 15. The fourth samples may be time-shifted relative to the third samples based on the second final shift value 1516, as described with reference to FIG. 15.

The method 1600 further includes sending the at least one encoded signal from the first device to a second device, at 1606. For example, the transmitter 110 of FIG. 1 may send at least the encoded signals 102 from the first device 104 to the second device 106, as further described with reference to FIG. 1. As another example, the transmitter 110 may send at least the first encoded signal frame 1454, the second encoded signal frame 566, the third encoded signal frame 1466, the fourth encoded signal frame 1468, or a combination thereof, as described with reference to FIG. 14. As a further example, the transmitter 110 may send at least the first encoded signal frame 564, the second encoded signal frame 566, the third encoded signal frame 1564, the fourth encoded signal frame 1566, or a combination thereof, as described with reference to FIG. 15.

The method 1600 may thus enable generating encoded signals based on first samples of a first audio signal and second samples of a second audio signal that are time-shifted relative to the first audio signal based on a shift value that is indicative of a shift of the first audio signal relative to the second audio signal. Time-shifting the samples of the second audio signal may reduce a difference between the first audio signal and the second audio signal which may improve joint-channel coding efficiency. One of the first audio signal 130 or the second audio signal 132 may be designated as a reference signal based on a sign (e.g., negative or positive) of the final shift value 116. The other (e.g., a target signal) of the first audio signal 130 or the second audio signal 132 may be time-shifted or offset based on the non-causal shift value 162 (e.g., an absolute value of the final shift value 116).

Figure 17:
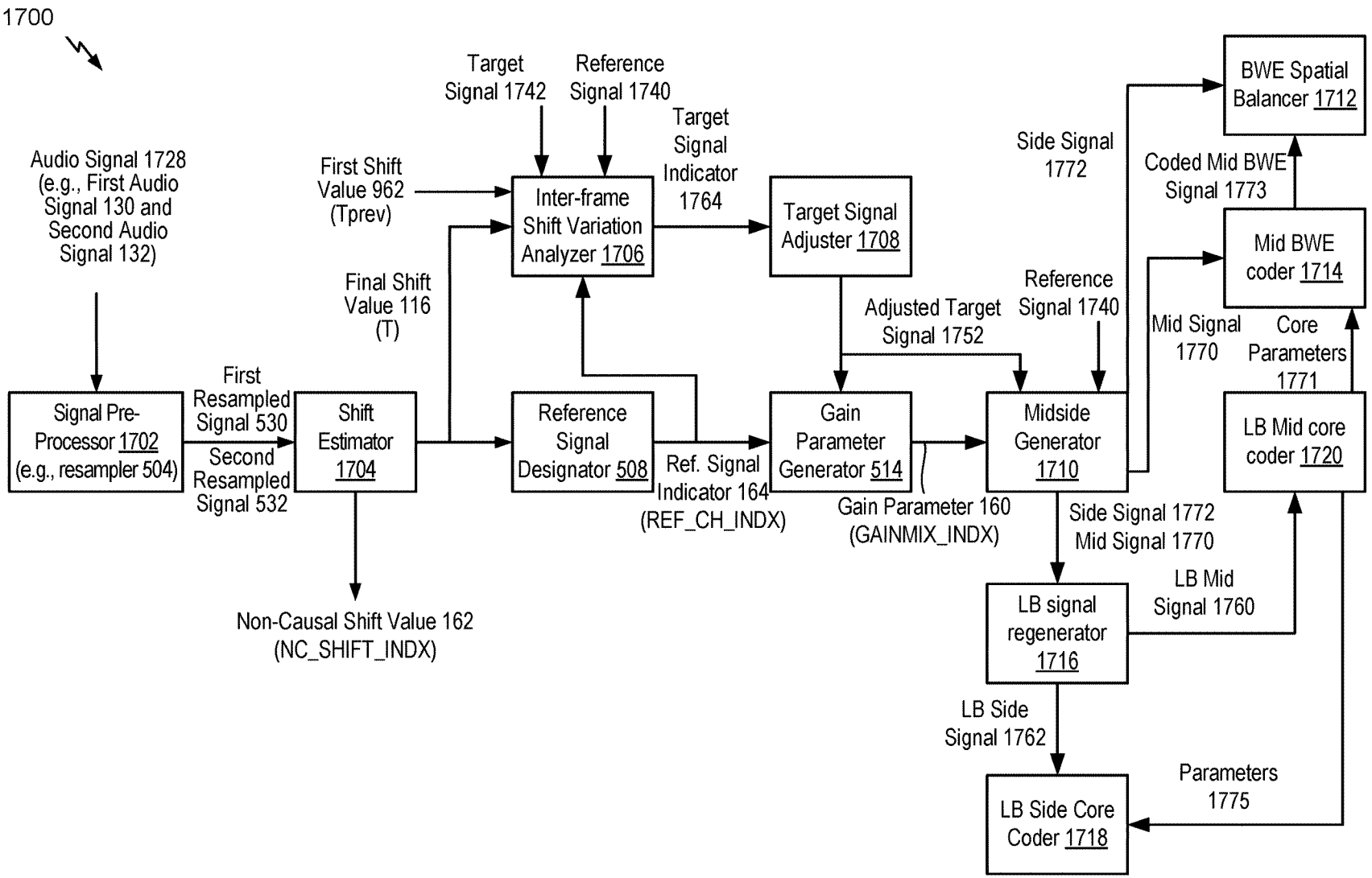
FIG. 17 is a diagram illustrating another example of a system operable to encode multiple audio signals.

Referring to FIG. 17, an illustrative example of a system is shown and generally designated 1700. The system 1700 may correspond to the system 100 of FIG. 1. For example, the system 100, the first device 104 of FIG. 1, or both, may include one or more components of the system 1700.

The system 1700 includes a signal pre-processor 1702 coupled, via a shift estimator 1704, to an inter-frame shift variation analyzer 1706, to the reference signal designator 508, or both. In a particular aspect, the signal pre-processor 1702 may correspond to the resampler 504. In a particular aspect, the shift estimator 1704 may correspond to the temporal equalizer 108 of FIG. 1. For example, the shift estimator 1704 may include one or more components of the temporal equalizer 108.

The inter-frame shift variation analyzer 1706 may be coupled, via a target signal adjuster 1708, to the gain parameter generator 514. The reference signal designator 508 may be coupled to the inter-frame shift variation analyzer 1706, to the gain parameter generator 514, or both. The target signal adjuster 1708 may be coupled to a midside generator 1710. In a particular aspect, the midside generator 1710 may correspond to the signal generator 516 of FIG. 5.

The gain parameter generator 514 may be coupled to the midside generator 1710. The midside generator 1710 may be coupled to a bandwidth extension (BWE) spatial balancer 1712, a mid BWE coder 1714, a low band (LB) signal regenerator 1716, or a combination thereof. The LB signal regenerator 1716 may be coupled to a LB side core coder 1718, a LB mid core coder 1720, or both. The LB mid core coder 1720 may be coupled to the mid BWE coder 1714, the LB side core coder 1718, or both. The mid BWE coder 1714 may be coupled to the BWE spatial balancer 1712.

During operation, the signal pre-processor 1702 may receive an audio signal 1728. For example, the signal pre-processor 1702 may receive the audio signal 1728 from the input interface(s) 112. The audio signal 1728 may include the first audio signal 130, the second audio signal 132, or both. The signal pre-processor 1702 may generate the first resampled signal 530, the second resampled signal 532, or both, as further described with reference to FIG. 18. The signal pre-processor 1702 may provide the first resampled signal 530, the second resampled signal 532, or both, to the shift estimator 1704.

The shift estimator 1704 may generate the final shift value 116 (T), the non-causal shift value 162, or both, based on the first resampled signal 530, the second resampled signal 532, or both, as further described with reference to FIG. 19. The shift estimator 1704 may provide the final shift value 116 to the inter-frame shift variation analyzer 1706, the reference signal designator 508, or both.

The reference signal designator 508 may generate the reference signal indicator 164, as described with reference to FIGS. 5, 12, and 13. The reference signal indicator 164 may, in response to determining that the reference signal indicator 164 indicates that the first audio signal 130 corresponds to a reference signal, determine that a reference signal 1740 includes the first audio signal 130 and that a target signal 1742 includes the second audio signal 132. Alternatively, the reference signal indicator 164 may, in response to determining that the reference signal indicator 164 indicates that the second audio signal 132 corresponds to a reference signal, determine that the reference signal 1740 includes the second audio signal 132 and that the target signal 1742 includes the first audio signal 130. The reference signal designator 508 may provide the reference signal indicator 164 to the inter-frame shift variation analyzer 1706, to the gain parameter generator 514, or both.

The inter-frame shift variation analyzer 1706 may generate a target signal indicator 1764 based on the target signal 1742, the reference signal 1740, the first shift value 962 (Tprev), the final shift value 116 (T), the reference signal indicator 164, or a combination thereof, as further described with reference to FIG. 21. The inter-frame shift variation analyzer 1706 may provide the target signal indicator 1764 to the target signal adjuster 1708.

The target signal adjuster 1708 may generate an adjusted target signal 1752 (e.g., the modified target channel 194) based on the target signal indicator 1764, the target signal 1742, or both. The target signal adjuster 1708 may adjust the target signal 1742 based on a temporal shift evolution from the first shift value 962 (Tprev) to the final shift value 116 (T). For example, the first shift value 962 may include a final shift value corresponding to the frame 302. The target signal adjuster 1708 may, in response to determining that a final shift value changed from the first shift value 962 having a first value (e.g., Tprev=2) corresponding to the frame 302 that is lower than the final shift value 116 (e.g., T=4) corresponding to the frame 304, interpolate the target signal 1742 such that a subset of samples of the target signal 1742 that correspond to frame boundaries are dropped through smoothing and slow-shifting to generate the adjusted target signal 1752. Alternatively, the target signal adjuster 1708 may, in response to determining that a final shift value changed from the first shift value 962 (e.g., Tprev=4) that is greater than the final shift value 116 (e.g., T=2), interpolate the target signal 1742 such that a subset of samples of the target signal 1742 that correspond to frame boundaries are repeated through smoothing and slow-shifting to generate the adjusted target signal 1752. The smoothing and slow-shifting may be performed based on hybrid Sinc- and Lagrange-interpolators. The target signal adjuster 1708 may, in response to determining that a final shift value is unchanged from the first shift value 962 to the final shift value 116 (e.g., Tprev=T), temporally offset the target signal 1742 to generate the adjusted target signal 1752. The target signal adjuster 1708 may provide the adjusted target signal 1752 to the gain parameter generator 514, the midside generator 1710, or both.

The gain parameter generator 514 may generate the gain parameter 160 based on the reference signal indicator 164, the adjusted target signal 1752, the reference signal 1740, or a combination thereof, as further described with reference to FIG. 20. The gain parameter generator 514 may provide the gain parameter 160 to the midside generator 1710.

The midside generator 1710 may generate a mid signal 1770, a side signal 1772, or both, based on the adjusted target signal 1752, the reference signal 1740, the gain parameter 160, or a combination thereof. For example, the midside generator 1710 may generate the mid signal 1770 based on Equation 2a or Equation 2b, where M corresponds to the mid signal 1770, $g_D$ corresponds to the gain parameter 160, Ref(n) corresponds to samples of the reference signal 1740, and T arg(n+$N_1$) corresponds to samples of the adjusted target signal 1752. The midside generator 1710 may generate the side signal 1772 based on Equation 3a or Equation 3b, where S corresponds to the side signal 1772, $g_D$ corresponds to the gain parameter 160, Ref(n) corresponds to samples of the reference signal 1740, and T arg(n+$N_1$) corresponds to samples of the adjusted target signal 1752.

The midside generator 1710 may provide the side signal 1772 to the BWE spatial balancer 1712, the LB signal regenerator 1716, or both. The midside generator 1710 may provide the mid signal 1770 to the mid BWE coder 1714, the LB signal regenerator 1716, or both. The LB signal regenerator 1716 may generate a LB mid signal 1760 based on the mid signal 1770. For example, the LB signal regenerator 1716 may generate the LB mid signal 1760 by filtering the mid signal 1770. The LB signal regenerator 1716 may provide the LB mid signal 1760 to the LB mid core coder 1720. The LB mid core coder 1720 may generate parameters (e.g., core parameters 1771, parameters 1775, or both) based on the LB mid signal 1760. The core parameters 1771, the parameters 1775, or both, may include an excitation parameter, a voicing parameter, etc. The LB mid core coder 1720 may provide the core parameters 1771 to the mid BWE coder 1714, the parameters 1775 to the LB side core coder 1718, or both. The core parameters 1771 may be the same as or distinct from the parameters 1775. For example, the core parameters 1771 may include one or more of the parameters 1775, may exclude one or more of the parameters 1775, may include one or more additional parameters, or a combination thereof. The mid BWE coder 1714 may generate a coded mid BWE signal 1773 based on the mid signal 1770, the core parameters 1771, or a combination thereof. The mid BWE coder 1714 may provide the coded mid BWE signal 1773 to the BWE spatial balancer 1712.

The LB signal regenerator 1716 may generate a LB side signal 1762 based on the side signal 1772. For example, the LB signal regenerator 1716 may generate the LB side signal 1762 by filtering the side signal 1772. The LB signal regenerator 1716 may provide the LB side signal 1762 to the LB side core coder 1718.

Figure 18:
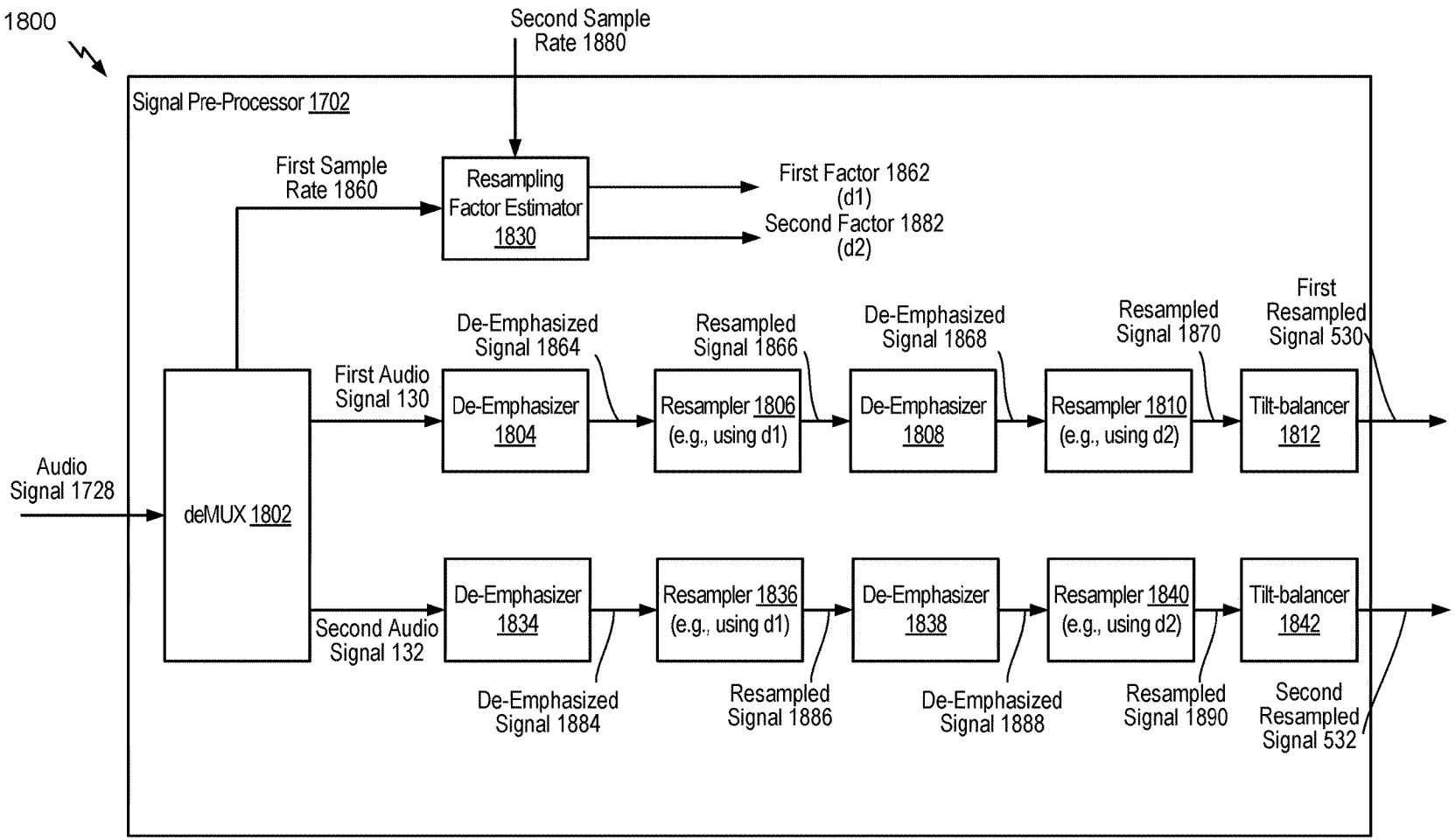
FIG. 18 is a diagram illustrating another example of a system operable to encode multiple audio signals.

Referring to FIG. 18, an illustrative example of a system is shown and generally designated 1800. The system 1800 may correspond to the system 100 of FIG. 1. For example, the system 100, the first device 104 of FIG. 1, or both, may include one or more components of the system 1800.

The system 1800 includes the signal pre-processor 1702. The signal pre-processor 1702 may include a demultiplexer (DeMUX) 1802 coupled to a resampling factor estimator 1830, a de-emphasizer 1804, a de-emphasizer 1834, or a combination thereof. The de-emphasizer 1804 may be coupled to, via a resampler 1806, to a de-emphasizer 1808. The de-emphasizer 1808 may be coupled, via a resampler 1810, to a tilt-balancer 1812. The de-emphasizer 1834 may be coupled, via a resampler 1836, to a de-emphasizer 1838. The de-emphasizer 1838 may be coupled, via a resampler 1840, to a tilt-balancer 1842.

During operation, the deMUX 1802 may generate the first audio signal 130 and the second audio signal 132 by demultiplexing the audio signal 1728. The deMUX 1802 may provide a first sample rate 1860 associated with the first audio signal 130, the second audio signal 132, or both, to the resampling factor estimator 1830. The deMUX 1802 may provide the first audio signal 130 to the de-emphasizer 1804, the second audio signal 132 to the de-emphasizer 1834, or both.

The resampling factor estimator 1830 may generate a first factor 1862 (d1), a second factor 1882 (d2), or both, based on the first sample rate 1860, a second sample rate 1880, or both. The resampling factor estimator 1830 may determine a resampling factor (D) based on the first sample rate 1860, the second sample rate 1880, or both. For example, the resampling factor (D) may correspond to a ratio of the first sample rate 1860 and the second sample rate 1880 (e.g., the resampling factor (D)=the second sample rate 1880/the first sample rate 1860 or the resampling factor (D)=the first sample rate 1860/the second sample rate 1880). The first factor 1862 (d1), the second factor 1882 (d2), or both, may be factors of the resampling factor (D). For example, the resampling factor (D) may correspond to a product of the first factor 1862 (d1) and the second factor 1882 (d2) (e.g., the resampling factor (D)=the first factor 1862 (d1)*the second factor 1882 (d2)). In some implementations, the first factor 1862 (d1) may have a first value (e.g., 1), the second factor 1882 (d2) may have a second value (e.g., 1), or both, which bypasses the resampling stages, as described herein.

The de-emphasizer 1804 may generate a de-emphasized signal 1864 by filtering the first audio signal 130 based on an IIR filter (e.g., a first order IIR filter), as described with reference to FIG. 6. The de-emphasizer 1804 may provide the de-emphasized signal 1864 to the resampler 1806. The resampler 1806 may generate a resampled signal 1866 by resampling the de-emphasized signal 1864 based on the first factor 1862 (d1). The resampler 1806 may provide the resampled signal 1866 to the de-emphasizer 1808. The de-emphasizer 1808 may generate a de-emphasized signal 1868 by filtering the resampled signal 1866 based on an IIR filter, as described with reference to FIG. 6. The de-emphasizer 1808 may provide the de-emphasized signal 1868 to the resampler 1810. The resampler 1810 may generate a resampled signal 1870 by resampling the de-emphasized signal 1868 based on the second factor 1882 (d2).

In some implementations, the first factor 1862 (d1) may have a first value (e.g., 1), the second factor 1882 (d2) may have a second value (e.g., 1), or both, which bypasses the resampling stages. For example, when the first factor 1862 (d1) has the first value (e.g., 1), the resampled signal 1866 may be the same as the de-emphasized signal 1864. As another example, when the second factor 1882 (d2) has the second value (e.g., 1), the resampled signal 1870 may be the same as the de-emphasized signal 1868. The resampler 1810 may provide the resampled signal 1870 to the tilt-balancer 1812. The tilt-balancer 1812 may generate the first resampled signal 530 by performing tilt balancing on the resampled signal 1870.

The de-emphasizer 1834 may generate a de-emphasized signal 1884 by filtering the second audio signal 132 based on an IIR filter (e.g., a first order IIR filter), as described with reference to FIG. 6. The de-emphasizer 1834 may provide the de-emphasized signal 1884 to the resampler 1836. The resampler 1836 may generate a resampled signal 1886 by resampling the de-emphasized signal 1884 based on the first factor 1862 (d1). The resampler 1836 may provide the resampled signal 1886 to the de-emphasizer 1838. The de-emphasizer 1838 may generate a de-emphasized signal 1888 by filtering the resampled signal 1886 based on an IIR filter, as described with reference to FIG. 6. The de-emphasizer 1838 may provide the de-emphasized signal 1888 to the resampler 1840. The resampler 1840 may generate a resampled signal 1890 by resampling the de-emphasized signal 1888 based on the second factor 1882 (d2).

In some implementations, the first factor 1862 (d1) may have a first value (e.g., 1), the second factor 1882 (d2) may have a second value (e.g., 1), or both, which bypasses the resampling stages. For example, when the first factor 1862 (d1) has the first value (e.g., 1), the resampled signal 1886 may be the same as the de-emphasized signal 1884. As another example, when the second factor 1882 (d2) has the second value (e.g., 1), the resampled signal 1890 may be the same as the de-emphasized signal 1888. The resampler 1840 may provide the resampled signal 1890 to the tilt-balancer 1842. The tilt-balancer 1842 may generate the second resampled signal 532 by performing tilt balancing on the resampled signal 1890. In some implementations, the tilt-balancer 1812 and the tilt-balancer 1842 may compensate for a low pass (LP) effect due to the de-emphasizer 1804 and the de-emphasizer 1834, respectively.

Figure 19:
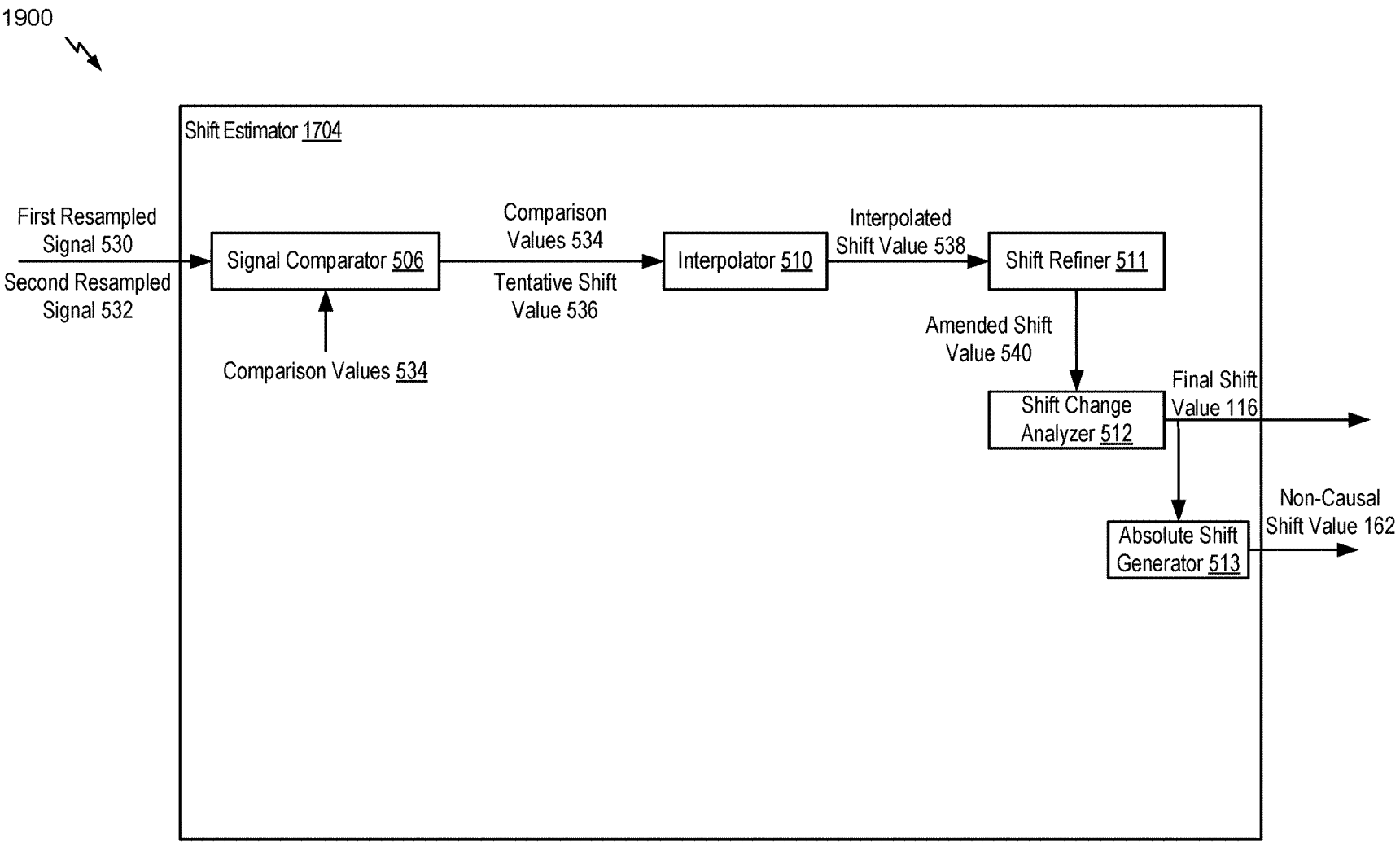
FIG. 19 is a diagram illustrating another example of a system operable to encode multiple audio signals.

Referring to FIG. 19, an illustrative example of a system is shown and generally designated 1900. The system 1900 may correspond to the system 100 of FIG. 1. For example, the system 100, the first device 104 of FIG. 1, or both, may include one or more components of the system 1900.

The system 1900 includes the shift estimator 1704. The shift estimator 1704 may include the signal comparator 506, the interpolator 510, the shift refiner 511, the shift change analyzer 512, the absolute shift generator 513, or a combination thereof. It should be understood that the system 1900 may include fewer than or more than the components illustrated in FIG. 19. The system 1900 may be configured to perform one or more operations described herein. For example, the system 1900 may be configured to perform one or more operations described with reference to the temporal equalizer 108 of FIG. 5, the shift estimator 1704 of FIG. 17, or both. It should be understood that the non-causal shift value 162 may be estimated based on one or more low-pass filtered signals, one or more high-pass filtered signals, or a combination thereof, that are generated based on the first audio signal 130, the first resampled signal 530, the second audio signal 132, the second resampled signal 532, or a combination thereof.

Figure 20:
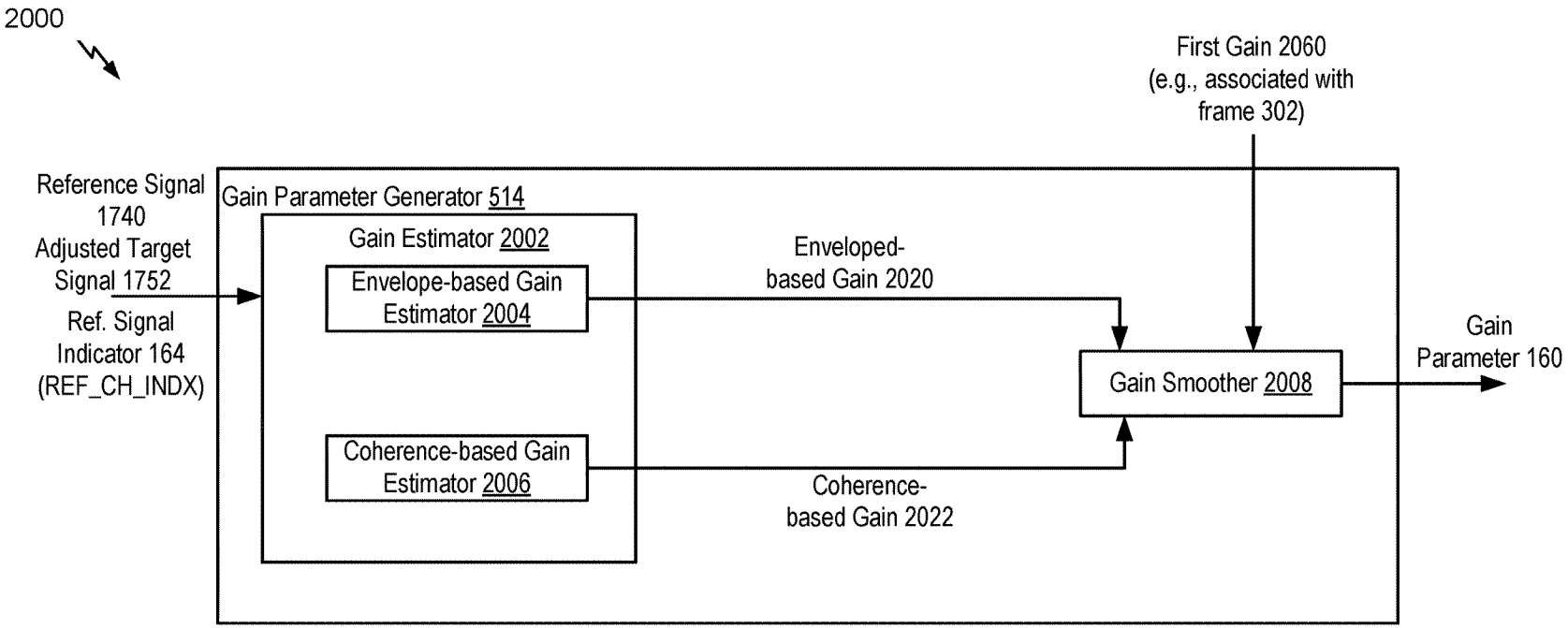
FIG. 20 is a diagram illustrating another example of a system operable to encode multiple audio signals.

Referring to FIG. 20, an illustrative example of a system is shown and generally designated 2000. The system 2000 may correspond to the system 100 of FIG. 1. For example, the system 100, the first device 104 of FIG. 1, or both, may include one or more components of the system 2000.

The system 2000 includes the gain parameter generator 514. The gain parameter generator 514 may include a gain estimator 2002 coupled to a gain smoother 2008. The gain estimator 2002 may include an envelope-based gain estimator 2004, a coherence-based gain estimator 2006, or both. The gain estimator 2002 may generate a gain based on one or more of the Equations 1a-1f, as described with reference to FIG. 1.

During operation, the gain estimator 2002 may, in response to determining that the reference signal indicator 164 indicates that the first audio signal 130 corresponds to a reference signal, determine that the reference signal 1740 includes the first audio signal 130. Alternatively, the gain estimator 2002 may, in response to determining that the reference signal indicator 164 indicates that the second audio signal 132 corresponds to a reference signal, determine that the reference signal 1740 includes the second audio signal 132.

The envelope-based gain estimator 2004 may generate an envelope-based gain 2020 based on the reference signal 1740, the adjusted target signal 1752, or both. For example, the envelope-based gain estimator 2004 may determine the envelope-based gain 2020 based on a first envelope of the reference signal 1740 and a second envelope of the adjusted target signal 1752. The envelope-based gain estimator 2004 may provide the envelope-based gain 2020 to the gain smoother 2008.

The coherence-based gain estimator 2006 may generate a coherence-based gain 2022 based on the reference signal 1740, the adjusted target signal 1752, or both. For example, the coherence-based gain estimator 2006 may determine an estimated coherence corresponding to the reference signal 1740, the adjusted target signal 1752, or both. The coherence-based gain estimator 2006 may determine the coherence-based gain 2022 based on the estimated coherence. The coherence-based gain estimator 2006 may provide the coherence-based gain 2022 to the gain smoother 2008.

The gain smoother 2008 may generate the gain parameter 160 based on the envelope-based gain 2020, the coherence-based gain 2022, a first gain 2060, or a combination thereof. For example, the gain parameter 160 may correspond to an average of the envelope-based gain 2020, the coherence-based gain 2022, the first gain 2060, or a combination thereof. The first gain 2060 may be associated with the frame 302.

Figure 21:
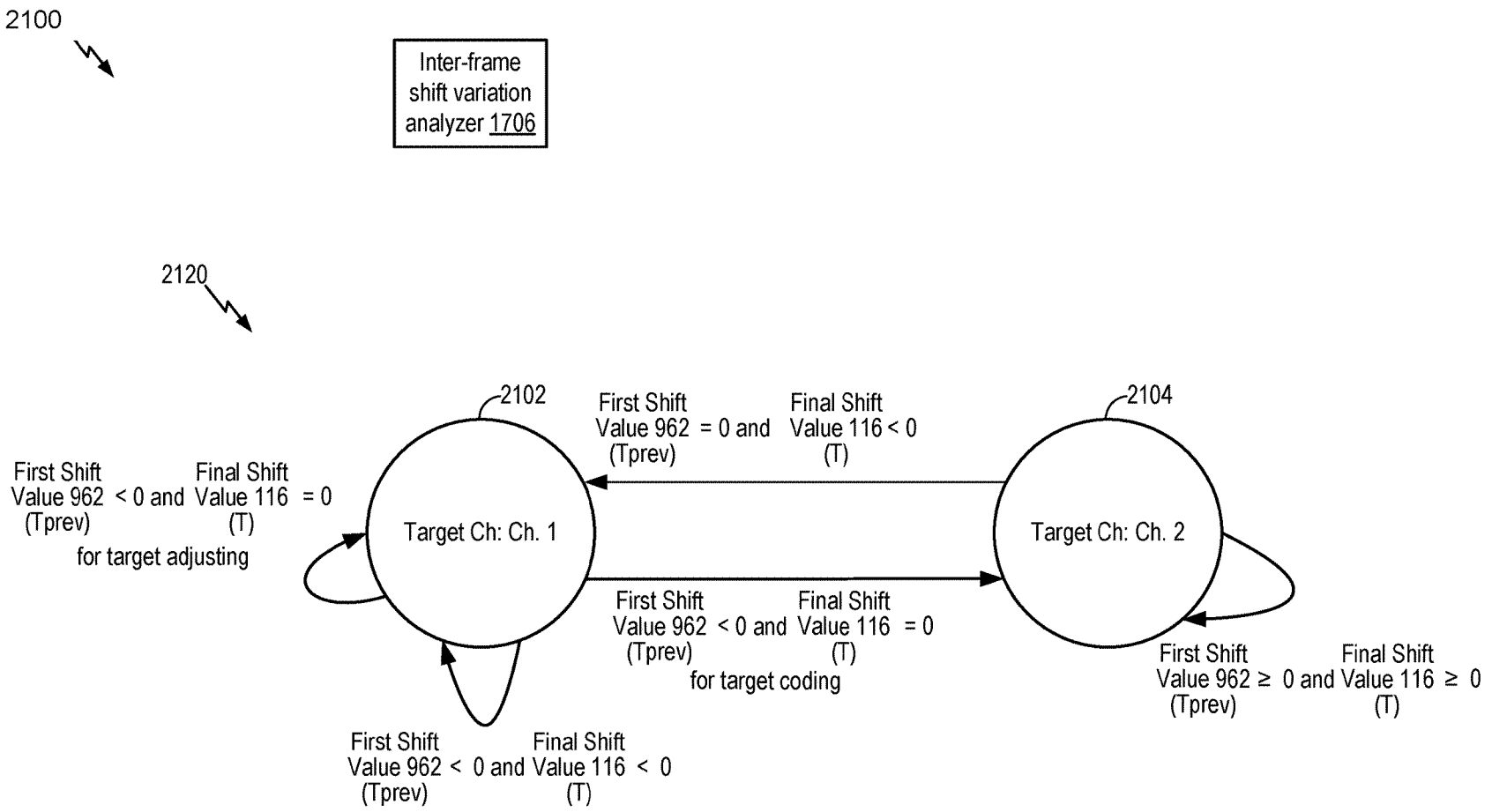
FIG. 21 is a diagram illustrating another example of a system operable to encode multiple audio signals.

Referring to FIG. 21, an illustrative example of a system is shown and generally designated 2100. The system 2100 may correspond to the system 100 of FIG. 1. For example, the system 100, the first device 104 of FIG. 1, or both, may include one or more components of the system 2100. FIG. 21 also includes a state diagram 2120. The state diagram 2120 may illustrate operation of the inter-frame shift variation analyzer 1706.

The state diagram 2120 includes setting the target signal indicator 1764 of FIG. 17 to indicate the second audio signal 132, at state 2102. The state diagram 2120 includes setting the target signal indicator 1764 to indicate the first audio signal 130, at state 2104. The inter-frame shift variation analyzer 1706 may, in response to determining that the first shift value 962 has a first value (e.g., zero) and that the final shift value 116 has a second value (e.g., a negative value), transition from the state 2104 to the state 2102. For example, the inter-frame shift variation analyzer 1706 may, in response to determining that the first shift value 962 has a first value (e.g., zero) and that the final shift value 116 has a second value (e.g., a negative value), change the target signal indicator 1764 from indicating the first audio signal 130 to indicating the second audio signal 132. The inter-frame shift variation analyzer 1706 may, in response to determining that the first shift value 962 has a first value (e.g., a negative value) and that the final shift value 116 has a second value (e.g., zero), transition from the state 2102 to the state 2104. For example, the inter-frame shift variation analyzer 1706 may, in response to determining that the first shift value 962 has a first value (e.g., a negative value) and that the final shift value 116 has a second value (e.g., zero), change the target signal indicator 1764 from indicating the second audio signal 132 to indicating the first audio signal 130. The inter-frame shift variation analyzer 1706 may provide the target signal indicator 1764 to the target signal adjuster 1708. In some implementations, the inter-frame shift variation analyzer 1706 may provide a target signal (e.g., the first audio signal 130 or the second audio signal 132) indicated by the target signal indicator 1764 to the target signal adjuster 1708 for smoothing and slow-shifting. The target signal may correspond to the target signal 1742 of FIG. 17.

Figure 22:
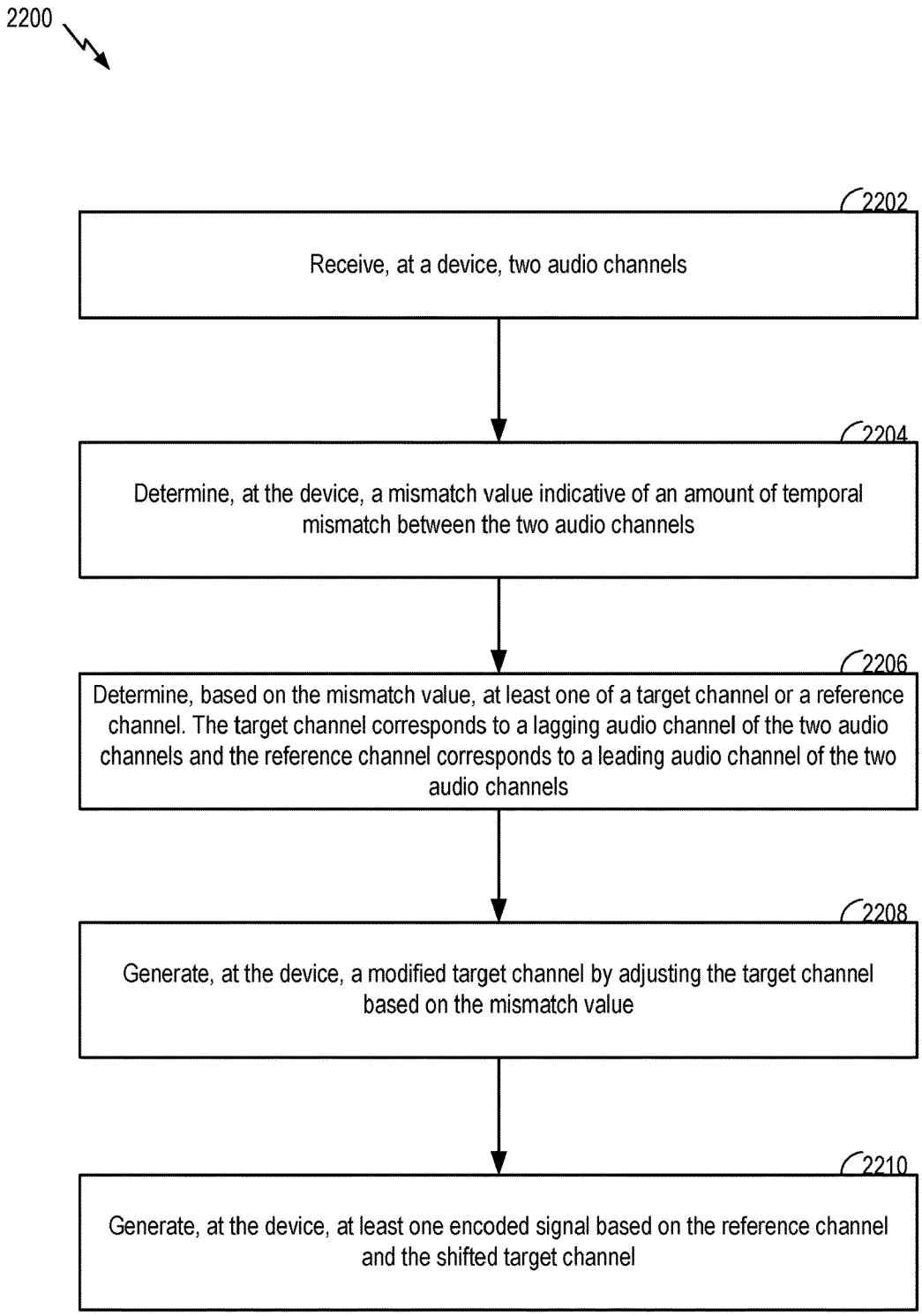
FIG. 22 is a flow chart illustrating a particular method of encoding multiple audio signals.

Referring to FIG. 22, a flow chart illustrating a particular method of operation is shown and generally designated 2200. The method 2200 may be performed by the temporal equalizer 108, the encoder 114, the first device 104 of FIG. 1, or a combination thereof.

The method 2200 includes receiving, at a device, two audio channels, at 2202. For example, a first input interface of the input interfaces 112 of FIG. 1 may receive the first audio signal 130 (e.g., a first audio channel) and a second input interface of the input interfaces 112 may receive the second audio signal 132 (e.g., a second audio channel).

The method 2200 also includes determining, at the device, a mismatch value indicative of an amount of temporal mismatch between the two audio channels, at 2204. For example, the temporal equalizer 108 of FIG. 1 may determine the final shift value 116 (e.g., a mismatch value) indicative of an amount of temporal mismatch between the first audio signal 130 and the second audio signal 132, as described with respect to FIG. 1. As another example, the temporal equalizer 108 may determine the final shift value 116 (e.g., a mismatch value) indicative of an amount of temporal mismatch between the first audio signal 130 and the second audio signal 132, the second final shift value 1416 (e.g., a mismatch value) indicative of an amount of temporal mismatch between the first audio signal 130 and the third audio signal 1430, the third final shift value 1418 (e.g., a mismatch value) indicative of an amount of temporal mismatch between the first audio signal 130 and the fourth audio signal 1432, or a combination thereof, as described with respect to FIG. 14. As a further example, the temporal equalizer 108 may determine the final shift value 116 (e.g., a mismatch value) indicative of an amount of temporal mismatch between the first audio signal 130 and the second audio signal 132, the second final shift value 1516 (e.g., a mismatch value) indicative of a temporal mismatch between the third audio signal 1430 and the fourth audio signal 1432, or both, as described with reference to FIG. 15.

The method 2200 further includes determining, based on the mismatch value, at least one of a target channel or a reference channel, at 2206. For example, the temporal equalizer 108 of FIG. 1 may determine, based on the final shift value 116, at least one of the target signal 1742 (e.g., a target channel) or the reference signal 1740 (e.g., a reference channel), as described with reference to FIG. 17. The target signal 1742 may correspond to a lagging audio channel of the two audio channels (e.g., the first audio signal 130 and the second audio signal 132). The reference signal 1740 may correspond to a leading audio channel of the two audio channels (e.g., the first audio signal 130 and the second audio signal 132).

The method 2200 also includes generating, at the device, a modified target channel by adjusting the target channel based on the mismatch value, at 2208. For example, the temporal equalizer 108 of FIG. 1 may generate the adjusted target signal 1752 (e.g., a modified target channel) by adjusting the target signal 1742 based on the final shift value 116, as described with reference to FIG. 17.

The method 2200 also includes generating, at the device, at least one encoded signal based on the reference channel and the modified target channel, at 2210. For example, the temporal equalizer 108 of FIG. 1 may generate the encoded signals 102 based on the reference signal 1740 (e.g., a reference channel) and the adjusted target signal 1752 (e.g., the modified target channel), as described with reference to FIG. 17.

As another example, the temporal equalizer 108 may generate the first encoded signal frame 1454 based on the samples 326-332 of the first audio signal 130 (e.g., the reference channel), the samples 358-364 of the second audio signal 132 (e.g., a modified target channel), third samples of the third audio signal 1430 (e.g., a modified target channel), fourth samples of the fourth audio signal 1432 (e.g., a modified target channel), or a combination thereof, as described with reference to FIG. 14. The samples 358-364, the third samples, and the fourth samples may be shifted relative to the samples 326-332 by an amount that is based on the final shift value 116, the second final shift value 1416, and the third final shift value 1418, respectively. The temporal equalizer 108 may generate the second encoded signal frame 566 based on the samples 326-332 (of the reference channel) and the samples 358-364 (of a modified target channel), as described with reference to FIGS. 5 and 14. The temporal equalizer 108 may generate the third encoded signal frame 1466 based on the samples 326-332 (of the reference channel) and the third samples (of a modified target channel). The temporal equalizer 108 may generate the fourth encoded signal frame 1468 based on the samples 326-332 (of the reference channel) and the fourth samples (of a modified target channel).

As a further example, the temporal equalizer 108 may generate the first encoded signal frame 564 and the second encoded signal frame 566 based on the samples 326-332 (of the reference channel) and the samples 358-364 (of a modified target channel), as described with reference to FIGS. 5 and 15. The temporal equalizer 108 may generate the third encoded signal frame 1564 and the fourth encoded signal frame 1566 based on third samples of the third audio signal 1430 (e.g., a reference channel) and fourth samples of the fourth audio signal 1432 (e.g., a modified target channel), as described with reference to FIG. 15. The fourth samples may be shifted relative to the third samples based on the second final shift value 1516, as described with reference to FIG. 15.

The method 2200 may thus enable generating encoded signals based on a reference channel and a modified target channel. The modified target channel may be generated by adjusting a target channel based on a mismatch value. A difference between the modified target channel and the reference channel may be lower than a difference between the target channel and the reference channel. The reduced difference may improve joint-channel coding efficiency.

Figure 23:
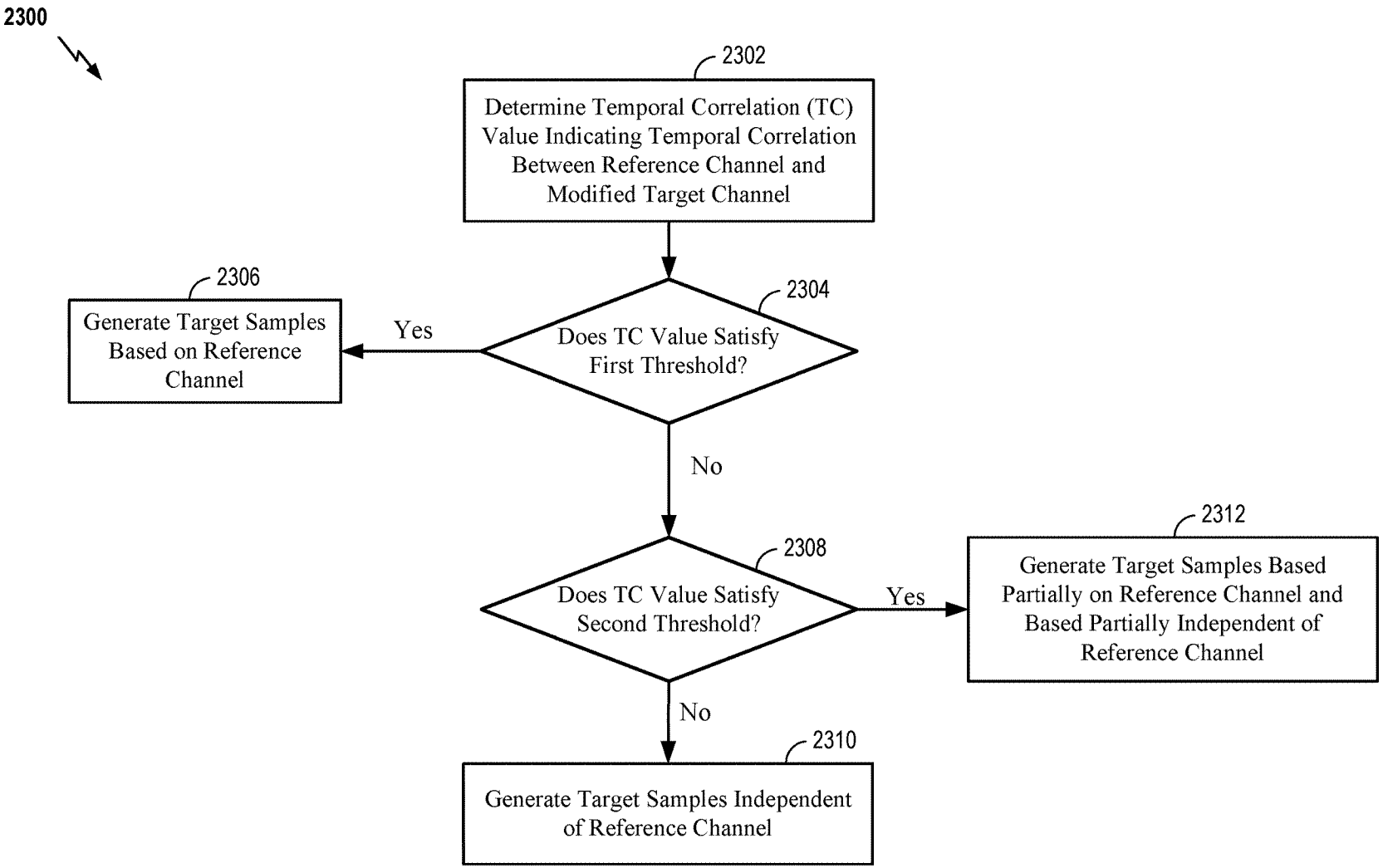
FIG. 23 is a process diagram for generating target samples for a temporally shifted target channel.

Referring to FIG. 23, a process diagram 2300 for generating target samples is shown. The operations associated with the process diagram 2300 may be performed by the encoder 114 of FIG. 1, the encoder 214 of FIG. 2, or both.

At 2302, an encoder may determine the temporal correlation value 192 indicating a temporal correlation between a reference channel and a modified target channel 194. As used herein, the "temporal correlation" may indicate a temporal alignment of the reference channel and the modified target channel 194, a temporal similarity of the reference channel and the modified target channel 194, a temporal short-term correlation between the reference channel and the modified target channel 194, a temporal long-term correlation between the reference channel and the modified target channel 194, or a combination thereof. If the first audio signal 130 is the reference channel (e.g., a leading audio channel of the two audio signals 130, 132) and the second audio signal 132 is the target channel (e.g., a lagging audio channel of the two audio signals 130, 132), the modified target channel 194 may correspond to the second audio signal 132 non-causally shifted by the final shift value 116.

As a non-limiting example, the temporal correlation value 192 may range from zero to one. A temporal correlation value 192 of one indicates a "strong correlation" between the reference channel and the modified target channel 194. For example, a temporal correlation value 192 of one may indicate that the reference channel and the modified target channel 194 are similar. A temporal correlation value 192 of zero indicates a "weak correlation" between the reference channel and the modified target channel 194. For example, a temporal correlation value 192 of zero may indicate that the reference channel and the modified target channel 194 are substantially temporally misaligned. In one example implementation, the temporal correlation may be estimated based on the short-term temporal correlation and the variation in the long-term correlation from frame-to-frame. The temporal correlation may also be based on the actual mismatch value and a variation in mismatch value. In another example implementation, the temporal correlation may be based on the coder type (e.g., unvoiced, voiced, music, inactive frame coding, etc.), target gain and the variation in the target gain from frame to frame.

At 2304, the encoder may determine whether the temporal correlation value 192 satisfies a first threshold. As a non-limiting example, the first threshold may be "0.8". Thus, if the temporal correlation value 192 is greater than or equal to "0.8", the temporal correlation value 192 may satisfy the first threshold. In other implementations, the first threshold may be another value, such as "0.9". If the temporal correlation value 192 satisfies the first threshold (e.g., if the reference channel and the modified target channel 194 are substantially temporally aligned), the encoder may generate target samples based on the reference channel, at 2306. For example, the encoder may use reference samples associated with the reference channel to generate missing target samples 196 resulting from time-shifting the target channel.

If the temporal correlation value 192 fails to satisfy the first threshold, the encoder may determine whether the temporal correlation value 192 satisfies a second threshold, at 2308. As a non-limiting example, the second threshold may be "0.1". Thus, if the temporal correlation value 192 is less than or equal to "0.1", the temporal correlation value 192 may fail to satisfy the second threshold. In other implementations, the second threshold may be another value, such as "0.2" or "0.15". If the temporal correlation value 192 fails to satisfy the second threshold (e.g., if the reference channel and the modified target channel 194 are substantially temporally misaligned), the encoder may generate target samples independent of the reference channel, at 2310. For example, the encoder may bypass use of the reference channel in generation of the missing target samples 196 in response to the determination, at 2308, that the temporal correlation value 192 fails to satisfy the second threshold. According to one implementation, the missing target samples 196 may be generated based on random noise filtered from a past set of samples of the modified target channel 194 using a linear predication filter in response to the determination that the temporal correlation value 192 fails to satisfy the second threshold. According to another implementation, the missing target samples 196 may be set to zero values in response to the determination that the temporal correlation value 192 fails to satisfy the second threshold. According to another implementation, the missing target samples 196 may be extrapolated from the modified target channel 194 in response to the determination that the temporal correlation value 192 fails to satisfy the second threshold.

If the temporal correlation value 192 satisfies the second threshold and fails to satisfy the first threshold, the encoder may generate target samples based partially on the reference channel and based partially independent of the reference channel, at 2312. As a non-limiting example, if the temporal correlation value 192 is between "0.8" and "0.1", the encoder may apply a first weight (w1) to an algorithm for generating the missing target samples 196 based on the reference samples of the reference channel and may apply a second weight (w2) to an algorithm for generating the missing target samples 196 independent of the reference channel. In some implementations, the second threshold and the first threshold may be equal and the selection of target signal missing sample generation is either based on the reference channel or independent of the reference channel.

In some implementations, the values of the first and second thresholds are based on parameters in the encoder 214 as opposed to fixed values. For example, the values of the first and second thresholds may be based on the coder type (e.g., unvoiced, voiced, music, inactive frame coding, etc.), the target gain, and the variation in the target gain from frame to frame.

In another example implementation, based on the coder type (e.g., unvoiced, voiced, music, active speech/music, inactive background noise frames), the missing target samples may be generated based on the reference channel or independent of the reference channel. At 2304, the encoder 214 may determine whether the input frame (e.g., a current frame or a previous frame) is a speech frame or a music/background noise frame. As a non-limiting example, if the input frame is determined to be a clean speech frame, the encoder 214 may generate target samples based on the reference channel, at 2306. For example, the encoder 214 may use reference samples associated with the reference channel to generate missing target samples 196 resulting from time-shifting the target channel.

At 2308, if the input frame is determined to be a music frame or background noise, the encoder 214 may generate or modify the target samples independent of the reference channel, at 2310. For example, the encoder 214 may bypass use of the reference channel in generation of the missing target samples or modifying/updating the target samples 196 in response to the determination, at 2308, that the input frame is determined to be a music/background noise frame. According to one implementation, the missing target samples 196 may be generated based on random noise filtered from a past set of samples of the modified target channel 194 using a linear prediction filter. According to another implementation, the missing target samples 196 may be set to zero values. According to another implementation, the missing target samples 196 may be extrapolated from the modified target channel 194. In another implementation, the update of the target samples 196 is at least based on an inter-channel level difference (ILD), or the ratio of inter-channel energies, or the inter-channel time difference (ICTD).

At 2308, if the input frame is determined to be a noisy speech or mixed music frame, the encoder 214 may generate target samples based partially on the reference channel and based partially independent of the reference channel, at 2312. As a non-limiting example, if the input frame is noisy speech (e.g., determined based on long-term noise level or signal-to-noise ratio), the encoder 214 may apply a first weight (w1) to an algorithm for generating the missing target samples 196 based on the reference samples of the reference channel and may apply a second weight (w2) to an algorithm for generating the missing target samples 196 independent of the reference channel. In some implementations, the second threshold and the first threshold may be equal and the selection of target signal missing sample generation is either based on the reference channel or independent of the reference channel.

In another implementation, the generation of the missing target samples may be based on a combination of whether the coder type is speech or music or background noise and whether the temporal correlation satisfies one of the first and second thresholds.

Figure 24:
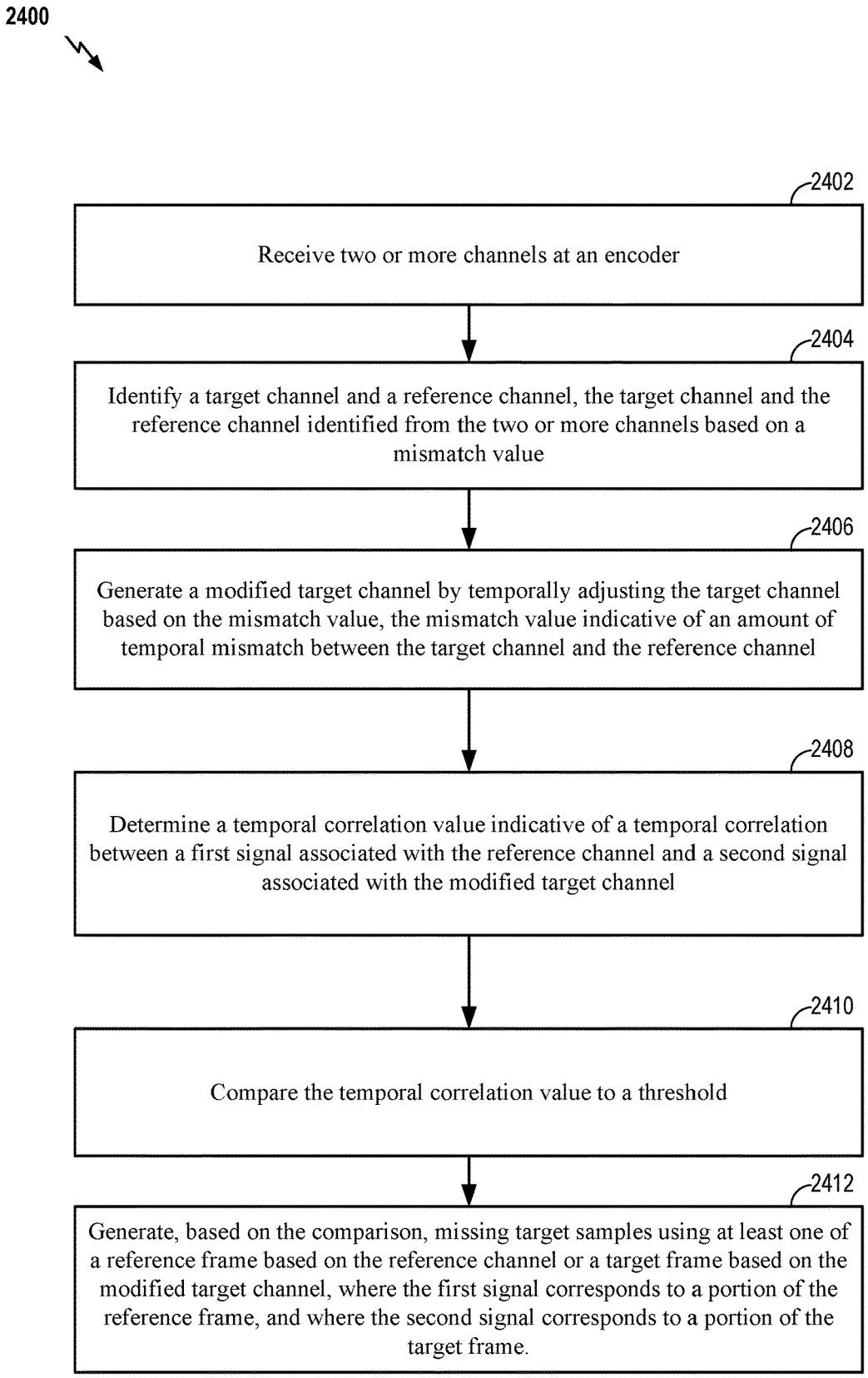
FIG. 24 is a flow chart illustrating a particular method of generating target samples for a temporally shifted target channel.

Referring to FIG. 24, a method 2400 of generating target samples is shown. The method 2400 may be performed by the encoder 114 of FIG. 1, the encoder 214 of FIG. 2, or both.

The method 2400 includes receiving two or more channels at an encoder, at 2402. For example, referring to FIG. 1, the encoder 114 may receive the first audio signal 130 from the first microphone 146 and may receive the second audio signal 132 from the second microphone 148.

The method 2400 also includes identifying a target channel and a reference channel, at 2404. The target channel and the reference channel are identified from the two or more channels based on a mismatch value. According to one implementation, the target channel may correspond to an audio channel that can be generated (e.g., estimated or derived) from the reference channel. The target channel may be a lagging channel of the two audio channels, and the reference channel may correspond to a spatially predominant channel of the two audio channels. For example, the encoder 114 may determine that the first audio signal 130 is the target channel and that the second audio signal 132 is the reference channel. In one example implementation, the encoder 114 may determine that the first audio signal 130 is a lagging audio channel and the second audio signal 132 is a leading audio channel.

The method 2400 also includes generating a modified target channel by temporally adjusting the target channel based on the mismatch value, at 2406. The mismatch value is indicative of an amount of temporal mismatch between the target channel and the reference channel. For example, the temporal equalizer 108 may generate the modified target channel 194 by temporally adjusting the first audio signal 130 (e.g., the target channel according to the method 2400) by the final shift value 116.

The method 2400 also includes determining a temporal correlation value indicative of a temporal correlation between a first signal associated with the reference channel and a second signal associated with the modified target channel, at 2408. The reference frame may include first reference samples associated with a first portion of the reference frame and second reference samples associated with a second portion of the reference frame. The target frame may include first target samples associated with a first portion of the target frame. For example, the encoder 114 may determine the temporal correlation value 192 indicative of the temporal similarity and short-term/long-term correlation between the frame 344 of the second audio signal 132 (e.g., the reference frame of the reference channel) and the frame 304 of the first audio signal 130 shifted by the final shift value 116 (e.g., the target frame of the modified target channel 194). The frame 344 may include first reference samples (e.g., samples 358, 360, 362) associated with a first portion of the second audio signal 132 and second reference samples (e.g., samples 364) associated with a second portion of the second audio signal 132. The frame 304 may include first target samples (e.g., samples 328, 330, 332) associated with a first portion of the first audio signal 130. In this particular example, FIG. 3, the first samples 320 are seen as the non-causally shifted target signal and the second samples 350 is seen as the reference signal.

The method 2400 also includes comparing the temporal correlation value to a threshold, at 2410. For example, the encoder 114 may compare the temporal correlation value 192 to a threshold. The method 2400 may also include generating, based on the comparison, missing target samples using at least one of a reference frame based on the reference channel or a target frame based on the modified target channel, at 2412. The first signal corresponds to a portion of the reference frame, and the second signal corresponds to a portion of the target frame. According to some implementations, the method 2400 includes selecting how the reference channel is used to generate the missing target samples based on the comparison. As used herein, selecting "how" to use the reference channel to generate the missing target samples may include selecting a target sample generation scheme from a plurality of target sample generation schemes.

To illustrate, the plurality of target sample generation schemes may include a first scheme where the missing target samples 334 are generated based on the reference channel, a second scheme where the missing target samples 334 are generated based on random noise filtered from a past set of samples of the modified target channel 194 using a linear prediction filter, or a third scheme where the missing target samples 334 are generated by scaling the modified target channel 194 (e.g., by zero). The plurality of target sample generation schemes may also include a fourth scheme where the missing target samples 334 are extrapolated from the modified target channel 194 or a fifth scheme where the missing target samples 334 are generated partially based on the reference channel and partially based on random noise filtered from a past set of samples of the modified target channel 194 using a linear prediction filter. The plurality of target sample generation schemes may also include a sixth scheme where the missing target samples are generated partially based on the reference channel and partially based on scaling the modified target channel 194 (e.g., by zero) or a seventh scheme where the missing target samples 334 are generated partially based on the reference channel and partially based on extrapolations from the modified target channel 194. Thus, selecting "how" to use the reference channel to generate the missing target samples may also include selecting "whether" to use the reference channel in generation of the target reference samples.

If the encoder 114 determines that the temporal correlation value 192 satisfies a first threshold, the encoder 114 may generate the missing target samples 196 based on the second audio signal 132 (e.g., the reference channel). However, if the encoder 114 determines that the temporal correlation value 192 fails to satisfy a second threshold, the encoder 114 may generate the missing target samples 196 without using the second audio signal 132. For example, the encoder 114 may generate the missing target samples 196 based on random noise filtered from a past set of samples of the modified target channel using a linear prediction filter in response to the determination that the temporal correlation value 192 fails to satisfy the second threshold. As another example, the encoder 114 may generate the missing target samples 196 by scaling the modified target channel 194 to zero values in response to the determination that the temporal correlation value 192 fails to satisfy the second threshold. As another example, the missing target samples 196 may be extrapolated from the modified target channel 194 in response to the determination that the temporal correlation value 192 fails to satisfy the second threshold.

According to one implementation, the method 2400 may include determining that the temporal correlation value 192 fails to satisfy a first threshold (e.g., strong correlation threshold) and the temporal correlation value 192 satisfies a second threshold (e.g., a weak correlation threshold) that is lower than the first threshold. As a non-limiting example, the encoder 114 may determine that the temporal correlation value 192 is less than "0.8" and greater than "0.1". As a result, the encoder 114 may generate the missing target samples 196 partially based on the reference channel (e.g., the second audio signal 132) and partially based on either random noise filtered from a past set of samples of the modified target channel 194, zero values, or extrapolations from the modified target channel 194.

According to one implementation of the method 2400, a single threshold may be used to determine how the missing target samples 196 are generated. A non-limiting example of the single threshold may be "0.5". However, in other implementations, different values may be used for the single threshold, such as "0.6", "0.65", "0.7", etc. If the temporal correlation value 192 satisfies the single threshold (e.g., is greater than or equal to the single threshold), the missing target samples 196 may be generated using the reference channel. However, if the temporal correlation value 192 fails to satisfy the single threshold, the missing target samples 196 may be generated based on random noise filtered from a previous target frame, based on an extrapolation of the target channel, based on zero values, or based on a combination thereof.

According to another implementation of the method 2400, three or more thresholds may be used to determine how the missing target samples 196 are generated. As a non-limiting example, if a first threshold (e.g., a strong correlation threshold) is satisfied, the missing target samples 196 may be generated based on the reference channel. If the first threshold is not satisfied and a second threshold (e.g., a medium correlation threshold) is satisfied, the missing target samples 196 may be generated based on random noise filtered from a previous target frame. If neither the first threshold nor the second threshold is satisfied and a third threshold (e.g., a low correlation threshold) is satisfied, the missing target samples 196 may be generated based on extrapolations from the target channel. Additionally, if neither the first, second, nor third thresholds are satisfied and a fourth threshold (e.g., a micro correlation threshold) is satisfied, the missing target samples 196 may be set to zero values. It should be understood that the scenarios presented above are for illustrative purposes only and should not be construed as limiting. In other implementations, different techniques for generating the missing target samples 196 may be applied for different thresholds. As a non-limiting example, the missing target samples 196 may be set to zero values if neither the first threshold nor the second threshold is satisfied and the third threshold (e.g., the low correlation threshold) is satisfied.

According to another implementation, the method 2400 may also include sending a frame from a first device to a second device. The frame may include the first reference samples associated with the reference frame, the second reference samples associated with the reference frame, the first target samples associated with the target frame, and the missing target samples 196 associated with the target frame. For example, referring to FIG. 1, the first device 104 may send the frame to the second device 106 as bare of the encoded signals 102.

Figure 25:
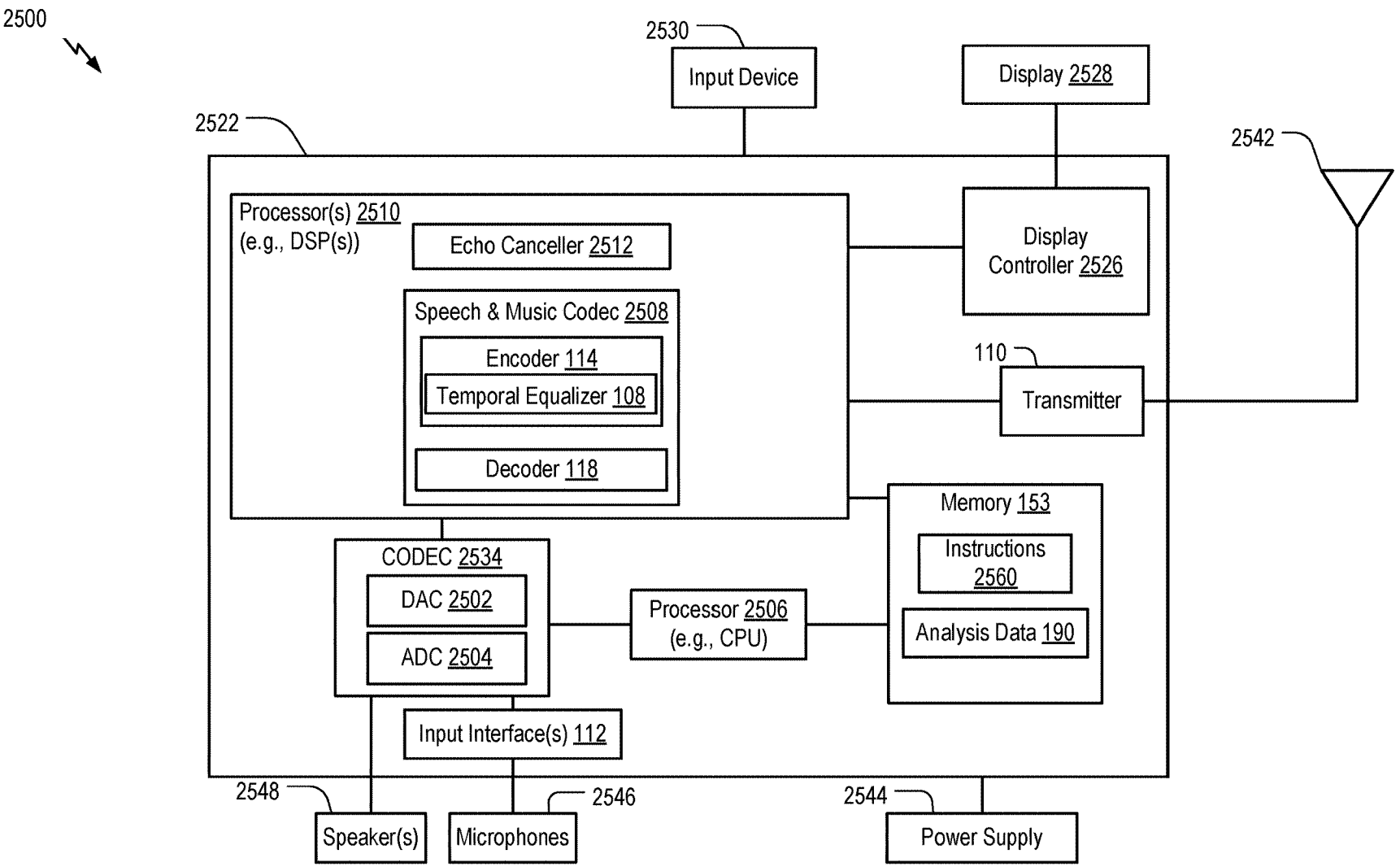
FIG. 25 is a block diagram of a particular illustrative example of a device that is operable to encode multiple audio signals.

Referring to FIG. 25, a block diagram of a particular illustrative example of a device (e.g., a wireless communication device) is depicted and generally designated 2500. In various aspects, the device 2500 may have fewer or more components than illustrated in FIG. 25. In an illustrative aspect, the device 2500 may correspond to the first device 104 or the second device 106 of FIG. 1. In an illustrative aspect, the device 2500 may perform one or more operations described with reference to systems and methods of FIGS. 1-24.

In a particular aspect, the device 2500 includes a processor 2506 (e.g., a central processing unit (CPU)). The device 2500 may include one or more additional processors 2510 (e.g., one or more digital signal processors (DSPs)). The processors 2510 may include a media (e.g., speech and music) coder-decoder (CODEC) 2508, and an echo canceller 2512. The media CODEC 2508 may include the decoder 118, the encoder 114, or both, of FIG. 1. The encoder 114 may include the temporal equalizer 108.

The device 2500 may include a memory 153 and a CODEC 2534. Although the media CODEC 2508 is illustrated as a component of the processors 2510 (e.g., dedicated circuitry and/or executable programming code), in other aspects one or more components of the media CODEC 2508, such as the decoder 118, the encoder 114, or both, may be included in the processor 2506, the CODEC 2534, another processing component, or a combination thereof.

The device 2500 may include the transmitter 110 coupled to an antenna 2542. The device 2500 may include a display 2528 coupled to a display controller 2526. One or more speakers 2548 may be coupled to the CODEC 2534. One or more microphones 2546 may be coupled, via the input interface(s) 112, to the CODEC 2534. In a particular aspect, the speakers 2548 may include the first loudspeaker 142, the second loudspeaker 144 of FIG. 1, the Yth loudspeaker 244 of FIG. 2, or a combination thereof. In a particular aspect, the microphones 2546 may include the first microphone 146, the second microphone 148 of FIG. 1, the Nth microphone 248 of FIG. 2, the third microphone 1146, the fourth microphone 1148 of FIG. 11, or a combination thereof. The CODEC 2534 may include a digital-to-analog converter (DAC) 2502 and an analog-to-digital converter (ADC) 2504.

The memory 153 may include instructions 2560 executable by the processor 2506, the processors 2510, the CODEC 2534, another processing unit of the device 2500, or a combination thereof, to perform one or more operations described with reference to FIGS. 1-24. The memory 153 may store the analysis data 190.

According to one implementation, the instructions 2560 may be executable to cause a processor (e.g., the processor 2506, the processor 2510, or the encoder 114) to perform operations including receiving two audio channels (e.g., the audio channels 130, 132) and identifying a target channel and a reference channel. The target channel may correspond to an audio channel that can be generated (e.g., estimated or derived) from the reference channel. The target channel may be a lagging channel of the two audio channels, and the reference channel may correspond to a spatially predominant channel of the two audio channels. The operations may also include generating a modified target channel (e.g., the modified target channel 194) by temporally shifting the target channel based on a mismatch value (e.g., the final shift value 116). The mismatch value may be indicative of an amount of temporal mismatch between the target channel and the reference channel. The operations may also include determining a temporal correlation value (e.g., the temporal correlation value 192) indicative of a temporal similarity and short-term and long-term correlation between a reference frame of the reference channel and a corresponding target frame of the modified target channel. The reference frame may include first reference samples associated with a first portion of the reference frame and second reference samples associated with a second portion of the reference frame. The target frame may include first target samples associated with a first portion of the target frame. The operations may also include selecting, based on the temporal correlation value 192, how to use the reference channel to generate missing target samples (e.g., the missing target samples 196) associated with a second portion of the target frame. The operations may further include generating the missing target samples based on the selection.

One or more components of the device 2500 may be implemented via dedicated hardware (e.g., circuitry), by a processor executing instructions to perform one or more tasks, or a combination thereof. As an example, the memory 153 or one or more components of the processor 2506, the processors 2510, and/or the CODEC 2534 may be a memory device (e.g., a computer-readable storage device), such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include (e.g., store) instructions (e.g., the instructions 2560) that, when executed by a computer (e.g., a processor in the CODEC 2534, the processor 2506, and/or the processors 2510), may cause the computer to perform one or more operations described with reference to FIGS. 1-24. As an example, the memory 153 or the one or more components of the processor 2506, the processors 2510, and/or the CODEC 2534 may be a non-transitory computer-readable medium that includes instructions (e.g., the instructions 2560) that, when executed by a computer (e.g., a processor in the CODEC 2534, the processor 2506, and/or the processors 2510), cause the computer perform one or more operations described with reference to FIGS. 1-24.

In a particular aspect, the device 2500 may be included in a system-in-package or system-on-chip device (e.g., a mobile station modem (MSM)) 2522. In a particular aspect, the processor 2506, the processors 2510, the display controller 2526, the memory 153, the CODEC 2534, and the transmitter 110 are included in a system-in-package or the system-on-chip device 2522. In a particular aspect, an input device 2530, such as a touchscreen and/or keypad, and a power supply 2544 are coupled to the system-on-chip device 2522. Moreover, in a particular aspect, as illustrated in FIG. 25, the display 2528, the input device 2530, the speakers 2548, the microphones 2546, the antenna 2542, and the power supply 2544 are external to the system-on-chip device 2522. However, each of the display 2528, the input device 2530, the speakers 2548, the microphones 2546, the antenna 2542, and the power supply 2544 can be coupled to a component of the system-on-chip device 2522, such as an interface or a controller.

The device 2500 may include a wireless telephone, a mobile communication device, a mobile device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular aspect, one or more components of the systems described with reference to FIGS. 1-24 and the device 2500 may be integrated into a decoding system or apparatus (e.g., an electronic device, a CODEC, or a processor therein), into an encoding system or apparatus, or both. In other aspects, one or more components of the systems described with reference to FIGS. 1-24 and the device 2500 may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems described with reference to FIGS. 1-24 and the device 2500 are described as being performed by certain components or modules. This division of components and modules is for illustration only. In an alternate aspect, a function performed by a particular component or module may be divided amongst multiple components or modules. Moreover, in an alternate aspect, two or more components or modules described with reference to FIGS. 1-24 may be integrated into a single component or module. Each component or module described with reference to FIGS. 1-24 may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described aspects, an apparatus includes means for receiving two or more channels. For example, the means for receiving the two audio channels may include the first microphone 146 of FIG. 1, the second microphone 148 of FIG. 1, the microphones 2546 of FIG. 25, or any combination thereof.

The apparatus may also include means for identifying a target channel and a reference channel. The target channel and the reference channel may be identified form the two or more channels based on a mismatch value. The target channel may correspond to an audio channel that can be generated (e.g., estimated or derived) from the reference channel. The target channel may be a lagging channel of the two audio channels, and the reference channel may correspond to a spatially predominant channel of the two audio channels. For example, the means for identifying may include the temporal equalizer 108, the encoder 114, the first device 104 of FIG. 1, the media CODEC 2508, the processors 2510, the device 2500, one or more devices configured to determine a mismatch value (e.g., a processor executing instructions that are stored at a computer-readable storage device), or a combination thereof.

The apparatus may also include means for generating a modified target channel by temporally adjusting the target channel based on the mismatch value. The mismatch value may be indicative of an amount of temporal mismatch between the target channel and the reference channel. For example, the means for generating the modified target channel may include the temporal equalizer 108, the encoder 114, the first device 104 of FIG. 1, the media CODEC 2508, the processors 2510, the device 2500, one or more devices configured to determine a mismatch value (e.g., a processor executing instructions that are stored at a computer-readable storage device), or a combination thereof.

The apparatus may also include means for determining a temporal correlation value indicative of a temporal correlation between a first signal associated with the reference channel and a second signal associated with the modified target channel. The reference frame may include first reference samples associated with a first portion of the reference frame and second reference samples associated with a second portion of the reference frame. The target frame may include first target samples associated with a first portion of the target frame. For example, the means for determining the temporal correlation value may include the temporal equalizer 108, the encoder 114, the first device 104 of FIG. 1, the media CODEC 2508, the processors 2510, the device 2500, one or more devices configured to determine a mismatch value (e.g., a processor executing instructions that are stored at a computer-readable storage device), or a combination thereof.

The apparatus may also include means for comparing the temporal correlation value to a threshold. For example, the means for comparing may include the temporal equalizer 108, the encoder 114, the first device 104 of FIG. 1, the media CODEC 2508, the processors 2510, the device 2500, one or more devices configured to determine a mismatch value (e.g., a processor executing instructions that are stored at a computer-readable storage device), or a combination thereof.

The apparatus may also include means for generating, based on the comparison, missing target samples using at least one of a reference frame based on the reference channel or a target channel based on the modified target channel. The first signal corresponds to a portion of the reference frame, and the second signal corresponds to a portion of the target frame. For example, the means for generating may include the temporal equalizer 108, the encoder 114, the first device 104 of FIG. 1, the media CODEC 2508, the processors 2510, the device 2500, one or more devices configured to determine a mismatch value (e.g., a processor executing instructions that are stored at a computer-readable storage device), or a combination thereof.

Figure 26:
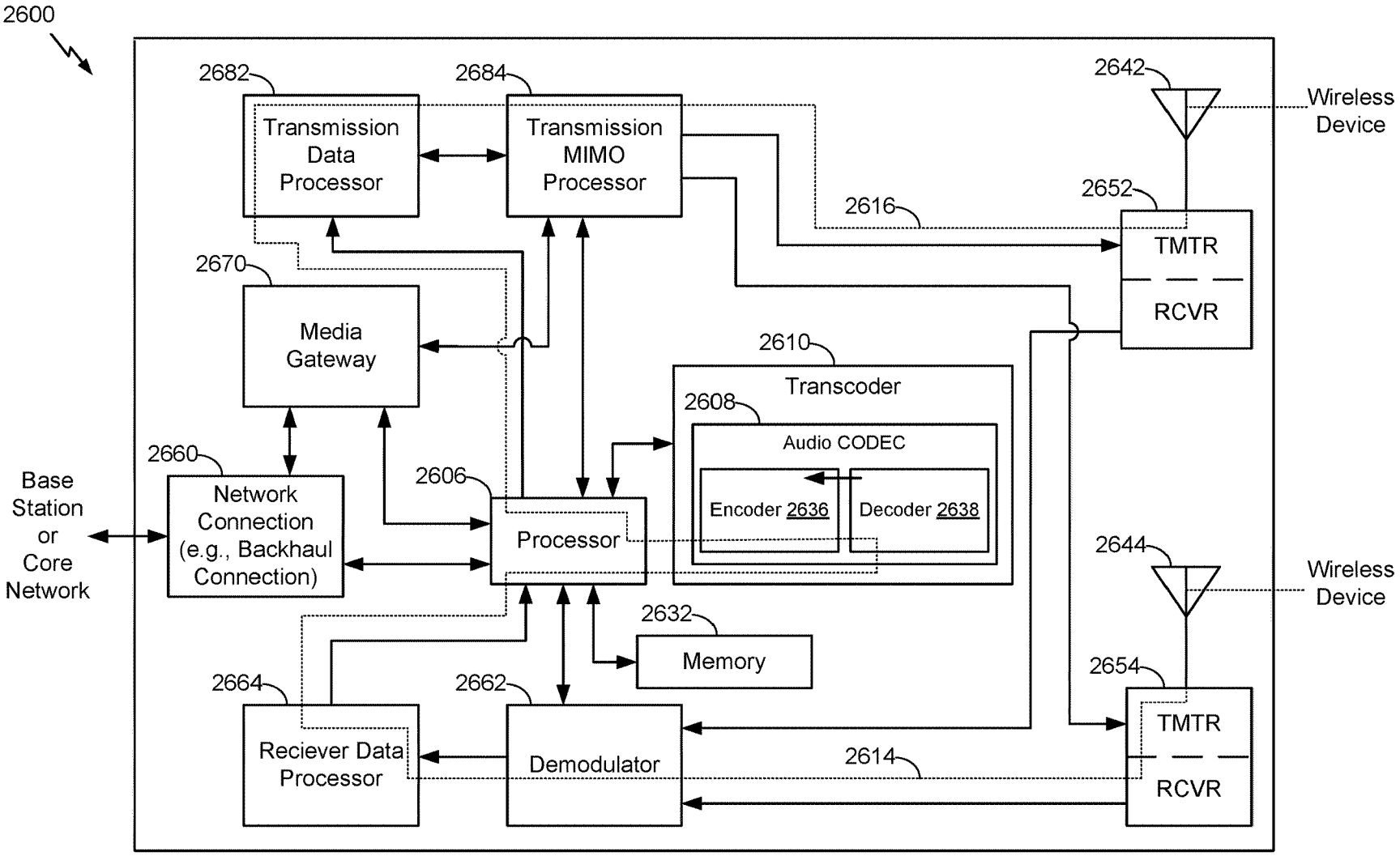
FIG. 26 is a block diagram of a base station that is operable to encode multiple audio signals.

Referring to FIG. 26, a block diagram of a particular illustrative example of a base station 2600 is depicted. In various implementations, the base station 2600 may have more components or fewer components than illustrated in FIG. 26. In an illustrative example, the base station 2600 may include the first device 104, the second device 106 of FIG. 1, the first device 204 of FIG. 2, or a combination thereof. In an illustrative example, the base station 2600 may operate according to one or more of the methods or systems described with reference to FIGS. 1-23.

The base station 2600 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 2300 of FIG. 23.

Various functions may be performed by one or more components of the base station 2600 (and/or in other components not shown), such as sending and receiving messages and data (e.g., audio data). In a particular example, the base station 2600 includes a processor 2606 (e.g., a CPU). The base station 2600 may include a transcoder 2610. The transcoder 2610 may include an audio CODEC 2608. For example, the transcoder 2610 may include one or more components (e.g., circuitry) configured to perform operations of the audio CODEC 2608. As another example, the transcoder 2610 may be configured to execute one or more computer-readable instructions to perform the operations of the audio CODEC 2608. Although the audio CODEC 2608 is illustrated as a component of the transcoder 2610, in other examples one or more components of the audio CODEC 2608 may be included in the processor 2606, another processing component, or a combination thereof. For example, a decoder 2638 (e.g., a vocoder decoder) may be included in a receiver data processor 2664. As another example, an encoder 2636 (e.g., a vocoder encoder) may be included in a transmission data processor 2682.

The transcoder 2610 may function to transcode messages and data between two or more networks. The transcoder 2610 may be configured to convert message and audio data from a first format (e.g., a digital format) to a second format. To illustrate, the decoder 2638 may decode encoded signals having a first format and the encoder 2636 may encode the decoded signals into encoded signals having a second format. Additionally or alternatively, the transcoder 2610 may be configured to perform data rate adaptation. For example, the transcoder 2610 may downconvert a data rate or upconvert the data rate without changing a format the audio data. To illustrate, the transcoder 2610 may downconvert 64 kbit/s signals into 16 kbit/s signals.

The audio CODEC 2608 may include the encoder 2636 and the decoder 2638. The encoder 2636 may include the encoder 114 of FIG. 1, the encoder 214 of FIG. 2, or both. The decoder 2638 may include the decoder 118 of FIG. 1.

The base station 2600 may include a memory 2632. The memory 2632, such as a computer-readable storage device, may include instructions. The instructions may include one or more instructions that are executable by the processor 2606, the transcoder 2610, or a combination thereof, to perform one or more operations described with reference to the methods and systems of FIGS. 1-25. The base station 2600 may include multiple transmitters and receivers (e.g., transceivers), such as a first transceiver 2652 and a second transceiver 2654, coupled to an array of antennas. The array of antennas may include a first antenna 2642 and a second antenna 2644. The array of antennas may be configured to wirelessly communicate with one or more wireless devices, such as the device 2500 of FIG. 25. For example, the second antenna 2644 may receive a data stream 2614 (e.g., a bit stream) from a wireless device. The data stream 2614 may include messages, data (e.g., encoded speech data), or a combination thereof.

The base station 2600 may include a network connection 2660, such as backhaul connection. The network connection 2660 may be configured to communicate with a core network or one or more base stations of the wireless communication network. For example, the base station 2600 may receive a second data stream (e.g., messages or audio data) from a core network via the network connection 2660. The base station 2600 may process the second data stream to generate messages or audio data and provide the messages or the audio data to one or more wireless device via one or more antennas of the array of antennas or to another base station via the network connection 2660. In a particular implementation, the network connection 2660 may be a wide area network (WAN) connection, as an illustrative, non-limiting example. In some implementations, the core network may include or correspond to a Public Switched Telephone Network (PSTN), a packet backbone network, or both.

The base station 2600 may include a media gateway 2670 that is coupled to the network connection 2660 and the processor 2606. The media gateway 2670 may be configured to convert between media streams of different telecommunications technologies. For example, the media gateway 2670 may convert between different transmission protocols, different coding schemes, or both. To illustrate, the media gateway 2670 may convert from PCM signals to Real-Time Transport Protocol (RTP) signals, as an illustrative, non-limiting example. The media gateway 2670 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 2670 may include a transcoder, such as the transcoder 610, and may be configured to transcode data when codecs are incompatible. For example, the media gateway 2670 may transcode between an Adaptive Multi-Rate (AMR) codec and a G.711 codec, as an illustrative, non-limiting example. The media gateway 2670 may include a router and a plurality of physical interfaces. In some implementations, the media gateway 2670 may also include a controller (not shown). In a particular implementation, the media gateway controller may be external to the media gateway 2670, external to the base station 2600, or both. The media gateway controller may control and coordinate operations of multiple media gateways. The media gateway 2670 may receive control signals from the media gateway controller and may function to bridge between different transmission technologies and may add service to end-user capabilities and connections.

The base station 2600 may include a demodulator 2662 that is coupled to the transceivers 2652, 2654, the receiver data processor 2664, and the processor 2606, and the receiver data processor 2664 may be coupled to the processor 2606. The demodulator 2662 may be configured to demodulate modulated signals received from the transceivers 2652, 2654 and to provide demodulated data to the receiver data processor 2664. The receiver data processor 2664 may be configured to extract a message or audio data from the demodulated data and send the message or the audio data to the processor 2606.

The base station 2600 may include a transmission data processor 2682 and a transmission multiple input-multiple output (MIMO) processor 2684. The transmission data processor 2682 may be coupled to the processor 2606 and the transmission MIMO processor 2684. The transmission MIMO processor 2684 may be coupled to the transceivers 2652, 2654 and the processor 2606. In some implementations, the transmission MIMO processor 2684 may be coupled to the media gateway 2670. The transmission data processor 2682 may be configured to receive the messages or the audio data from the processor 2606 and to code the messages or the audio data based on a coding scheme, such as CDMA or orthogonal frequency-division multiplexing (OFDM), as an illustrative, non-limiting examples. The transmission data processor 2682 may provide the coded data to the transmission MIMO processor 2684.

The coded data may be multiplexed with other data, such as pilot data, using CDMA or OFDM techniques to generate multiplexed data. The multiplexed data may then be modulated (i.e., symbol mapped) by the transmission data processor 2682 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 2606.

The transmission MIMO processor 2684 may be configured to receive the modulation symbols from the transmission data processor 2682 and may further process the modulation symbols and may perform beamforming on the data. For example, the transmission MIMO processor 2684 may apply beamforming weights to the modulation symbols. The beamforming weights may correspond to one or more antennas of the array of antennas from which the modulation symbols are transmitted.

During operation, the second antenna 2644 of the base station 2600 may receive a data stream 2614. The second transceiver 2654 may receive the data stream 2614 from the second antenna 2644 and may provide the data stream 2614 to the demodulator 2662. The demodulator 2662 may demodulate modulated signals of the data stream 2614 and provide demodulated data to the receiver data processor 2664. The receiver data processor 2664 may extract audio data from the demodulated data and provide the extracted audio data to the processor 2606.

The processor 2606 may provide the audio data to the transcoder 2610 for transcoding. The decoder 2638 of the transcoder 2610 may decode the audio data from a first format into decoded audio data and the encoder 2636 may encode the decoded audio data into a second format. In some implementations, the encoder 2636 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 2610, the transcoding operations (e.g., decoding and encoding) may be performed by multiple components of the base station 2600. For example, decoding may be performed by the receiver data processor 2664 and encoding may be performed by the transmission data processor 2682. In other implementations, the processor 2606 may provide the audio data to the media gateway 2670 for conversion to another transmission protocol, coding scheme, or both. The media gateway 2670 may provide the converted data to another base station or core network via the network connection 2660.

The encoder 2636 may determine the final shift value 116 indicative of a time delay between the first audio signal 130 and the second audio signal 132. The encoder 2636 may generate the encoded signals 102, the gain parameter 160, or both, by encoding the first audio signal 130 and the second audio signal 132 based on the final shift value 116. The encoder 2636 may generate the reference signal indicator 164 and the non-causal shift value 162 based on the final shift value 116. The decoder 118 may generate the first output signal 126 and the second output signal 128 by decoding encoded signals based on the reference signal indicator 164, the non-causal shift value 162, the gain parameter 160, or a combination thereof. Encoded audio data generated at the encoder 2636, such as transcoded data, may be provided to the transmission data processor 2682 or the network connection 2660 via the processor 2606.

The transcoded audio data from the transcoder 2610 may be provided to the transmission data processor 2682 for coding according to a modulation scheme, such as OFDM, to generate the modulation symbols. The transmission data processor 2682 may provide the modulation symbols to the transmission MIMO processor 2684 for further processing and beamforming. The transmission MIMO processor 2684 may apply beamforming weights and may provide the modulation symbols to one or more antennas of the array of antennas, such as the first antenna 2642 via the first transceiver 2652. Thus, the base station 2600 may provide a transcoded data stream 2616, that corresponds to the data stream 2614 received from the wireless device, to another wireless device. The transcoded data stream 2616 may have a different encoding format, data rate, or both, than the data stream 2614. In other implementations, the transcoded data stream 2616 may be provided to the network connection 2660 for transmission to another base station or a core network.

The base station 2600 may therefore include a computer-readable storage device (e.g., the memory 2632) storing instructions that, when executed by a processor (e.g., the processor 2606 or the transcoder 2610), cause the processor to perform operations including determining a shift value indicative of an amount of time delay between a first audio signal and a second audio signal. The first audio signal is received via a first microphone and the second audio signal is received via a second microphone. The operations also including generating a time-shifted second audio signal by shifting the second audio signal based on the shift value. The operations further including generating at least one encoded signal based on first samples of the first audio signal and second samples of the time-shifted second audio signal. The operations also including sending the at least one encoded signal to a device.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A device comprising:

an encoder configured to:

receive two or more channels;

identify a target channel and a reference channel, the target channel and the reference channel identified from the two or more channels based on a mismatch value;

generate a modified target channel by temporally adjusting the target channel based on the mismatch value, the mismatch value indicative of an amount of temporal mismatch between the target channel and the reference channel;

determine a temporal correlation value indicative of a temporal correlation between a first signal associated with the reference channel and a second signal associated with the modified target channel;

compare the temporal correlation value to a threshold; and generate, based on the comparison, missing target samples using at least one of a reference frame based on the reference channel or a target frame based on the modified target channel, wherein the first signal corresponds to a portion of the reference frame, and wherein the second signal corresponds to a portion of the target frame.

2. The device of claim 1, wherein the reference frame comprises first reference samples associated with a first portion of the reference frame and second reference samples associated with a second portion of the reference frame, and wherein the target frame comprises first target samples associated with a first portion of the target frame.

3. The device of claim 1, wherein the encoder is further configured to determine that the temporal correlation value satisfies the threshold, and wherein the missing target samples are generated based on the reference channel in response to the determination that the temporal correlation value satisfies the threshold.

4. The device of claim 1, wherein the encoder is further configured to determine that the temporal correlation value fails to satisfy the threshold, and wherein the missing target samples are generated based on random noise filtered from a past set of samples of the modified target channel using a linear prediction filter in response to the determination that the temporal correlation value fails to satisfy the threshold.

5. The device of claim 1, wherein the encoder is further configured to determine that the temporal correlation value fails to satisfy the threshold, and wherein the missing target samples are generated by scaling the modified target channel to zero in response to the determination that the temporal correlation value fails to satisfy the threshold.

6. The device of claim 1, wherein the encoder is further configured to determine that the temporal correlation value fails to satisfy the threshold, and wherein the missing target samples are extrapolated from the modified target channel in response to the determination that the temporal correlation value fails to satisfy the threshold.

7. The device of claim 1, wherein the missing target samples are generated partially based on the reference channel and partially based on random noise filtered from a past set of samples of the modified target channel using a linear prediction filter.

8. The device of claim 1, wherein the missing target samples are generated partially based on the reference channel and partially based on scaling the modified target channel to zero.

9. The device of claim 1, wherein the missing target samples are generated partially based on the reference channel and partially based on extrapolations from the modified target channel.

10. The device of claim 1, wherein adjustment of the target channel is based on a non-causal shift.

11. The device of claim 1, wherein the missing target samples are further based on a coder type.

12. The device of claim 1, wherein the reference frame is based on an excitation of the reference channel, and wherein the target frame is based on an excitation of the modified target channel.

13. The device of claim 1, wherein the encoder is integrated into a mobile device.

14. The device of claim 1, wherein the encoder is integrated into a base station.

15. A method of encoding audio channels, the method comprising:

receiving two or more channels at an encoder;

identifying a target channel and a reference channel, the target channel and the reference channel identified from the two or more channels based on a mismatch value;

generating a modified target channel by temporally adjusting the target channel based on the mismatch value, the mismatch value indicative of an amount of temporal mismatch between the target channel and the reference channel;

determining a temporal correlation value indicative of a temporal correlation between a first signal associated with the reference channel and a second signal associated with the modified target channel;

comparing the temporal correlation value to a threshold; and generating, based on the comparison, missing target samples using at least one of a reference frame based on the reference channel or a target frame based on the modified target channel, wherein the first signal corresponds to a portion of the reference frame, and wherein the second signal corresponds to a portion of the target frame.

16. The method of claim 15, wherein the reference frame comprises first reference samples associated with a first portion of the reference frame and second reference samples associated with a second portion of the reference frame, and wherein the target frame comprises first target samples associated with a first portion of the target frame.

17. The method of claim 15, further comprising determining that the temporal correlation value satisfies the threshold, wherein the missing target samples are generated based on the reference channel in response to the determination that the temporal correlation value satisfies the threshold.

18. The method of claim 15, further comprising determining that the temporal correlation value fails to satisfy the threshold, wherein the missing target samples are generated based on random noise filtered from a past set of samples of the modified target channel using a linear prediction filter in response to the determination that the temporal correlation value fails to satisfy the threshold.

19. The method of claim 15, further comprising determining that the temporal correlation value fails to satisfy the threshold, wherein the missing target samples are generated by scaling the modified target channel to zero in response to the determination that the temporal correlation value fails to satisfy the threshold.

20. The method of claim 15, further comprising determining that the temporal correlation value fails to satisfy the threshold, wherein the missing target samples are extrapolated from the modified target channel in response to the determination that the temporal correlation value fails to satisfy the threshold.

21. The method of claim 15, wherein the missing target samples are generated partially based on the reference channel and partially based on random noise filtered from a past set of samples of the modified target channel using a linear prediction filter.

22. The method of claim 15, wherein generating the missing target samples is performed at a mobile device.

23. The method of claim 15, wherein generating the missing target samples is performed at a base station.

24. A non-transitory computer-readable medium comprising instructions that, when executed by a processor within an encoder, cause the processor to perform operations comprising:

identifying a target channel and a reference channel, the target channel and the reference channel identified from two or more channels based on a mismatch value;

generating a modified target channel by temporally adjusting the target channel based on the mismatch value, the mismatch value indicative of an amount of temporal mismatch between the target channel and the reference channel;

determining a temporal correlation value indicative of a temporal correlation between a first signal associated with the reference channel and a second signal associated with the modified target channel;

comparing the temporal correlation value to a threshold; and generating, based on the comparison, missing target samples using at least one of a reference frame based on the reference channel or a target frame based on the modified target channel, wherein the first signal corresponds to a portion of the reference frame, and wherein the second signal corresponds to a portion of the target frame.

25. The non-transitory computer-readable medium of claim 24, wherein the reference frame comprises first reference samples associated with a first portion of the reference frame and second reference samples associated with a second portion of the reference frame, and wherein the target frame comprises first target samples associated with a first portion of the target frame.

26. The non-transitory computer-readable medium of claim 24, wherein the operations further comprise determining that the temporal correlation value satisfies the threshold, and wherein the missing target samples are generated based on the reference channel in response to the determination that the temporal correlation value satisfies the threshold.

27. The non-transitory computer-readable medium of claim 24, wherein the operations further comprise determining that the temporal correlation value fails to satisfy the threshold, and wherein the missing target samples are generated based on random noise filtered from a past set of samples of the modified target channel using a linear prediction filter in response to the determination that the temporal correlation value fails to satisfy the threshold.

* * * * *